US006352821B1

(12) United States Patent
Makuta et al.

(10) Patent No.: US 6,352,821 B1
(45) Date of Patent: Mar. 5, 2002

(54) METHOD FOR FORMING COLOR IMAGE USING SILVER HALIDE COLOR PHOTOGRAPHIC LIGHT-SENSITIVE MATERIAL

(75) Inventors: Toshiyuki Makuta; Koichi Nakamura, both of Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/675,489

(22) Filed: Sep. 29, 2000

(30) Foreign Application Priority Data

Sep. 30, 1999 (JP) ..... 11-280107

(51) Int. Cl.[7] ..... G03C 7/30
(52) U.S. Cl. ..... 430/405; 430/448
(58) Field of Search ..... 430/405, 448

(56) References Cited

U.S. PATENT DOCUMENTS 6,057,086 A * 5/2000 Nakamura et al. ..... 430/543
6,060,225 A * 5/2000 Makuta ..... 430/405
6,218,088 B1 * 4/2001 Arakawa ..... 430/351

* cited by examiner

*Primary Examiner*—Hoa Van Le
(74) *Attorney, Agent, or Firm*—Birch, Stewart, Kolasch & Birch, LLP

(57) ABSTRACT

There is disclosed a method of forming a color image that comprises processing a silver halide color photographic light-sensitive material having at least one photographic constitutional layer on a support, wherein the processing substantially comprises a developing step and subsequent thereto a step of supplying an acidic solution having a pH of 4 or less, in the form of a thin layer, onto the light-sensitive material, so as to have a coverage of 30 ml/m$^2$ or less, omitting both the washing and desilvering steps, and wherein the total of the coating silver amount in each of the coating layers of the light-sensitive material is in the range of 0.003 to 0.3 g/m$^2$ in terms of silver. According to this method, both a highly enhanced convenience of the processing and a simplicity and miniaturization of the processing apparatus can be realized by using a silver halide color photographic light-sensitive material that is excellent in coloring property, storage stability, dye image fastness and hue, and moreover by omitting both the washing and desilvering steps. Further, a stain occurring after processing a light-sensitive material can be lessened.

12 Claims, 2 Drawing Sheets

METHOD FOR FORMING COLOR IMAGE USING SILVER HALIDE COLOR PHOTOGRAPHIC LIGHT-SENSITIVE MATERIAL

FIELD OF THE INVENTION

The present invention relates to a color photographic art. Particularly, it relates to a color image-forming method that is able to accomplish considerable improvement in simplification (convenience) of processing by the use of a silver halide color photographic light-sensitive material that is excellent in coloring property, storage stability, dye image fastness and hue, and moreover by omitting a conventional washing step and desilvering step.

BACKGROUND OF THE INVENTION

Generally in a color photographic light-sensitive material, when the said light-sensitive material is exposed to light imagewise, then, in color-developing step, an oxidized p-phenylenediamine derivative reacts with a coupler to form an image. In this system, color reproduction by the subtractive color technique is used, and, to reproduce blue, green, and red colors, dye images of yellow, magenta, and cyan in color, respectively complementary to blue, green, and red, are formed.

Color development is accomplished by immersing (dipping) an exposed color photographic light-sensitive material in an alkaline aqueous solution containing a p-phenylenediamine derivative (a color developer).

The color image-forming method using a color photographic light-sensitive material excelled in that an image could be provided at a low price and in large quantities. On the other hand, the method had a drawback that an image formation could not be completed unless a bleach-fix step and a washing step were performed after the foregoing color-developing step. Consequently the processing apparatus inevitably became complicated and large in size.

Particularly in the case of a minilab or the like, by which a distributed processing is carried out, the apparatus must be of small size. Therefore, it is an essential condition to make compact and simplify the apparatus for the distributed processing of a photographic light-sensitive material.

The reason such latter steps must be performed, is that silver in a light-sensitive material is reduced by color development to a metal silver, which results in the metal silver remaining in the light-sensitive material. The remaining metal silver exhibits a black color, and therefore it deteriorates the purity of the color image. Consequently, it is necessary to remove the metal silver from the light-sensitive material. At the present time, the metal silver is removed from a light-sensitive material by means that the metal silver is converted to a silver ion, by bleach-fixing, and then the silver ion is removed together with an undeveloped silver halide, by fixing.

Examples of a method to omit such a bleach-fixing step from a processing include a method in which intensification processing with hydrogen peroxide is carried out, as described in, for example, the Journal of the Society of Photographic Science and Technology of Japan, Vol. 51, No. 3, p. 191 (1988), JP-B-61-48148 ("JP-B" means examined Japanese patent publication), JP-B-63-20330, JP-B-63-20332, JP-A-3-111844 ("JP-A" means unexamined published Japanese patent application), and the like. Because an image amplified on a developed silver is formed by the intensification processing, a sufficient image density can be obtained, even though a light-sensitive material having remarkably reduction in silver content is used. Therefore, color stain due to a metal silver can be made negligibly small, so that bleaching and fixing are not needed.

However, a problem has arisen that a processing solution deteriorates with the lapse of time because of an oxidation-reduction reaction between peroxides, such as hydrogen peroxide used in intensification processing, and p-phenylenediamine derivatives.

To stabilize such a color developer for intensification, it is conceivable that the p-phenylenediamine derivative should be removed from the color developer.

Omission of the p-phenylenediamine derivatives from a color developer results in no color-formation. However, if the p-phenylenediamine derivative or the another compound having the same function, is incorporated in a light-sensitive material, there is no need to incorporate a p-phenylenediamine derivative in the processing solution. Examples of a method proposed in which a p-phenylenediamine derivative or another compound having the same function is incorporated in a light-sensitive material, include a method in which an aromatic primary amine or its precursor is built-in a light-sensitive material. Examples of the aromatic primary amine developing agent or its precursor, each of which can be built-in the light-sensitive material, include those as described in, for example, U.S. Pat. Nos. 2,507,114, 3,764,328, and 4,060,418, JP-A-56-6235, JP-A-58-192031, JP-A-11-106361, and JP-A-11-167185. Of these compounds, a compound that releases an aromatic primary amine upon a rearrangement reaction due to a peroxide, as described in JP-A-11-106361, JP-A-11-167185, and the like, is excellent in the compatibility of storage stability and coloring property. Another example of an effective means proposed is a method in which a stable color-forming reducing agent is built in a hydrophilic colloid layer, with examples of the reducing agent including hydrazine compounds as described in, for example, European Patent Nos. 0545491A1 and 0565165A1,JP-A-8-286340, JP-A-8-292529, JP-A-8-297354, JP-A-8-320542, and JP-A-8-292531; and sulfonamidophenol compounds as described in, for example, U.S. Pat. No. 4,021,240 and Research Disclosure No. 15108 (November 1976). These color-forming reducing agents have characteristics of excellent storage stability and high coloring property.

The reason the washing step is needed is that it is necessary to wash away ingredients that were originally incorporated in a light-sensitive material but have become unwanted to the light-sensitive material after image formation, and further it is much more necessary to wash away ingredients that were later brought into the light-sensitive material until completion of both the developing step and the bleach-fixing step but have become unwanted to the light-sensitive material after the image formation. Therefore, the need for such a washing step is greatly reduced if the bleach-fixing step is omitted. However, since the color developer is alkaline, unless a light-sensitive material that was passed through the color developer completes a bleach-fixing step or a washing step, the pH of a coated film of the light-sensitive material remains high, which has resulted in a considerable deterioration of the image stability after processing. Further, when a light-sensitive material having a silver amount lowered in a large margin is subjected to intensification processing, unless the light-sensitive material completes a fixing step or a washing step, a very small amount of silver still remains in the light-sensitive material. Consequently, such a very small amount of silver has caused a stain after the lapse of a long time.

Further, JP-A-58-127926 and the like discloses a method of processing a color-developed light-sensitive material with an acidic solution. JP-A-58-137837 discloses a method of processing a color-developed light-sensitive material with a solution containing a silver complex-forming agent.

However, even though these methods are used, there has been a need for an apparatus composed of a tank that is used to dip a light-sensitive material in a color developer; a supplemental tank that is used to stock a solution that replenish a color developer corresponding to the consumed amount thereof; a tank that is used to dip a color-developed light-sensitive material in an acidic solution; a supplemental tank that is used to stock a solution that replenish an acidic solution or a silver complex-forming agent-containing solution, corresponding to the consumed amount of each solution; and a waste solution tank, which is used to collect and stock an overflow solution and the like of the color developer, the acidic solution, and the silver complex-forming agent-containing solution. Consequently, the apparatus inevitably becomes large in size.

Further, when p-phenylenediamine derivatives are contained in a developer, the p-phenylenediamine derivatives from the developer are brought into an acidic solution by a running processing, and a decomposition product of the p-phenylenediamine derivatives accumulates therein. As a result, a problem has arisen that the above-mentioned decomposition products are brought into a light-sensitive material and then cause unequal stain streaks (unevenness).

On the other hand, as another method of making a: processing apparatus compact, there is a method of supplying a color developer or an activator solution (an alkaline solution substantially free of a color-developing agent) in the form of a thin layer. Examples of a method of supplying a processing solution in the form of a thin layer include a method of coating the processing solution in the form of a thin layer by a roller coat, a felt cloth, a sponge coat, and the like, as described in Japanese Patent No. 2,612,205 and the like, and a method of spraying a processing solution jetted from a thin nozzle, as described in, for example JP-A-6-324455, JP-A-9-179272, and JP-A-11-109582.

However in these methods, since the fixing step and the washing step are necessary in the latter step of the processing, tanks for these steps are needed. Therefore it has been difficult to completely simplify and miniaturize a processing apparatus even by these methods.

As to, in particular, a distributed processing of the light-sensitive material, it has been desired to develop an image-forming method capable of dissolving factors that make a processing apparatus become large sized as described above.

SUMMARY OF THE INVENTION

An object of the present invention is to provide a color image-forming method that is able to cope with both substantial improvement in the convenience of processing and simplification and miniaturization of a processing apparatus, and that causes less stain in the light-sensitive material after processing, by the use of a silver halide color photographic light-sensitive material that is excellent in coloring property, storage stability, dye image fastness and hue, and moreover by omitting a conventional washing step and desilvering step.

Other and further objects, features, and advantages of the invention will appear more fully from the following description, taken in connection with the accompanying drawings.

DETAILED DESCRIPTION OF THE INVENTION

Figure 1:
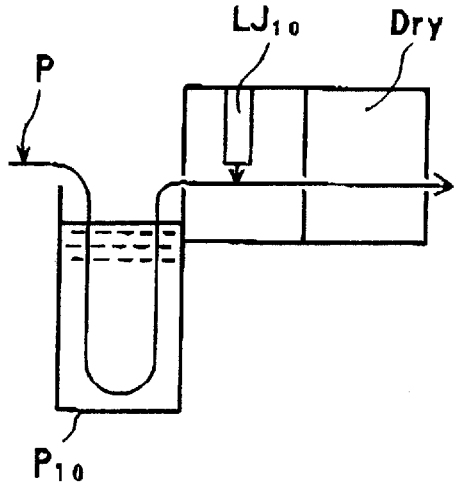
FIG. 1 is an outlined explanatory view showing a processing apparatus that can be used to practice the present invention.

We have found out that the above-described object of the present invention is accomplished by the following methods.

(1) A method for forming a color image by processing a silver halide color photographic light-sensitive material having at least one photographic constitutional layer on a support, wherein the processing substantially comprises the steps of:

a) developing, and subsequent thereto b) supplying an acidic solution having a pH of 4 or less, in the form of a thin layer, onto the light-sensitive material, so as to have a coverage of 30 ml/m$^2$ or less; and wherein the total of the coated silver amount in each of the coating layers of the light-sensitive material is in the range of 0.003 to 0.3 g/m$^2$ in terms of silver.

(2) The method for forming a color image according to the above (1), wherein the period of time necessitated after a developer is supplied onto the light-sensitive material in the developing step a), until the acidic solution is supplied thereon, in the form of a thin layer, is in the range of 5 sec to 30 sec.

(3) The method for forming a color image according to the above (1) or (2), wherein a developer is supplied, by thin layer applying, in the developing step a).

(4) The method for forming a color image according to the above (3), wherein the volume ratio of the amount of the acidic solution, to the amount of the developer to be supplied onto the light-sensitive material, is in the range of 1/100 to 1/1.

(5) The method for forming a color image according to any one of the above (1) to (4), wherein the acidic solution having a pH of 4 or less contains at least one kind of compounds selected from a group consisting of a nitrogen-containing heterocyclic compound having a sulfido group, a mesoionic compound, a thioether compound, a thiourea compound, a bromide salt, and an iodide salt.

(6) The method for forming a color image according to any one of the above (1) to (5), wherein the silver halide color photographic light-sensitive material contains a compound capable of forming a dye having an absorption in the visible region by a coupling reaction between a coupler and an oxidation product of the compound ascribable to at least one kind of silver halide, or a precursor of the compound; and wherein the developer is an alkaline processing solution substantially free of a color-developing agent.

(7) The method for forming a color image according to the above (6), wherein the compound capable of forming a dye having an absorption in the visible region by a coupling reaction between a coupler and an oxidation product of the compound ascribable to at least one kind of silver halide, is represented by the following formula (I):

formula (I)

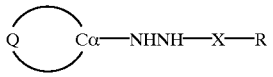

wherein Cα represents a carbon atom; R represents a substituted or unsubstituted, alkyl group, aryl group, or heterocyclic group; Q represents an atomic group necessary to form an unsaturated ring with Cα; X represents —$SO_2$—, —CO—, —COCO—, —CO—O—, —CON(R')—, —COCO—O—, —COCO—N(R')— or —$SO_2$—N(R')—, wherein R' represents a hydrogen atom or the groups defined by R.

(8) The method for forming a color image according to the above (7), wherein X in formula (I) is —CONH—.

(9) The method for forming a color image according to the above (7) or (8), wherein a compound represented by formula (II), and a coupler represented by formula (III), are incorporated in the same layer:

formula (II)

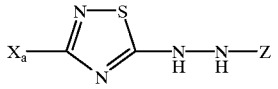

wherein $X_a$ represents a halogen atom, an aliphatic thio group, an aliphatic sulfinyl group, an aliphatic sulfonyl group, an arylthio group, an aryl sulfinyl group, an aryl sulfonyl group, a sulfamoyl group, or a substituent substituted with —COOH, —$NHSO_2R$, —$SO_2NHR$, —$SO_2NHCOR$, —$CONHSO_2R$, —OH, or —SH; and Z represents a carbamoyl group, an acyl group, an alkoxy carbonyl group, or an aryloxy carbonyl group:

formula (III)

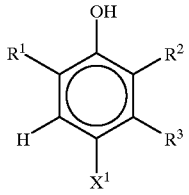

wherein $R^1$ represents an alkyl group; $R^2$ and $R^3$ each represent a hydrogen atom or a substituent; $X^1$ represents a group cleavable by coupling with an oxidation product of the color-developing agent, provided that a halogen-substituted alkyl group is excluded from $R^1$.

(10) The method for forming a color image according to any one of above (1) to (9), wherein the exposure time per picture element (pixel) is in the range of $10^{-8}$ to $10^{-4}$ sec, and the exposure is performed by a scanning exposure system providing overlap between raster adjacent to each other.

The use of a color image-forming method of the present invention enables substantially no waste solution. Moreover, the use of the color image-forming method of the present invention enables to reduce streaks (unevenness) occurring at the time of a processing, as small as possible.

The present invention is explained in detail below.

First, an image-forming method of the present invention is described below.

The image-forming method of the present invention comprises processing, which is characterized in that both a washing step and a desilvering step are substantially omitted after a developing step, and that an acidic solution having a pH of 4 or less is supplied so as to have a coverage of 30 $ml/m^2$ or less in the form of a thin layer.

The processing for use in the present invention is described below. In the present invention, "processing" means processing steps comprising a developing step to form an image.

In the present invention, steps of the processing are substantially composed of a developing step (including e.g., development intensifying step) and a step of supplying an acidic solution. Further, a drying step (including natural drying) is included in these steps. In the image-forming method of the present invention, substantially neither washing step nor desilvering step are included between the developing step and the drying step. Namely, the conventionally required desilvering step is not needed. Further, washing in water that is performed by dipping a light-sensitive material in the conventionally required tub (e.g., tank) is not carried out any more. However, the development intensification ingredients may be removed by just simply putting (e.g., spraying or coating) water. Further after putting such a water, the moisture (for example, attached on the surface, etc. of a light-sensitive material) may be removed with a water-absorbing agent or a moisture-absorbing agent.

In the present invention, it is preferable to subject the light-sensitive material of the present invention to image intensification in order to obtain a sufficient image density. In the color development, it is preferable to incorporate hydrogen peroxide and/or a hydrogen peroxide releasing compound in a color developer. Further, when hydrogen peroxide and/or a hydrogen peroxide releasing compound is incorporated in a color developer containing a color-developing agent, these intensifying agents sometimes decompose the color-developing agent. Therefore, a method wherein a color-developing agent-containing solution is supplied into a light-sensitive material and then a solution containing hydrogen peroxide and/or a hydrogen peroxide releasing compound is supplied, can also be preferably used.

Further, in order to prevent a color-developing agent from the above-mentioned decomposition, it is also preferable to use a method of color developing a light-sensitive material containing a compound capable of forming a dye having an absorption in the visible region by a coupling reaction between a coupler and an oxidation product of the compound ascribable to silver halide, or a precursor of the compound, with an alkaline activating solution (activator solution) that is a processing solution which is free of a color-developing agent and that contains hydrogen peroxide and/or a hydrogen peroxide releasing compound. In this case, a method wherein an alkali agent-containing solution is supplied into a light-sensitive material and then a solution containing hydrogen peroxide and/or a hydrogen peroxide releasing compound is supplied, is also preferred for stabilization of the processing solution. Namely, an alkali component and an intensification component (e.g., hydrogen peroxide) may be given as a single solution, or as two-separated solutions. In the use of two solutions, a preferable order is to give an alkali component and subsequent thereto an intensification component, thereby to obtain an excellent image.

In the present invention, hydrogen peroxide and/or a hydrogen peroxide releasing compound can be used. As a hydrogen peroxide releasing compound, perboric acid, percarbonic acid and the like can preferably be used. Preferred among these compounds is hydrogen peroxide from the view point that no solid substance remains in the processed light-sensitive material. The amount of hydrogen peroxide and/or a hydrogen peroxide releasing compound to be incorporated in a processing solution is preferably in the range of 0.005 to 1 mol/liter, more preferably in the range of 0.01 to 0.5 mol/liter, especially preferably in the range of 0.02 to 0.25 mol/liter.

The color developer (including an activator) for use in the present invention preferably has a pH of 9 to 14, more preferably 9 to 13. The color developer may contain other compounds known as developer ingredients. In order to maintain the foregoing pH range, various kinds of buffer are preferably used. Further, when the color developer is separated into an unit of a color-developing agent-containing solution and a hydrogen peroxide and/or a hydrogen peroxide releasing compound-containing solution, or an unit of an alkali agent-containing solution and a hydrogen peroxide and/or a hydrogen peroxide releasing compound-containing solution, the pH of the hydrogen peroxide and/or the hydrogen peroxide releasing compound-containing solution is preferably in the range of 5 to 9, more preferably 6 to 8.

Specific examples of these buffers include sodium carbonate, potassium carbonate, sodium bicarbonate, potassium bicarbonate, trisodium phosphate, tripotassium phosphate, disodium phosphate, dipotassium phosphate, potassium borate, sodium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate) and the like.

The amount of the buffers to be added to the color developer is preferably 0.1 mol/liter or more, and particularly preferably 0.1 to 0.4 mol/liter.

As a color-developing agent for use in the color-developing step, known aromatic primary amine color-developing agents can properly be used. Preferred among them are p-phenylenediamine-series compounds. Typical examples of the compounds include 3-methyl-4-amino-N,N-diethylaniline, 3-methyl-4-amino-N-ethyl-N-β-hydroxyethylaniline, 3-methyl-4-amino-N-ethyl-N-β-methanesufonamidoethylaniline, 3-methyl-4-amino-N-ethyl-N-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-ethyl-N-ethyl-N-(3-hydroxy-2-methylpropyl)aniline , 4-amino -3-methyl-N,N-bis(4-hydroxybutyl)aniline, 4-amino-3-methyl-N,N-bis(5-hydroxypentyl)aniline, 4-amino-3-methyl-N-(5-hydroxypentyl)-N-(4-hydroxybutyl)aniline 4-amino-3-methoxy-N-ethyl-N-(4-hydroxybutyl)aniline, 4-amino-3-ethoxy-N,N-bis(5-hydroxypentyl)aniline, 4-amino- 3-propyl-N-(4-hydroxybutyl)aniline, and a salt of these anilines with sulfuric acid, hydrochloric acid or p-toluenesulfonic acid. Especially preferred among these compounds are 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4-hydroxybutyl)aniline, and a salt of these anilines with hydrochloric acid, p-toluenesulfonic acid, or sulfuric acid. Two or more kinds of these compounds may be used in combination, if necessary.

Those described in EP-A-410 450, JP-A-4-11255, etc., can also be used preferably.

Further, sulfates, hydrochlorides, sulfites, and salts of naphthalenedisulfonic acid or p-toluenesulfonic acid, of these p-phenylenediamine derivatives, may also be used. The amount of the aromatic primary amine developing agent to be used is preferably 0.0002 to 0.2 mol, and more preferably 0.001 to 0.1 mol, per liter of the color developer.

Further, if necessary, to the color developer, can be added a sulfite, such as sodium sulfite, potassium sulfite, sodium bisulfite, potassium bisulfite, sodium metasulfite, and potassium metasulfite, or a carbonyl sulfite adduct, as a preservative.

In the color developer, if necessary, an arbitrary development accelerator can be added.

Examples of the development accelerator include the following compounds: thioether compounds described, for example, in U.S. Pat. No. 3,813,247; p-phenylenediamine compounds described in JP-A-52-49829 and JP-A-50-15554; quaternary ammonium salts described, for example, in JP-B-44-30074 ("JP-B" means an examined Japanese patent publication); amine-series compounds described, for example, in U.S. Pat. Nos. 2,482,546, 2,596,926, and 3,582,346; polyalkylene oxides described, for example, in U.S. Pat. No. 3,532,501, as well as 1-phenyl-3-pyrazolidons, imidazoles, and the like can be added, if necessary.

In addition, various chelating agents can be used in a color developer, as a precipitation-preventing agent against calcium and magnesium, or as an agent for improving stability of the color developer. Examples of the chelating agent include nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, glycol ether diaminetetraacetic acid, ethylenediamine orthohydroxyphenylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, and hydroxyethyliminodiacetic acid. Two or more of these chelating agents may be used in combination, if necessary.

With respect to the amount of these chelating agents to be added, preferably the amount is enough to sequester the metal ions in the color developer, for example, in an amount of about 0.1 to 10 g per liter.

In the present invention, if required, an arbitrary antifoggant can be added. As the antifoggant, the alkali metal halide, such as sodium chloride, potassium bromide, and potassium iodide, and an organic antifoggant, can be used. Typical examples of the organic antifoggant include nitrogen-containing heterocyclic compounds, such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethyl-benzimidazole, indazole, hydroxyazaindolidine, and adenine.

In the present invention, it is preferable to incorporate a chloride ion in a color developer in an amount of $3.0\times10^{-2}$ mol/l to $1.5\times10^{-1}$ mol/l, especially preferably $3.5\times10^{-2}$ mol/l to $1.0\times10^{-1}$ mol/l. When the chloride ion concentration is more than $1.5\times10^{-1}$ mol/liter, there is a drawback of retardation of development. Therefore such a concentration is not preferable from the viewpoint of rapid formation of the image having a high maximum density and the like. On the other hand, when the ion density is less than $3.0\times10^{-2}$ mol/liter, it is also not preferable from the viewpoint of anti-fogging.

In the present invention, it is preferable to incorporate a bromide ion in a color developer in an amount of $0.5\times10^{-5}$ Mol/l to $1.0\times10^{-3}$ mol/l, more preferably $3.0\times10^{-5}$ mol/l to $5.0\times10^{-4}$ mol/l. When the bromide ion concentration is higher than $1\times10^{-3}$ mol/l, the development may be retarded and the maximum density rand sensitivity may be lowered. When the bromide ion concentration is lower than $0.5\times10^{-5}$ mol/l, the fogging cannot be completely inhibited in some cases.

In the present invention, the chloride ion and the bromide ion may be directly added to the color developer, or may be contained in the photosensitive material so that they are eluted into the color developer during the developing process.

When these are directory added to the color developer, as a chloride-ion-supply substance, sodium chloride, potassium chloride, ammonium chloride, lithium chloride, magnesium chloride, or calcium chloride can be mentioned. Further, it may be supplied from a fluorescent-whitening agent contained in the color developer. As a bromide-ion-supply substance, sodium bromide, potassium bromide, ammonium bromide, lithium bromide, calcium bromide, or magnesium bromide, can be mentioned.

When the chloride ion and the bromide ion are eluted from the light-sensitive material during the developing process, these ions may be fed by an emulsion or other materials.

Preferably, the color developer which can be used in the step of development according to the present invention, is substantially free from benzyl alcohol. The term "substantially free from benzyl alcohol" herein indicates that the benzyl alcohol concentration is preferably 2 ml/l or less, further preferably 0.5 ml/l or less, and most preferably no benzyl alcohol is contained.

It is also preferred that the color developer for use in the present invention is substantially free of sulfite ion so as to inhibit a change in photographic properties due to the continuous processing, and also to obtain the effects of the present invention. The term "substantially free of sulfite ion" herein indicate that the sulfite ion concentration is generally $3.0\times10^{-3}$ mol/l or less, preferably $1.0\times10^{-3}$ mol/l or less, and most preferably, the developing solution is completely free of sulfite ion, except for a very small amount of the sulfite ion used for inhibiting the oxidation of a processing kit containing the concentrated developing agent before preparing the developer.

Further, it is more preferable that the color developer for use in the present invention is substantially free of hydroxylamine (namely, the hydroxylamine concentration is $5.0\times10^{-3}$ mol/l or less) so as to inhibit the change of photographic properties due to the change in the concentration of hydroxylamine. Most preferably, the developing solution is completely free of hydroxylamine. In the present invention, both a washing step and a desilvering step are substantially omitted after the developing step. Accordingly, in order to minimize the amount of a non-volatile substance to be taken in the processing, the concentration of the total amount of the non-volatile substance in a developer is preferably 10% by weight or less, more preferably 8% by weight or less, and especially more preferably 6% by weight or less.

The activator solution for use in the present invention is explained.

The activator solution is characterized in that substantially no p-phenylenediamine-series color-developing agent is incorporated therein. However, the activator solution may contain other ingredients (e.g., alkali, halogen, or chelating agents). Further, sometimes it is preferable that no reducing agent is contained in the activator solution in order to maintain the processing stability. In that case, it is preferable that the activator solution is substantially free of an auxiliary developing agent, hydroxylamines, sulfites and the like.

The term "substantially free of" as used herein means that the concentration of each of them is preferably 0.5 mmol/liter or less, more preferably 0.1 mmol/liter or less. It is especially preferable that absolutely none of them are contained therein. A preferable pH range of the activator solution is the same as the foregoing color developer.

A supply of the color developer (the term "color developer" as used herein embrace an activator solution) for use in the present invention to a light-sensitive material, may be performed by a tank-processing method wherein a tank is used as conventionally practiced; a method wherein a solution is run through a thin slit as described in Japanese Patent No. 2,612,205; and a method wherein a light-sensitive material is dipped in a color developer, such as a dip coating. A processing that is carried out by coating a color developer onto a light-sensitive material, i.e., so-called "a coating processing" is another preferable embodiment. Especially when a color-developing agent-containing solution is supplied in a light-sensitive material and thereafter a hydrogen peroxide and/or a hydrogen peroxide-releasing compound-containing solution is supplied, or when an alkali agent-containing solution is supplied in a light-sensitive material and thereafter a hydrogen peroxide and/or a hydrogen peroxide-releasing compound-containing solution is supplied, the coating processing is especially effective when the latter solution is supplied, because these two solutions are not mixed.

As a method of coating a processing solution on a light-sensitive material, there are a method of supplying a processing solution by contacting the light-sensitive material with a coating part of the coating apparatus for a developer; a method of supplying a processing solution by non-contact of them. Examples of the former method include a roller coat, a rod coat, a squeeze coat, a felt cloth, and a sponge coat as described in, for example, Yuji Harasaki, Kotingu Gaku, (tokuni pp. 253 to 255), Asakura shoten (1971) and Shigyo taimusu sha, Kami Kako Binran, pp. 129 to 138 (1973). Examples of the latter method include a method of spraying a processing solution jetted from a thin nozzle, as described in, for example, JP-A-6-324455, JP-A-9-179272, JP-A-11-109582 and Japanese patent application No. 101886/1998, is preferably used.

As a method of coating a processing solution on a light-sensitive material, a coating method using a coating apparatus for a processing solution as described in , for example, JP-A-9-179272, JP-A-11-109582 and Japanese patent application No. 101886/1998, is preferably used from the viewpoint that a stain ascribable to a substance discharged from a light-sensitive material at a coating area can be prevented.

Further in the present invention, a method wherein a developer is repeatedly coated in many times, may be used. Further, an alkaline processing solution exceeding the amount of swelling can be removed by squeezing a coated color developer.

When a developer is coated, the coating amount is preferably 100 ml/m$^2$ or less, more preferably 80 ml/m$^2$ or less, especially preferably 40 ml/m$^2$ or less. When a developer is coated by dividing it to two or more solutions, it is preferable that the total amount thereof is the same as described above.

The processing temperature, when a color developer is used in the present invention, is generally in the range of 20° C. to 55° C., preferably in the range of 30° C. to 55° C.

A step at which an acidic solution is used in the present invention is described below.

The acidic solution for use in the present invention preferably has a pH of 4 or less, more preferably 3 or less, and especially preferably 2 or less. Addition of an acid is needed to adjust to such a pH range.

As an acid for use in the present invention, use can be made of known compounds including inorganic acids such as hydrochloric acid, sulfuric acid, nitric acid and phosphoric acid, and organic acids such as acetic acid, a substituted acetic acid (e.g., chloro acetic acid), oxalic acid, lactic acid, citric acid, succinic acid, tartaric acid, benzoic acid, salicylic acid and glycine. Preferably used is an acid having an acid dissociation constant (pKa) of 5 or less in water, described in Kagaku Binran, Kisohen IV (1993, edited by Nippon Kagaku Kai (The Chemical Society of Japan, Chemistry and Industrial Chemistry), published by Maruzen Co., Ltd.) from page 316 to 321. When the acid has two or more acidic groups, the lowest one among the pKa values due to the acidic groups is preferably 5 or less. It is more preferable that the pKa value is 4 or less. These acids may be used in combination.

The amount of an acid to be used in an acid solution according to the present invention is generally in the range of $1\times10^{-3}$ mol to 4 mol, preferably in the range of $1\times10^{-2}$ mol to 2 mol, more preferably in the range of $5\times10^{-2}$ mol to 1 mol, per liter of the solution.

Further in the present invention, preferably the acid solution contains at least one kind of compounds selected from a nitrogen-containing heterocyclic compound having a sulfido group, a mesoionic compound, a thioether compound, a thiourea compound, a bromide salt, and an iodide salt.

The foregoing nitrogen-containing heterocyclic compound having a sulfido group, mesoionic compound, thioether compound, thiourea compound, bromide salt, and iodide salt, for use in the present invention, are explained in detail below. These compounds may be used singly or in combination.

Specific examples of the nitrogen-containing heterocyclic compound having a sulfido group for use in the present invention are shown below. However, the present invention is not limited thereto.

A-1

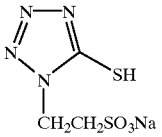

A-2

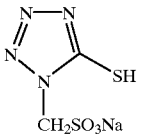

A-3

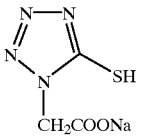

-continued

A-4

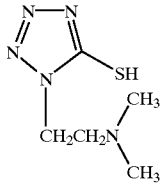

A-5

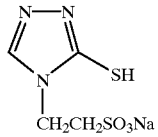

A-6

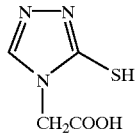

A-7

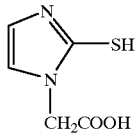

A-8

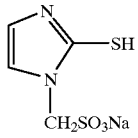

A-9

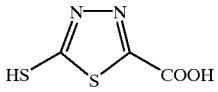

A-10

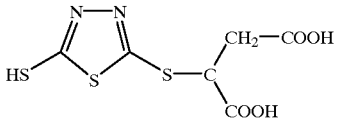

A-11

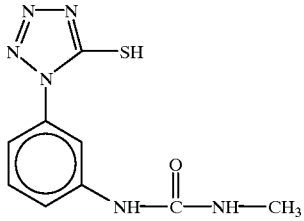

A-12

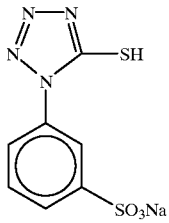

-continued

A-13

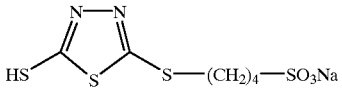

A-14

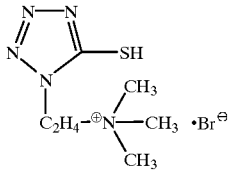

A-15

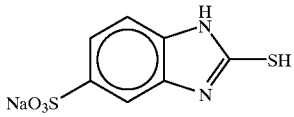

A-16

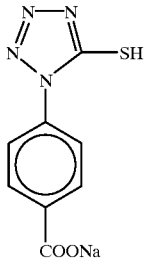

A-17

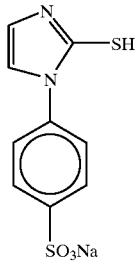

The foregoing nitrogen-containing heterocyclic compound having a sulfido group used in the present invention can be synthesized in accordance with methods described in Berichte der Deutschen Chemischen Gesellschaft 28, 77 (1895); Berichte der Deutschen Chemischen Gesellschaft 22, 568 (1889); Berichte der Deutschen Chemischen Gesellschaft 29, 2483 (1896); JP-A-50-37436, JP-A-51-3231, JP-A-50-89034, U.S. Pat. Nos. 2,541,924, 2,585,388, 3,295,976, 3,376,310, 3,106,467, 3,420,670, 2,271, 3,137,578, 3,148,066, 3,511,663, 3,060,028, 3,271,154, 3,251,691, 3,598,599, 3,615,616, 3,420,664, 3,071,465, 2,444,605, 2,444,606, 2,444,607, 2,935,404, J. Chem. Soc. 1932, 1806; J. Am. Chem. Soc. 71, 4000 (1949); J. Am. Chem. Soc. 45, 2390 (1932); Advances in Heterocyclic Chemistry 9, 165 (1968); Organic Synthesis IV, 569 (1963); and Chemische Berichte 9, 465 (1876).

Specific examples of the mesoionic compounds are shown below, however, the present invention should not be limited to these compounds.

B-1

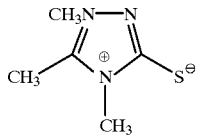

B-2

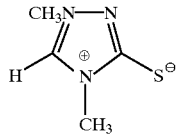

B-3

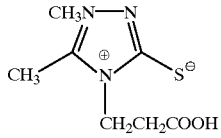

B-4

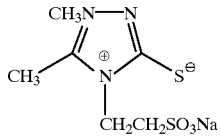

B-5

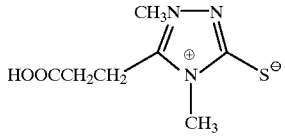

B-6

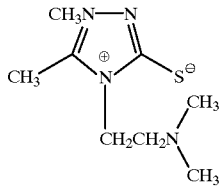

B-7

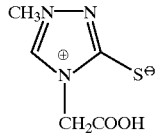

B-8

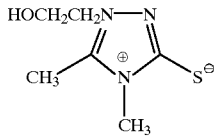

B-9

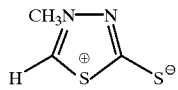

B-10

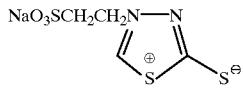

B-11

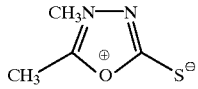

-continued

B-12

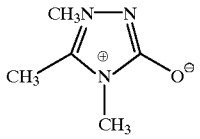

B-13

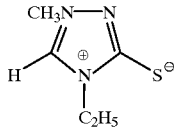

B-14

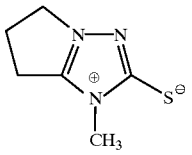

B-15

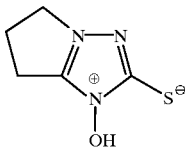

B-16

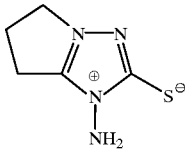

The foregoing mesoionic compound for use in the present invention can be synthesized in accordance with various methods described in, for example, J. Heterocyclic Chem. 2, 105 (1965), ibid. 5, 277 (1968), J. Org. Chem. 32, 2245 (1967), ibid. 30, 567 (1965), J. Chem. Soc. 3799 (1969), ibid. 899 (1935), J. Am. Chem. Soc. 80, 1895 (1958), Chem. Commun.1x222 (1971), Tetrahedron Letters 2939 (1972), ibid. 5881 (1968), ibid. 1809 (1967), Berichte der Deutschen Chemischen Gesellschaft 38, 4049 (1905), J. Chem. Soc. Commun. 1224 (1971), J. Chem. Soc., Perkin Trans. I 627 (1974), JP-A-60-87322, JP-A-60-122936, and JP-A-60-117240.

Specific examples of the thioether compounds are shown below, however, the present invention should not be limited to these compounds.

C-1. $NaO_3S(CH_2)_2S(CH_2)_2S(CH_2)_2SO_3Na$

C-2. $NaO_3S(CH_2)_2$—$(SCH_2CH_2)_2$—$S(CH_2)_2SO_3Na$

C-3. $NaO_3S(CH_2)_2$—$(SCH_2CH_2)_3$—$S(CH_2)_2SO_3Na$

C-4. $NaO_3S(CH_2)_2$—$(SCH_2CH_2)_4$—$S(CH_2)_2SO_3Na$

C-5. $NaO_3S(CH_2)_3S(CH_2)_2O(CH_2)_2S(CH_2)_3SO_3Na$

C-6

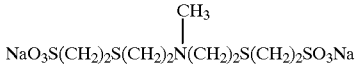

C-7

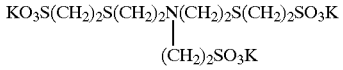

C-8. $Na_2O_3P(CH_2)_2S(CH_2)_2S(CH_2)_2PO_3Na_2$

C-9. $Na_2O_3P(CH_2)_2$—$(SCH_2CH_2)_2S(CH_2)_2PO_3Na_2$

C-10. $Na_2O_3P(CH_2)_3$—$(SCH_2CH_2)_3S(CH_2)_3PO_3Na_2$

C-11

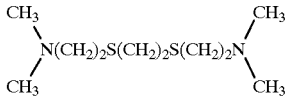

C-12. $H_2N(CH_2)_2S(CH_2)_2S(CH_2)_2NH_2$

C-13. $H_2NO_2S(CH_2)_2S(CH_2)_2S(CH_2)_2SO_2NH_2$

C-14

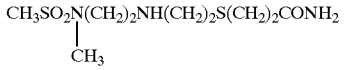

C-15. $CH_3SO_2(CH_2)_3S(CH_2)_3S(CH_2)_2SO_3Na$

The foregoing thioether compound for use in the present invention can be easily synthesized with reference to, for example, J. Org. Chem. 30, 2867 (1965), ibid. 27, 2846 (1962), J. Am. Chem. Soc. 69, 2330 (1947).

In addition, thiourea compounds described in JP-A-2-44355, page 1084 to 1088; bromide salts such as potassium bromide and sodium bromide; and iodide salts such as potassium iodide and sodium iodide can be used.

Specific examples of the thiourea compound for use in the present invention are shown below. However, the present invention is not limited thereto.

D-1

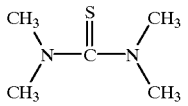

D-2

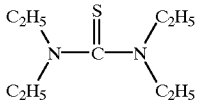

D-3

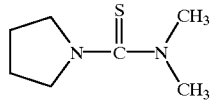

D-4

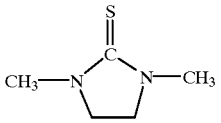

D-5

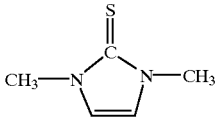

D-6

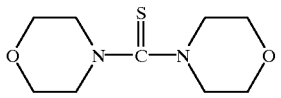

-continued

D-7

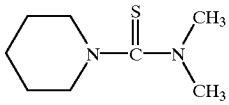

D-8

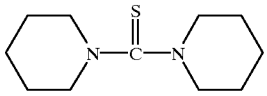

D-9

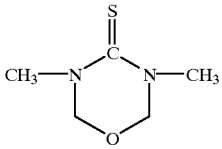

D-10

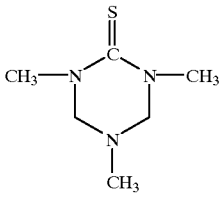

D-11

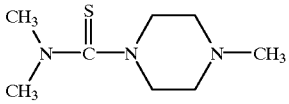

D-12

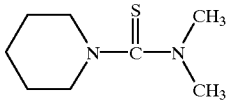

Preferred among these compounds are a nitrogen-containing heterocyclic compound and a mesoionic compound from the viewpoint that silver halide can be rapidly stabilized in a small amount.

Preferably at least one of the foregoing nitrogen-containing heterocyclic compound having a sulfido group, mesoionic compound, thioether compound, thiourea compound, bromide salt, and iodide salt is incorporated in a acidic solution that is to be applied onto a light-sensitive material in the form of a thin layer, in an amount of $10^{-4}$ mol/liter to 10 mol/liter, preferably $10^{-3}$ mol/liter to 5 mol/liter, especially preferably $5\times10^{-}$mol/liter to 1 mol/liter. Preferably, at least one of the foregoing compound is supplied in a light-sensitive material so as to have a coverage of $1\times10^{-5}$ to 0.5 mol, preferably $1\times10^{-4}$ to $5\times10^{-2}$ mol, and especially preferably $5\times10^{-4}$ to $1\times10^{-2}$, per $m^2$ of the light-sensitive material.

The coating amount of the foregoing compounds to be needed varies depending on the kind of the compound for use, the pH of an acidic solution, both the kind and amount of the coating silver salt of a light-sensitive material. However, it is preferable that they are supplied so as to have a coating coverage of, generally 0.5 to 20 times, preferably 1 to 10 times, more preferably 2 to 5 times the molar amount, per the coating silver.

Preferably the acidic solution for use in the present invention is substantially free of a bleaching agent having a bleaching capacity. The term "substantially free of" as used herein has the same meaning as described above.

Examples of the bleaching agent include compounds of polyvalent metals such as iron(III), peracids, quinones, and nitro compounds. Examples of the typical bleaching agent include organic complex salts of iron(III), such as iron complex salts of ethylenediaminetetraacetic acid, methyliminodiacetic acid, or glycol ether diaminetetraacetic acid; bleaching agents such as 1,3-propylenediaminetetraacetic acid iron complex salt, described in JP-A-4-121739, from page 4, lower right column, to page 5, upper left column; bleaching agents having a heterocyclic group, described in JP-A-4-174432; bleaching agents described in EP-A-520 457, such as N-(2-carboxyphenyl)iminodiacetic acid ferric complex salt; bleaching agents described in EP-A-530 828 (A1), such as ethylenediamine-N-2-carboxyphenyl-N,N',N'-triacetic acid ferric acetate; bleaching agents described in EP-A-501 479, bleaching agents described in EP-A-567 126, bleaching agents described in JP-A-4-127145, and aminocarboxylic acid ferric salts or their salts described in JP-A-3-144446, page (11).

Preferably the acidic solution contains substantially none of these bleaching agents as exemplified above.

In the present invention, when p-phenylenediamine derivatives or the like are incorporated in a color developer, it is preferable that the acidic solution contains a compound such as sulfinic acid derivatives, which capable of forming a colorless product resulting from the reaction with an oxidation product of the color-developing agent. As the sulfinic acid derivatives, m-carboxybenzenesulfinic acid and the like are preferably used.

In the present invention, it is essential that the acidic solution is supplied in the form of a thin layer. As a method of supplying the acidic solution in the form of a thin layer, the same coating method as any one of the methods of supplying a developer can be used. In this case, a coating method such as a sponge coat is preferred from the viewpoint that a surplus of the solution coated on a light-sensitive material can be removed. On the other hand, a method of spraying a processing solution jetted from a thin nozzle as described in, for example, JP-A-9-179272, JP-A-11-109582 and Japanese patent application No. 10-101886, is preferred from the viewpoint that stains resulting from substances both brought from a developer and discharged from a light-sensitive material can be prevented.

In the present invention, it is essential that the amount of the acidic solution to be supplied is 30 ml/$m^2$ or less. If the supply amount is higher than 30 ml/$m^2$, not only a waste solution occurs but also a drying load increases, so that an effect of the present invention hardly is exerted. The supply amount of the acidic solution for use in the present invention is more preferably 20 ml/$m^2$ or less, especially preferably 10 ml/$m^2$ or less. The lowest limit thereof is preferably 0.05 ml/$m^2$ or more.

Further, when a developer is supplied in the form of a thin layer, the volume ratio of the amount of a acidic solution to that of the developer is preferably in the range of 1/100 to 1/1. If the volume ratio is less than 1/100, it is difficult to reduce a film pH of the light-sensitive material to a desired range. On the other hand, if the volume ratio is more than 1/1, the flowing of a solution or the like occurs and consequently a coloring streaks (unevenness) arise in the colored image after processing. The volume ratio of the amount of the acidic solution to that of the developer is more preferably in the range of 1/50 to 1/1, especially preferably in the range of 1/25 to 1/2.

In the present invention, a time necessitated after a supply of the developer has finished and until an acidic solution is supplied is preferably in the range of 5 sec to 30 sec. If the time is shorter than 5 sec, it is difficult to obtain a sufficient color density. On the other hand, if the time is longer than 30 sec, a large sized apparatus is needed or a reduction in productivity of the image formation is caused.

In the present invention, a temperature of an acidic solution at the time when the acidic solution is supplied on a light-sensitive material in the form of a thin layer, is not limited in particular, but the temperature is preferably in the range of 5° C. to 60° C., more preferably in the range of 10° C. to 50° C., and especially preferably in the range of 15° C. to 45° C.

Next, a processing apparatus is explains with reference to figures.

Figure 2:
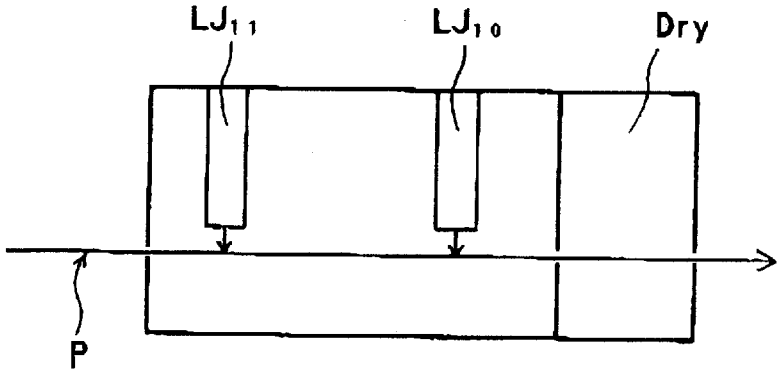
FIG. 2 is an outlined explanatory view showing another example of the processing apparatus that can be used to practice the present invention.
Figure 3:
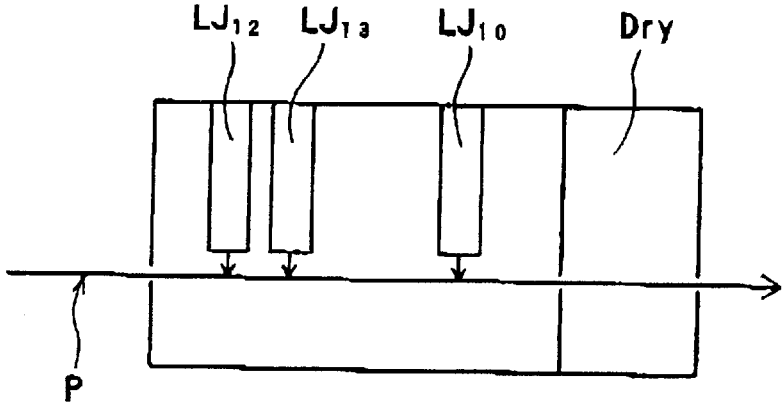
FIG. 3 is an outlined explanatory view showing another alternative example of the processing apparatus that can be used to practice the present invention.
Figure 4:
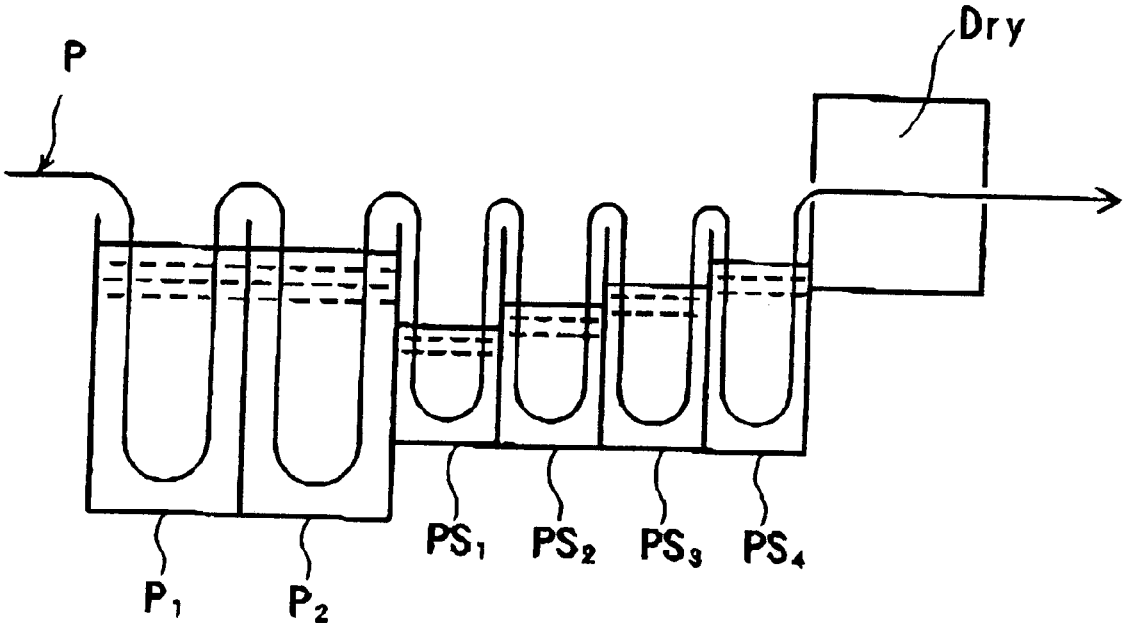
FIG. 4 is an outlined explanatory view showing a processing apparatus that is used in a conventional method.
Figure 5:
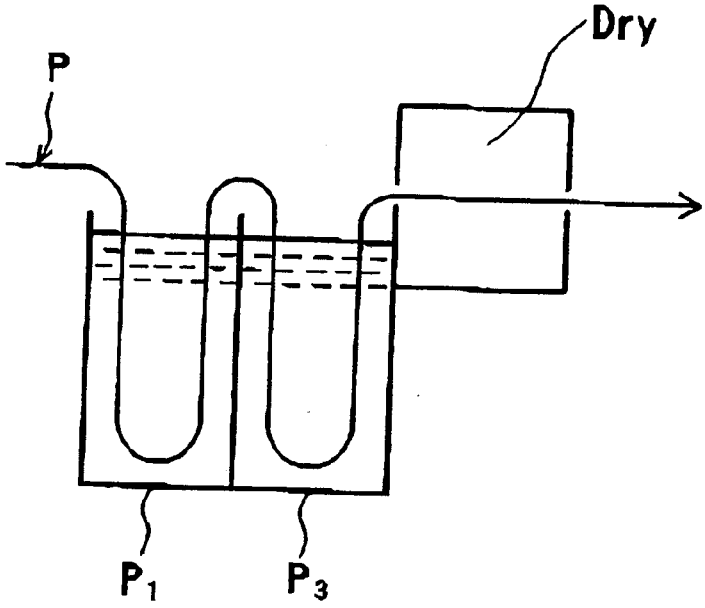
FIG. 5 is an outlined explanatory view showing another example of the processing apparatus that is used in a conventional method.

FIGS. 1 to 3 are the outline of the processing apparatuses that can be used to practice the present invention. FIGS. 4 to 5 are the outline of the processing apparatuses that are used in a conventional method.

According to the present invention as shown in FIG. 4, a color photographic light-sensitive material P is subjected to diping with a color development intensifier P1 and a fixing bath $P_2$, and then washed with rinsing bathes shown by $PS_1$, $PS_2$, $PS_3$ and $PS_4$, and thereafter dried in a drying step Dry. Further, when a light-sensitive material is processed with an acidic solution after a color development intensification step, an apparatus by which the light-sensitive material P is processed with both a color development intensifier $P_1$ and an acidic solution bath $P_3$, followed by drying as shown in FIG. 5, is used.

On the other hand, in the apparatus that can be used in the present invention as shown in, for example, FIG. 1, a line jet $LJ_{10}$ for an acidic solution is set (lined) next to a color development intensifier $P_{10}$, and an acidic solution is coated by means of the line jet $LJ_{10}$, onto the light-sensitive material in the form of a thin layer, and then dried. FIG. 2 shows an alternative embodiment that can be used in the present invention, namely an apparatus by which not only a coating of the acidic solution but also a color development intensification step can be performed by means of a line jet $LJ_{11}$ in the form of a thin layer. FIG. 3 shows an alternative embodiment of the apparatus by which the line jet for a color development intensifying solution is divided into $LJ_{12}$ and $LJ_{13}$ wherein $LJ_{12}$ stands for a line jet for an alkaline solution while $LJ_{13}$ for an aqueous hydrogen peroxide solution. In FIGS. 1 to 5, the same symbols each have the same meaning.

The silver halide particles for use in the present invention are made of silver bromide, silver chloride, silver iodide, silver chlorobromide, silver chloroiodide, silver iodobromide, or silver chloroiodobromide. Other silver salts, such as silver rhodanate, silver sulfide, silver selenide, silver carbonate, silver phosphate, or a silver salt of an organic acid, may be contained in the form of independent particles or as part of silver halide particles. If it is desired to make the developing step rapid, a so-called high-silver-chloride particles having the silver chloride content of 90 mol % or more are desirable.

In the high-silver-chloride emulsion for use in the present invention, preferably there is provided a silver bromide localized phase having a layered structure or a non-layered structure in each silver halide particle and/or on each silver halide particle surface. The halogen composition of the localized phase has a silver bromide content of preferably at least 10 mol %, and more preferably over 20 mol %. Silver bromide contents of silver bromide localized phase can be analyzed by using a method such as X-ray diffraction (described in such books as "Shin-jikken Kagaku-koza 6/Kozo Kaiseki", edited by Nihonkagakukai, Maruzen). Further, these localized phase can be formed in the particle, at the edges, corners, or planes of surface of particle, as one of preferable examples, the phase that forms epitaxially on a corner of particle can be mentioned.

Further, for the purpose of lowering the replenishing rate of the development processing solution, it is also effective to increase the silver chloride content of the silver halide emulsion further. In such a case, an emulsion of almost pure silver chloride, having a silver chloride content, for example, of 98 to 100 mol %, is also preferably used.

The value obtained by dividing the diameter of the projected area, which is assumed to be a circle, by the thickness of the particle, is called an aspect ratio, which defines the shape of tabular particles. Tabular particles having an aspect ratio more than 1 can be used in the present invention. The average aspect ratio of 80% or more of all the projected areas of particle is desirably 1 or more but less than 100, more preferably 2 or more but less than 20, and particularly preferably 3 or more but less than 10. As the shape of tabular particles, a triangle, a hexagon, a circle, and the like can be selected. A regular hexagonal shape having six approximately equal sides, described in U.S. Pat. No. 4,797,354, is a preferable mode.

As the emulsion for use in the present invention, an emulsion having a wide particle size distribution, that is, a so-called polydisperse emulsion, or an emulsion having a narrow particle size distribution, that is, a so-called monodisperse emulsion, can be selected and used in accordance with the purpose. As the scale for representing the size distribution, the diameter of the projected area of the particle equivalent to a circle, or the deviation coefficient of the sphere-equivalent diameters, may be used. If a monodisperse emulsion is used, it is suitable to use an emulsion having such a size distribution that the deviation coefficient is generally 25% or below, more preferably 20% or below, and further more preferably 15% or below.

The total of each of coating silver amounts of the coating layers of the silver halide color photographic light-sensitive material that is processed according to the present invention, is in the range of 0.003 to 0.3 $g/m^2$ in terms of silver. The coating silver amount of each of layers is preferably in the range of 0.001 to 0.1 $g/m^2$, based on one light-sensitive layer. The total coating silver amounts is preferably in the range of 0.01 to 0.1 $g/m^2$, more preferably in the range of 0.015 to 0.05 $g/m^2$. Since the present invention does not need the bleach and fixing step, the smaller the coating silver amount is, the better on the ground that a color stain in the color image can be reduced as much as possible. However, if the coating silver amount of each of the light-sensitive layers is less than 0.001 $g/m^2$, dissolution of the silver salt is accelerated and consequently a sufficient color density is hardly obtained. On the other hand, when an intensification processing is carried out, if the coating silver amount is more than 0.1 $g/m^2$, a processing stain tends to increase and bubbles are apt to occur.

The compound capable of forming a dye having an absorption in the visible region by a coupling reaction between a coupler and an oxidation product of the compound resulting from oxidization by a silver halide, or a precursor of the compound, for use in the present invention is explained in detail below. As a compound capable of forming a dye having an absorption in the visible region by a coupling reaction between a coupler and an oxidation product of the compound resulting from oxidization by a silver halide, or a precursor of the compound (hereinafter referred to as a color developing material as occasion demands), any known compounds can be used, as long as they have such a function. However, hydrazine-type compounds as described in, for example, European Patent Nos.

545491A1 and 565165A1, JP-A-8-286340, JP-A-8-292529, JP-A-8-297354, JP-A-8-320542, JP-A-8-292531, JP-A-11-109582, and JP-A-11-249274; sulfonamidophenol compounds as described in, for example, U.S. Pat. No. 4,021,240, Research Disclosure 15108 (November 1976); and a precursor of the color-developing agent that can release an aromatic primary amine by a rearrangement reaction ascribable to hydrogen peroxide, as described in, for example, JP-A-11-106361 and JP-A-11-167185 are preferred in the point that storage stability and coloring property consist together.

More preferred among compounds capable of forming a dye having an absorption in the visible region by a coupling reaction between a coupler and an oxidation product of the compound resulting from oxidization by a silver halide, or a precursor of the compound, are compounds represented by formula (I).

Particularly for a magenta dye image formation, a color developing compound represented by formula (II) is preferably used with a coupler represented by formula (III) described below.

The compounds represented by formula (II) are explained in detail below.

In formula (II), $X_a$ represents a halogen atom (e.g., chlorine or bromine), an aliphatic thio group (e.g., methylthio, ethylthio, or benzylthio), an aliphatic sulfinyl group (e.g., methane sulfinyl or ethane sulfinyl), an aliphatic sulfonyl group (e.g., methane sulfonyl, ethane sulfonyl, or benzyl sulfonyl), an arylthio group (e.g., phenylthio, naphthylthio, or 4-methoxy phenylthio), an arylsulfinyl group (e.g., benzene sulfinyl or naphthalene sulfinyl), an arylsulfonyl group (e.g., benzene sulfonyl, p-toluene sulfonyl, or p-methansulfonyl benzene sulfonyl), a sulfamoyl group (e.g., N-butylsulfamoyl or N,N-diethyl sulfamoyl), and so on.

Preferred among these atoms groups of $X_a$ are a halogen atom, an aliphatic thio group, an aliphatic sulfonyl group, an arylthio group and an aryl sulfonyl group.

Further, when $X_a$ is a substituent substituted with —COOH, —$NHSO_2R$, —$SO_2NHR$, —$SO_2NHCOR$, —$CONHSO_2R$, —OH or —SH, the group represented by $X_a$ may include an alkyl group (e.g., a methyl group, ethyl group or benzyl group), an aryl group (e.g., a phenyl group, naphthyl group or m-nitrophenyl group), an alkylthio group (e.g., a methylthio group, ethylthio group or benzylthio group), an alkylsulfinyl group (e.g., a methanesulfinyl group or ethanesulfinyl group), an alkylsulfonyl group (e.g., a methanesulfonyl group, ethanesulfonyl group or benzylsulfonyl group), an arylthio group (e.g., a phenylthio group, naphthylthio group or 4-methoxyphenylthio group), an arylsulfinyl group (e.g., benzenesulfinyl group or naphthalenesulfinyl group), an arylsulfonyl group (e.g., benzenesulfonyl group, p-toluenesulfonyl group or p-methanesulfonylbenzenesulfonyl group) and a sulfamoyl group (e.g., N-butylsulfamoyl group or N,N-diethylsulfamoyl group). Preferably each of these groups has 1 to 50 carbon atoms and more preferably 1 to 20 carbon atoms. Here, R represents an alkyl group, an aryl group, or an aromatic hetrocyclic group.

Among these groups, the substituent represented by $X_a$ is preferably an alkyl group, aryl group, alkylthio group, alkylsulfonyl group, arylthio group or arylsulfonyl group.

The substituent that $X_a$ has is preferably —$NHSO_2R$, —$SO_2NHR$, —$SO_2NHCOR$, —$CONHSO_2R$ or —OH, and more preferably —$NHSO_2R$ or —$SO_2NHR$, in which R represents an alkyl group (e.g., a methyl group, ethyl group or benzyl group), an aryl group (e.g., a phenyl group, naphthyl group or m-nitrophenyl group) or an aromatic heterocyclic group (e.g., a 2-pyridyl group, 4-pyridyl group or 2-furyl group), and preferably an alkyl group or aryl group.

Z represents a carbamoyl group, acyl group, alkoxycarbonyl group or aryloxycarbonyl group. Among these groups, a carbamoyl group is preferable and a carbamoyl group having one or two hydrogen atom(s), and more preferably one hydrogen atom bonded on the nitrogen atom is particularly preferable.

As the carbamoyl group, those having 1 to 50 carbon atoms are preferable and those having 8 to 40 carbon atoms are more preferable. Specific examples of the carbamoyl group include a hexadecylcarbamoyl group, octadecylcarbamoyl group, 3-(2,4-di-tert-pentylphenoxy) propylcarbamoyl group, 4-dodecyloxyphenylcarbamoyl group, 2-chloro-5-dodecyloxycarbonylphenylcarbamoyl group and naphthylcarbamoyl group.

Further, the carbamoyl group is also preferable the group represented by the following formula:

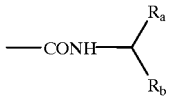

wherein $R_a$ and $R_b$ each represents a chain or cyclic alkyl group, preferably a chain or cyclic alkyl group having 1 to 50 carbon atoms. Specific examples of the alkyl group include methyl, ethyl, propyl, isopropyl, isobutyl, t-butyl, t-pentyl, cyclohexyl, octyl, 3-methylhexyl, 2-ethylhexyl, 3,5,5-trimethylhexyl, 3-methyloctyl, and dodecyl groups. $R_a$ and $R_b$ may bond together to form a ring. As the ring, there can be illustrated a cyclopropane ring, a cyclopentane ring, a cyclohexane ring, a norbornane ring, and an adamantane ring. Preferably each of $R_a$ and $R_b$ is a straight chain or branched chain alkyl group, and more preferably branched chain alkyl group.

The alkyl group represented by $R_a$ and $R_b$ may be the same or different, but it is more preferable that they are different from each other.

Each of $R_a$ and $R_b$ preferably has 4 to 30 carbon atoms, more preferably has 6 to 25 carbon atoms.

The number of carbon atoms of the alkyl group represented by $R_a$ may be the same or different from the number concerning $R_b$. When the number of carbon atoms are the same, alkyl groups having a different substitution form from each other are preferred. However, it is more preferable that the alkyl group represented by $R_a$ and $R_b$ are alkyl groups having a different number of carbon atoms from each other.

It is preferable that the alkyl group represented by $R_a$ and $R_b$ are alkyl groups having a different number of carbon atoms from each other and each having 6 or more (preferably 25 or less) carbon atoms. It is most preferable that these groups are branched alkyl groups having a different number of carbon atoms from each other and each having 6 or more (preferably 25 or less) carbon atoms.

The aforementioned groups each may further have a substituent, and examples of the further substituent include a cyano group, a carboxyl group, a sulfo group, a hydroxy group, a nitro group, a mercapto group, a halogen atom (a fluorine atom, chlorine atom, bromine atom and iodine atom), an alkyl group (an alkyl group which has generally 30 or less carbon atoms and preferably 8 or less carbon atoms and may be substituted, for example, a methyl group, trifluoromethyl group, benzyl group, dimethylaminomethyl group, ethoxycarbonylmethyl group, acetylaminomethyl group, ethyl group, carboxyethyl group, allyl group, n-propyl group, iso-propyl group, n-butyl group, t-butyl group, t-pentyl group, cyclopentyl group, n-hexyl group, t-hexyl group, cyclohexyl group, t-octyl group, n-decyl group, n-undecyl group and n-dodecyl group), an aryl group (an aryl group which has generally 30 or less carbon atoms and preferably 10 or less carbon atoms and may be substituted, for example, a phenyl group, naphthyl group, 3-hydroxyphenyl group, 3-chlorophenyl group, 4-acetylaminophenyl group, 2-methanesulfonylphenyl group, 4-methoxyphenyl group, 4-methanesulfonylphenyl group and 2,4-dimethylphenyl group), a heterocyclic group (a heterocyclic group which has generally 30 or less carbon atoms and preferably 10 or less carbon atoms and may be substituted, for example, a 1-imidazolyl group, 2-furyl group, 2-pyridyl group, 3-pyridyl group, 3,5-dicyano-2-pyridyl group, 5-tetrazolyl group, 5-phenyl-1-tetrazolyl group, 2-benzthiazolyl group, 2-benzimidazolyl group, 2-benzoxazolyl group, 2-oxazoline-2-yl group and morpholino group), an acyl group (an acyl group which has generally 20 or less carbon atoms and preferably 8 or less carbon atoms and may be substituted, for example, an acetyl group, propionyl group, butyroyl group, iso-butyroyl group, 2,2-dimethylpropionyl group, benzoyl group, 3,4-dichlorobenzoyl group, 3-acetylamino-4-methoxybenzoyl group and 4-methylbenzoyl group), a sulfonyl group (a sulfonyl group which has generally 20 or less carbon atoms and preferably 8 or less carbon atoms and may be substituted, for example, a methanesulfonyl group, ethanesulfonyl group, chloromethanesulfonyl group, propanesulfonyl group, butanesulfonyl group, n-octanesulfonyl group, n-dodecanesulfonyl group, benzenesulfonyl group and 4-methylphenylsulfonyl group), an alkoxy group (an alkoxy group which has generally 20 or less carbon atoms and preferably 8 or less carbon atoms and may be substituted, for example, a methoxy group, ethoxy group, n-propyloxy group, iso-propyloxy group and cyclohexylmethoxy group), an aryloxy group or heteroaryloxy group (an aryloxy group or heteroaryloxy group which has generally 20 or less carbon atoms and preferably 10 or less carbon atoms and may be substituted, for example, a phenoxy group, naphthyloxy group, 4-acetylaminophenoxy group, pyrimidine-2-yloxy group and 2-pyridyloxy group), a silyloxy group (a silyloxy group which has generally 10 or less carbon atoms and preferably 8 or less carbon atoms and may be substituted, for example, a trimethylsilyloxy group and tert-butyldimethylsilyloxy group), an alkylthio group (an alkylthio group which has generally 20 or less carbon atoms and preferably 8 or less carbon atoms and may be substituted, for example, a methylthio group, ethylthio group, n-butylthio group, n-octylthio group, t-octylthio group, ethoxycarbonylmethylthio group, benzylthio group and 2-hydroxyethylthio group), an arylthio group or heteroarylthio group (an arylthio or heteroarylthio group which has generally 20 or less carbon atoms and preferably 10 or less carbon atoms and may be substituted, for example, a phenylthio group, 4-chlorophenylthio group, 2-n-butoxy-5-t-octylphenylthio group, 4-nitrophenylthio group, 2-nitrophenylthio group, 4-acetylaminophenylthio group, 1-phenyl-5-tetrazolylthio group, 5-methanesulfonylbenzothiazole-2-yl group), a carbamoyl group (a carbamoyl group which has generally 20 or less carbon atoms and preferably 8 or less carbon atoms and may be substituted, for example, a carbamoyl group, methylcarbamoyl group, dimethylcarbamoyl group, bis-(2-methoxyethyl)carbamoyl group, diethylcarbamoyl group, cyclohexylcarbamoyl group and di-n-octylcarbamoyl group), a sulfamoyl group (a sulfamoyl group which has generally 20 or less carbon atoms and preferably 8 or less carbon atoms and may be substituted, for example, a sulfamoyl group, methylsulfamoyl group, dimethylsulfamoyl group, bis-(2-methoxyethyl)sulfamoyl group, diethylsulfamoyl group, di-n-butylsulfamoyl group, methyl-n-octylsulfamoyl group, 3-ethoxypropylmethylsulfamoyl group and N-phenyl-N-methylsulfamoyl group), an acylamino group (an acylamino group which has generally 20 or less carbon atoms and preferably 8 or less carbon atoms and may be substituted, for example, an acetylamino group, 2-carboxybenzoylamino group, 3-nitrobenzoylamino group, 3-diethylaminopropanoylamino group and acryloylamino group), a sulfonylamino group (a sulfonylamino group which has generally 20 or less carbon atoms and preferably 8 or less carbon atoms and may be substituted, for example, a methanesulfonylamino group, benzenesulfonylamino group and 2-methoxy-5-n-methylbenzenesulfonylamino group), an alkoxycarbonylamino group (an alkoxycarbonylamino group which has generally 20 or less carbon atoms and preferably 8 or less carbon atoms and may be substituted, for example, a methoxycarbonylamino group, ethoxycarbonylamino group, 2-methoxyethoxycarbonylamino group, iso-butoxycarbonylamino group, benzyloxycarbonylamino group, t-butoxycarbonylamino group and 2-cyanoethoxycarbonylamino group), an alkoxycarbonyloxy group (an alkoxycarbonyloxy group which has generally 20 or less carbon atoms and preferably 8 or less carbon atoms and may be substituted, for example, a methoxycarbonyloxy group, ethoxycarbonyloxy group and methoxyethoxycarbonyloxy group), an aryloxycarbonylamino group (an aryloxycarbonylamino group which has generally 20 or less carbon atoms and preferably 8 or less carbon atoms and may be substituted, for example, a phenoxycarbonylamino group, 2,4-nitrophenoxycarbonylamino group and 4-t-butoxyphenoxycarbonylamino group), an aminocarbonylamino group (an aminocarbonylamino group which has generally 20 or less carbon atoms and preferably 8 or less carbon atoms and may be substituted, for example, a methylaminocarbonylamino group, morpholinocarbonylamino group, diethylaminocarbonylamino group, N-ethyl-N-phenylaminocarbonylamino group, 4-cyanophenylaminocarbonylamino group and 4-methanesulfonylaminocarbonylamino group), an aminocarbonyloxy group (an aminocarbonyloxy group which has generally 20 or less carbon atoms and preferably 8 or less carbon atoms and may be substituted, for example, a dimethylaminocarbonyloxy group and pyrrolidinocarbonyloxy group), an aminosulfonylamino group (an aminosulfonylamino group which has generally 20 or less carbon atoms and preferably 8 or less carbon atoms and may be substituted, for example, a diethylaminosulfonylamino group, di-n-butylaminosulfonylamino group and phenylaminosulfonylamino group), an amino group (an amino group which has generally 30 or less carbon atoms and preferably 8 or less carbon atoms and may be substituted, for example, an amino group, methylamino group, dimethylamino group, ethylamino group, ethyl-3-carboxypropylamino group, ethyl-2-sulfoethylamino group, phenylamino group, methylphenylamino group and methyloctylamino group), an alkoxycarbonyl group (an alkoxycarbonyl group which has generally 20 or less carbon atoms and preferably 6 or less carbon atoms and may be substituted, for example, a methoxycarbonyl group, ethoxycarbonyl group and methoxyethoxycarbonyl group), an aryloxycarbonyl group (an aryloxycarbonyl group which has generally 20 or less carbon atoms and preferably 10 or less carbon atoms and may be substituted, for example, a phenoxycarbonyl group and p-methoxyphenoxycarbonyl group), an acyloxy group (an acyloxy group which has generally 20 or less carbon atoms and preferably 8 or less carbon atoms and may be substituted, for example, an acetoxy group, benzoyloxy group, 2-butenoyloxy group and 2-methylpropanoyloxy group), an aryloxycarbonyloxy group (an aryloxycarbonyloxy group which has generally 20 or less carbon atoms and preferably 8 or less carbon atoms and may be substituted, for example, a phenoxycarbonyloxy group, 3-cyanophenoxycarbonyloxy group, 4-acetoxyphenoxycarbonyloxy group and 4-t-butoxycarbonylaminophenoxycarbonyloxy group), and a sulfonyloxy group (a sulfonyloxy group which has generally 20 or less carbon atoms and preferably 8 or less carbon atoms and may be substituted, for example, a phenylsulfonyloxy group, methanesulfonyloxy group, chloromethanesulfonyloxy group, 4-chlorophenylsulfonyloxy group and dodecylsulfonyloxy group).

Next, examples of the color-developing agent represented by the formula (II) will be explained. However, the scope of the present invention is not limited to these exemplified examples.

R-1

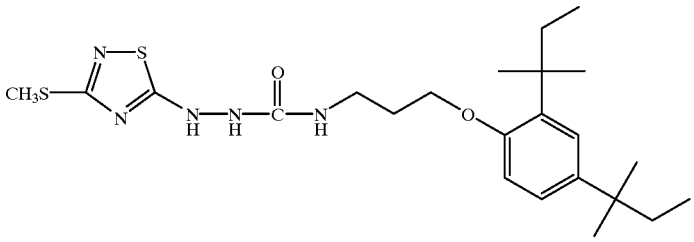

R-2

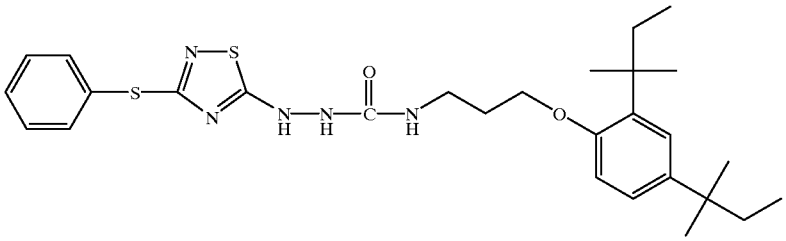

R-3

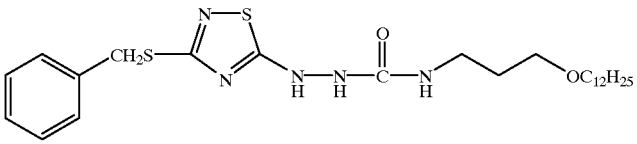

R-4

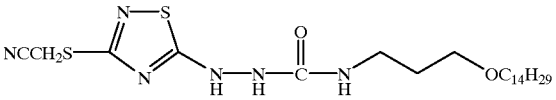

R-5

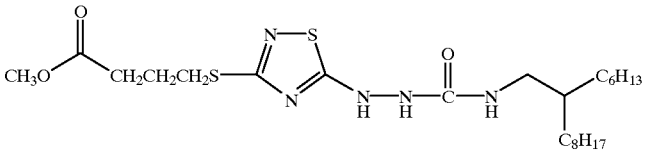

R-6

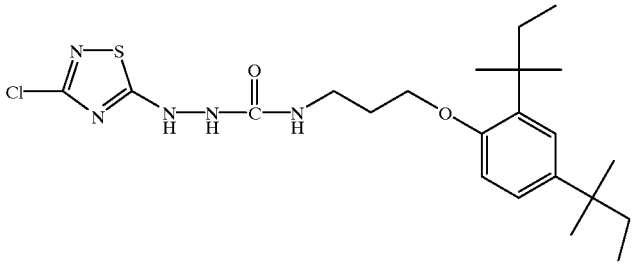

-continued
R-7
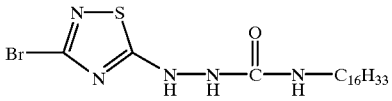
R-8
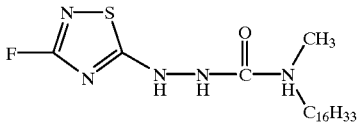
R-9
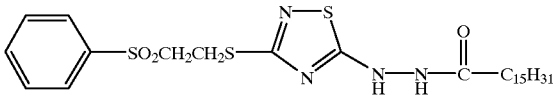
R-10
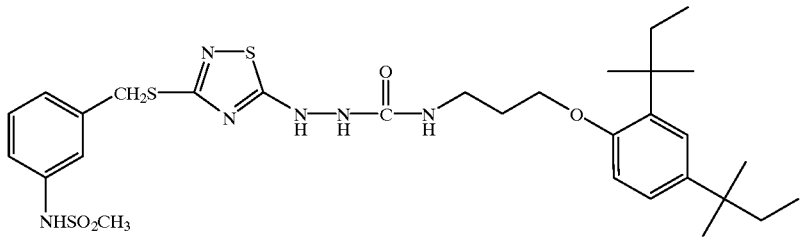
R-11
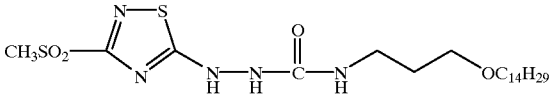
R-12
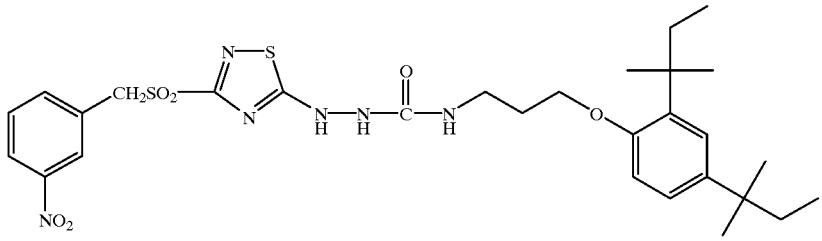
R-13
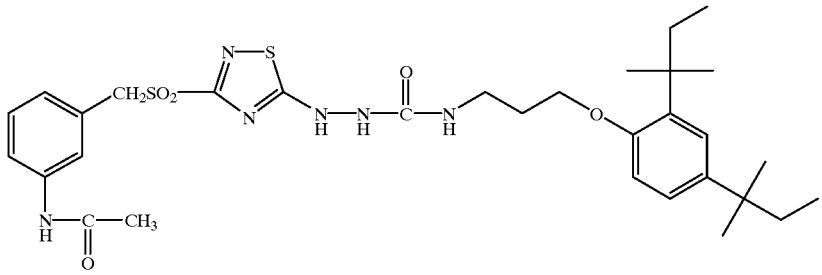
R-14
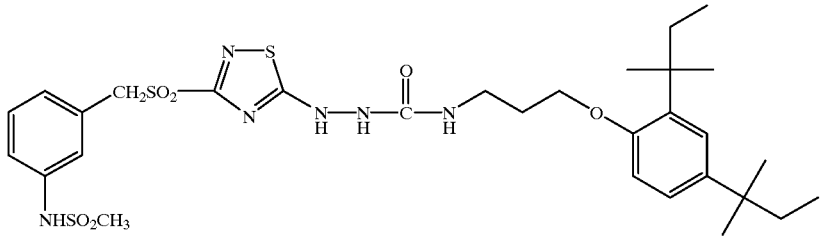
R-15
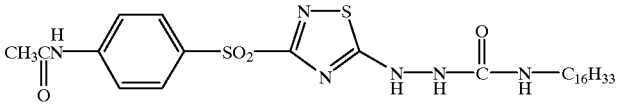

-continued
R-16
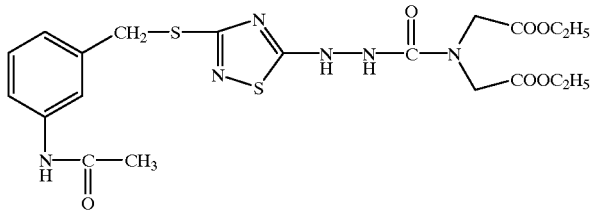
R-17
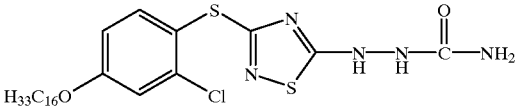
R-18
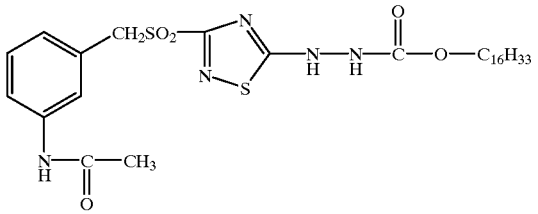
R-19
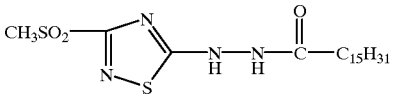
R-20
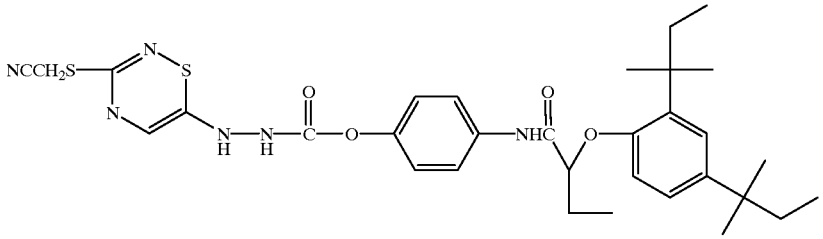
R-21
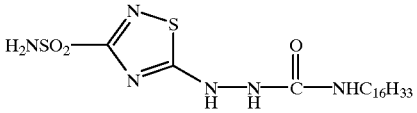
R-22
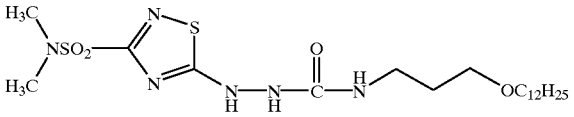
R-23
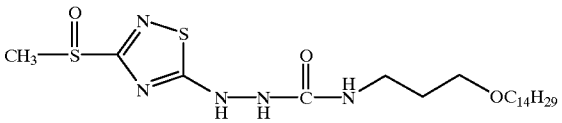
R-24
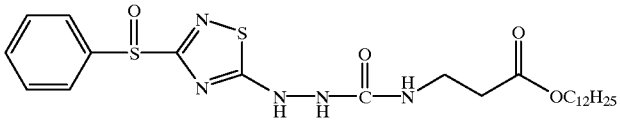

-continued
R-25
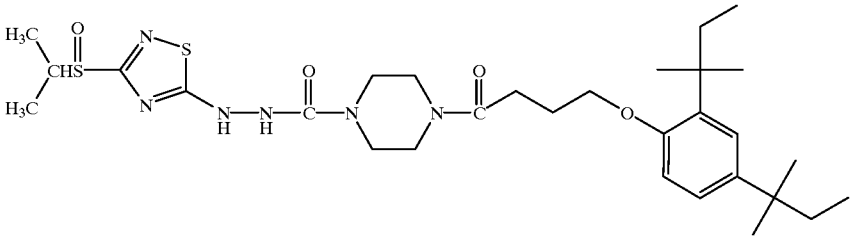
R-26
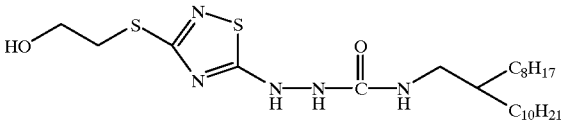
R-27
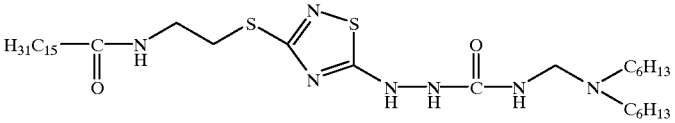
R-28
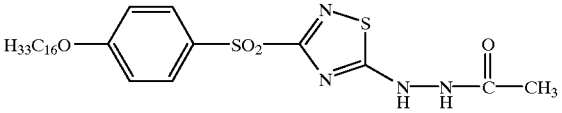
R-29
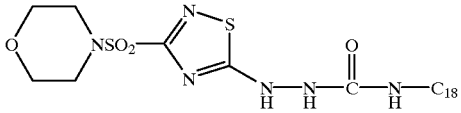
R-30
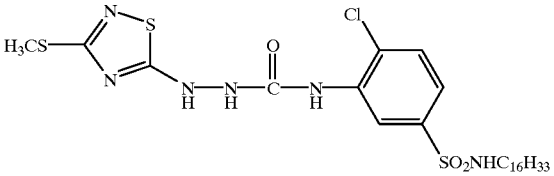
R-31
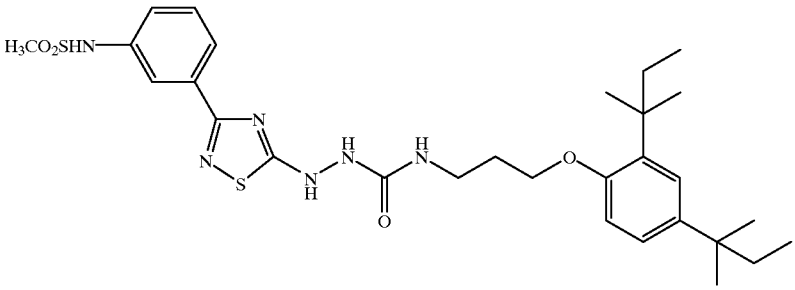
R-32
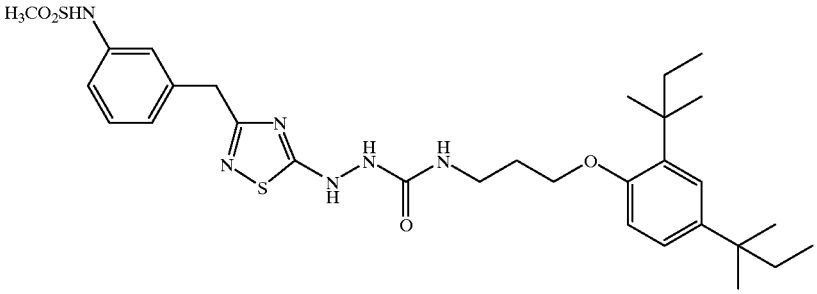

-continued
R-33
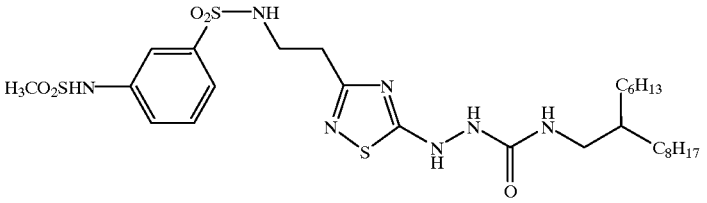
R-34
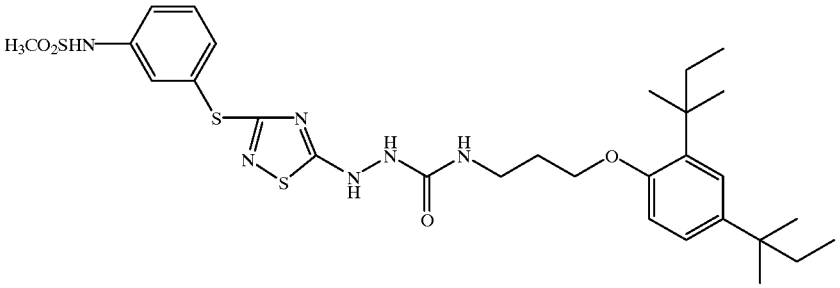
R-35
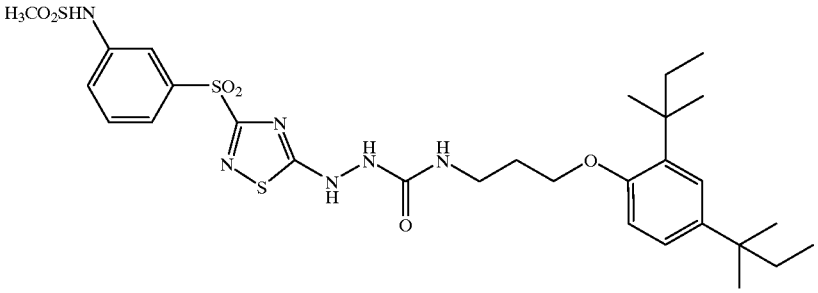
R-36
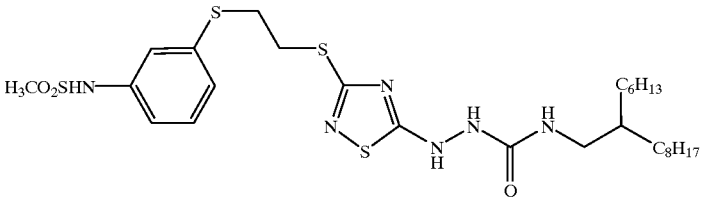
R-37
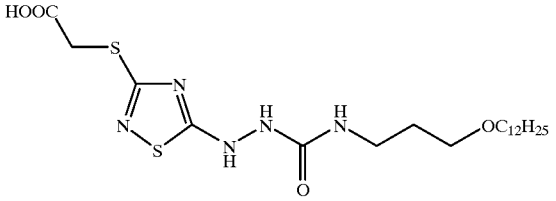
R-38
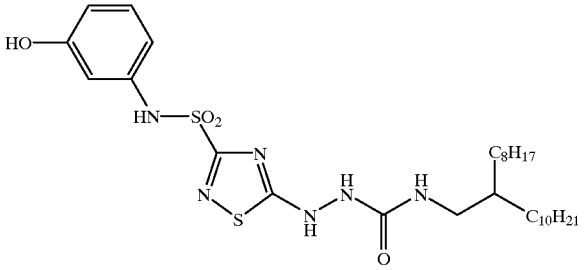

-continued
R-39
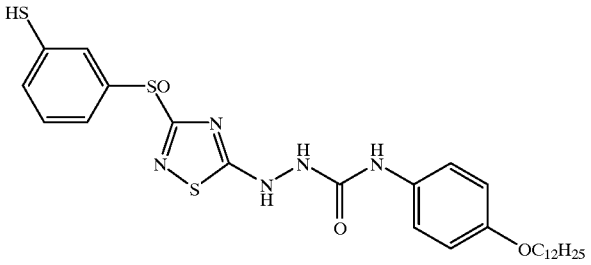
R-40
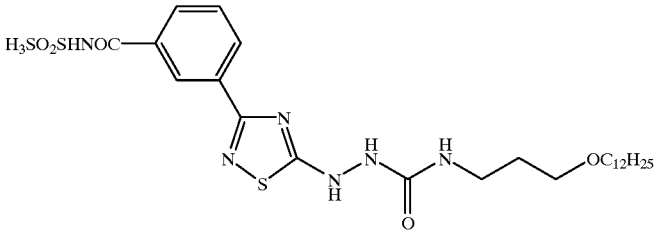
R-41
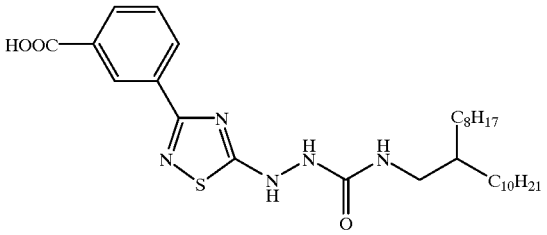
R-42
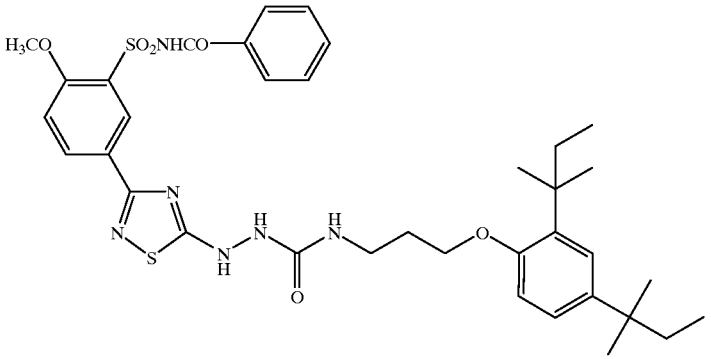
R-43
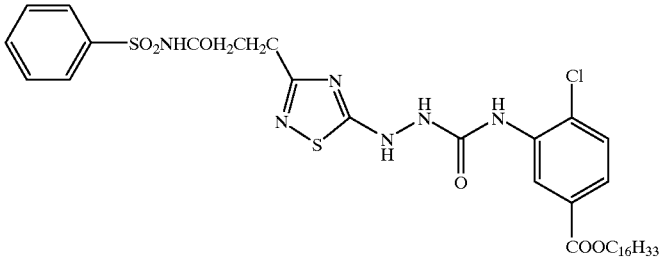
R-44
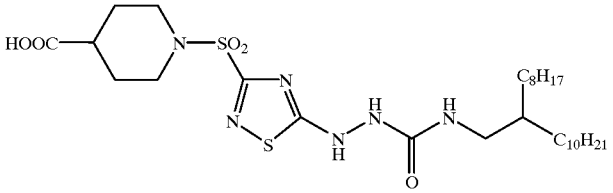

-continued
R-45
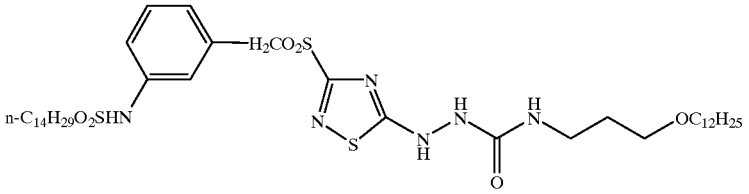
R-46
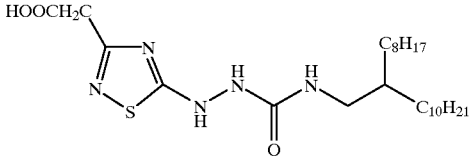
R-47
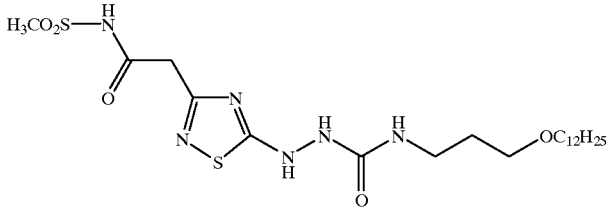
R-48
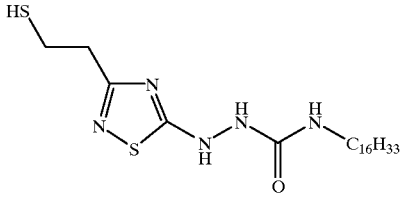
R-49
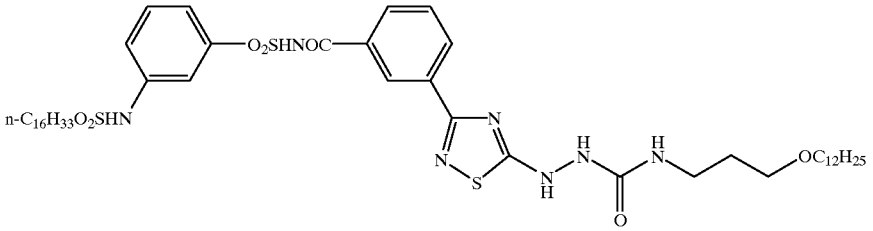
R-50
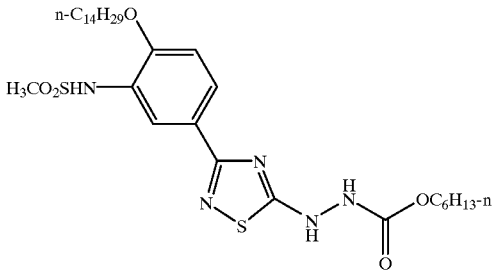
R-51
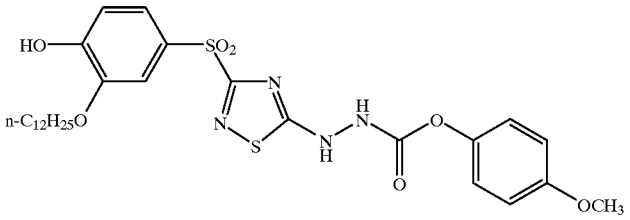

-continued
R-52
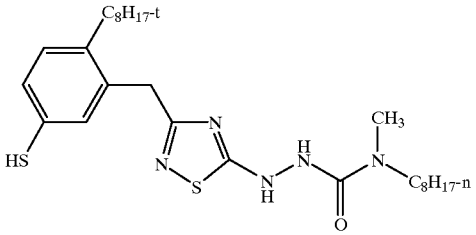
R-53
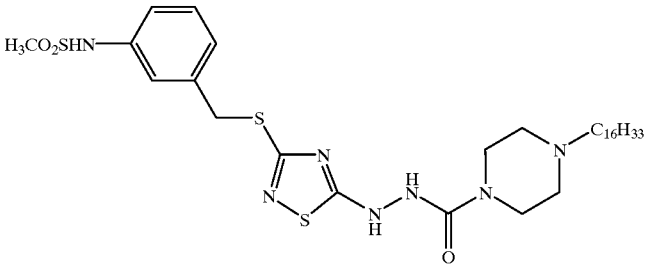
R-54
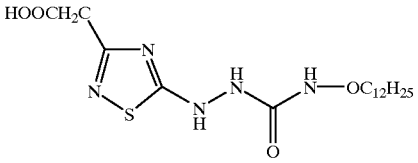
R-55
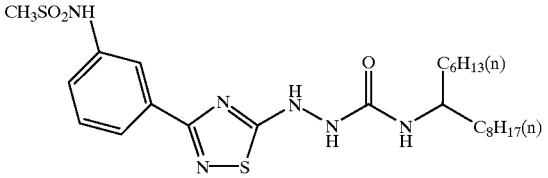
R-56
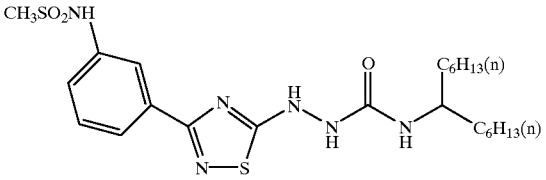
R-57
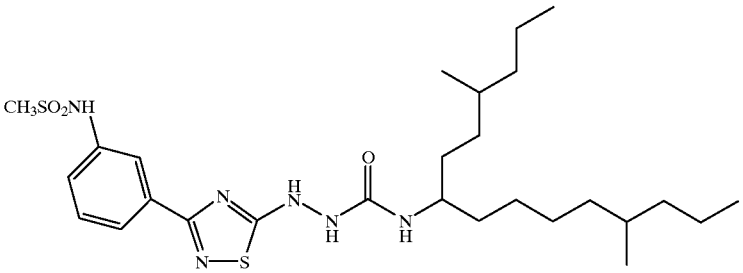
R-58
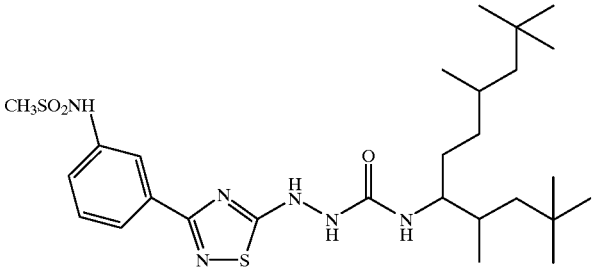

-continued
R-59
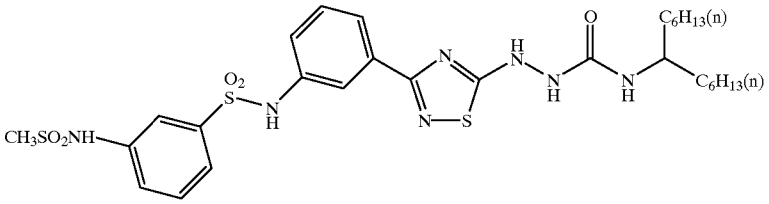
R-60
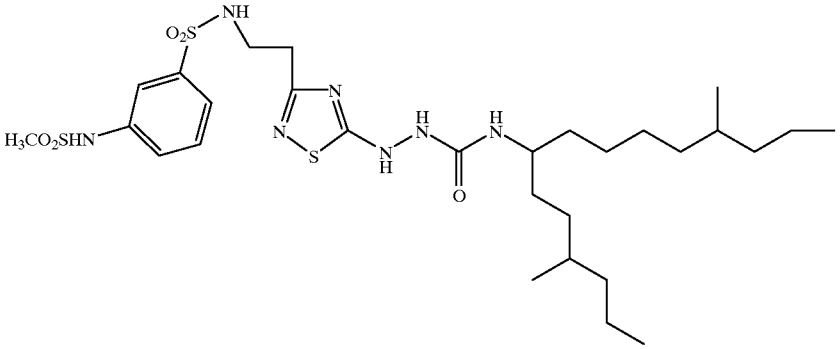
R-61
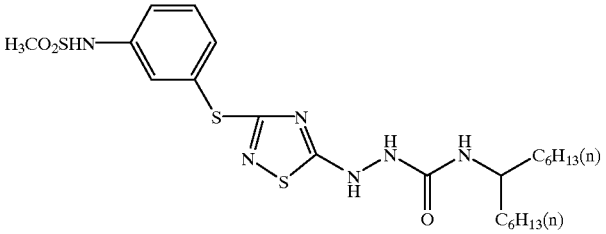
R-62
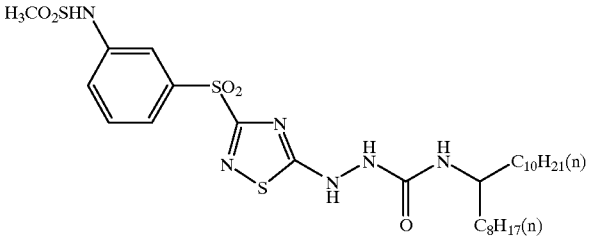
R-63
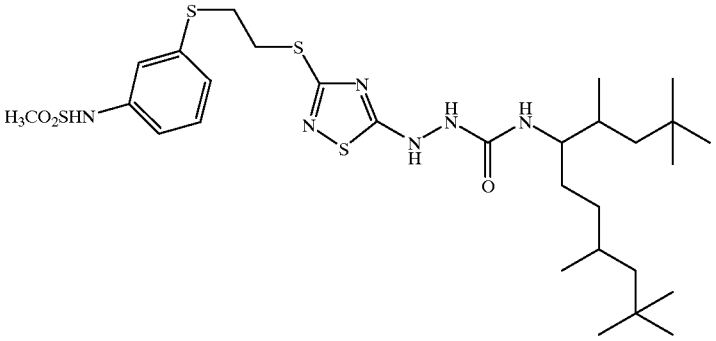

-continued
R-64
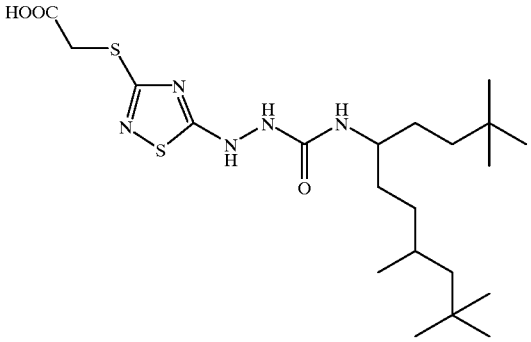
R-65
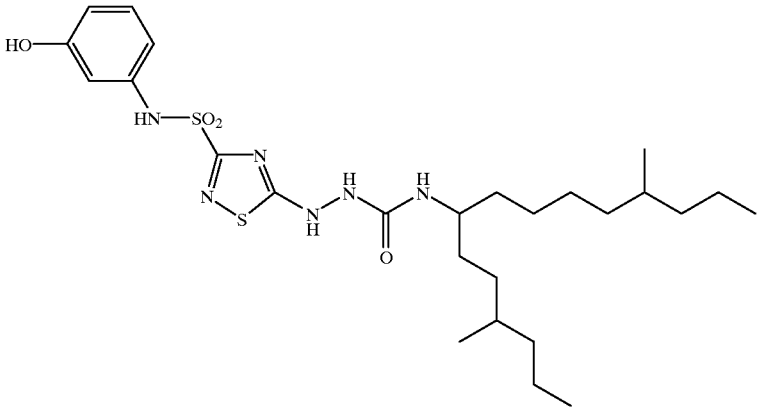
R-66
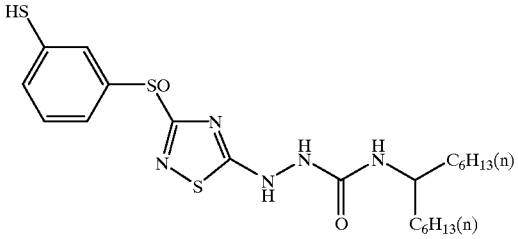
R-67
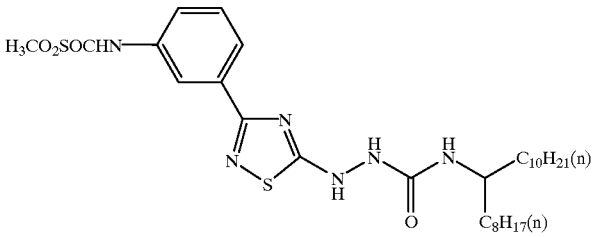
R-68
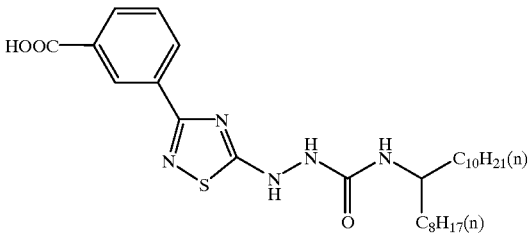
R-69
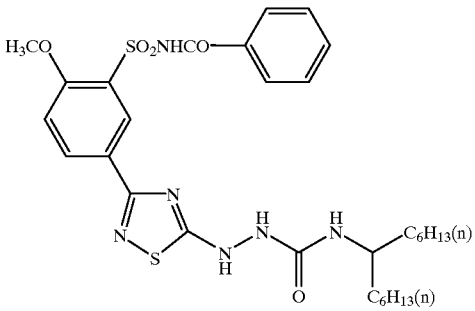

-continued
R-70
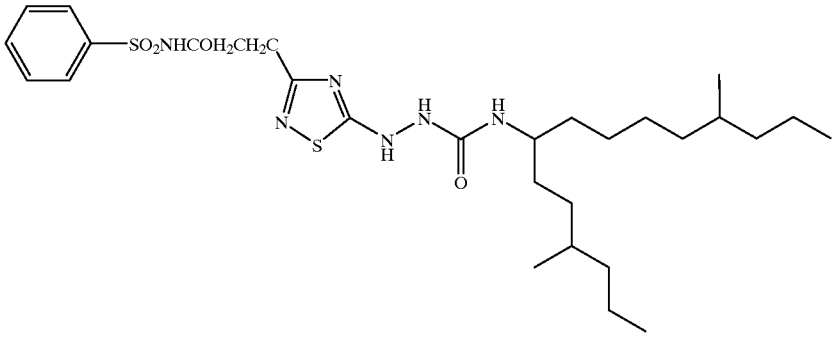
R-71
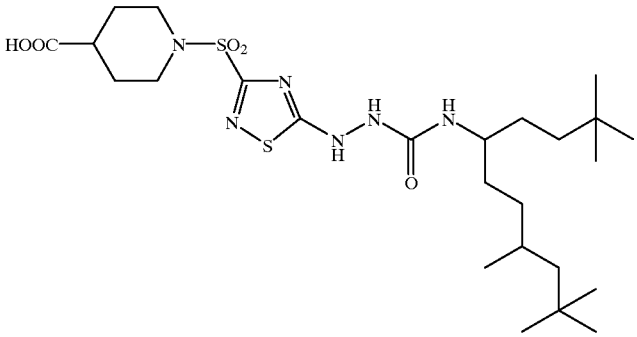
R-72
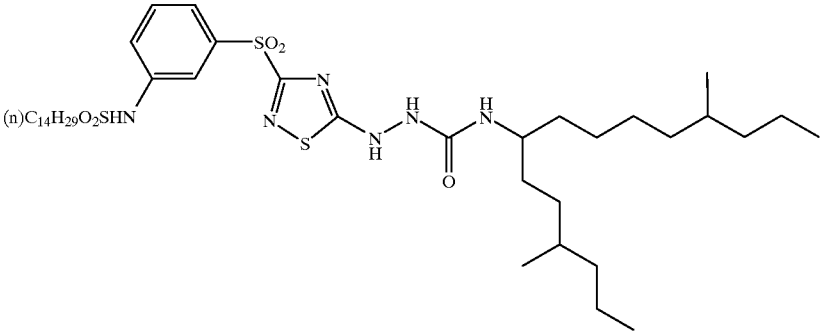
R-73
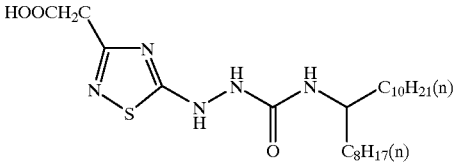
R-74
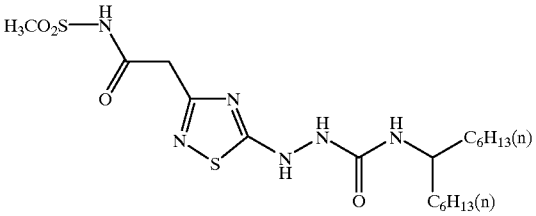

-continued
R-75
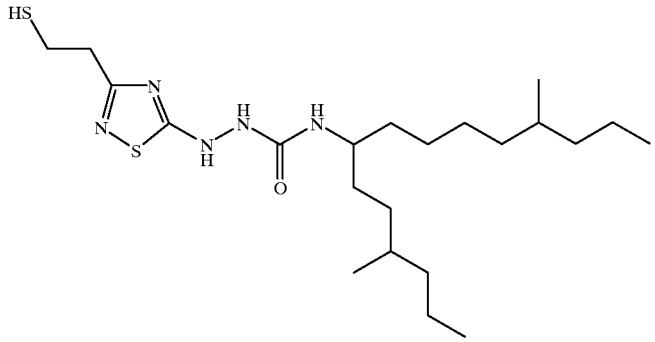
R-76
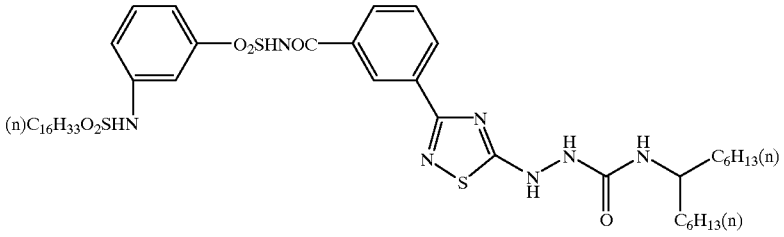
R-77
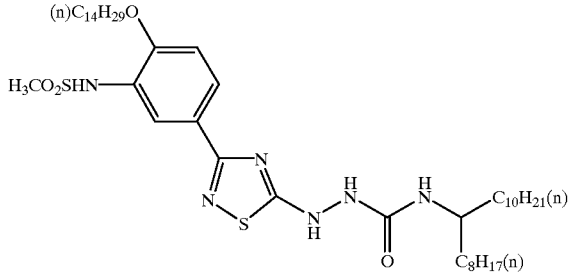
R-78
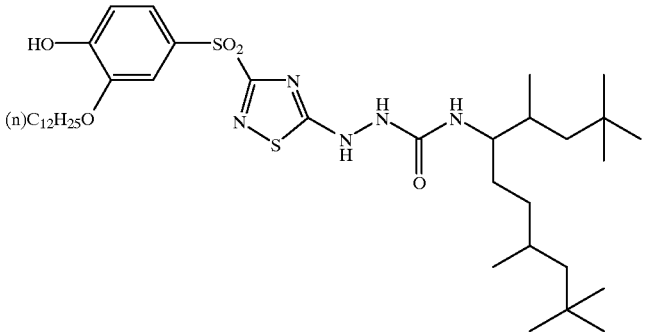
R-79
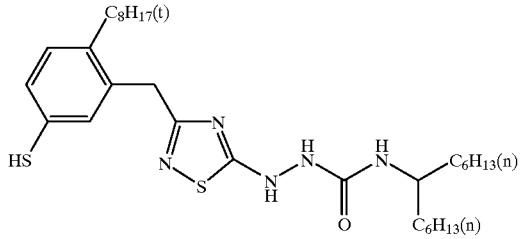

-continued
R-80
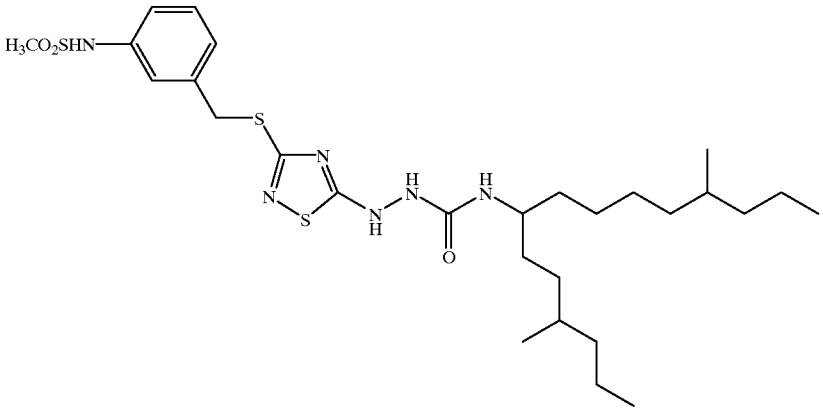
R-81
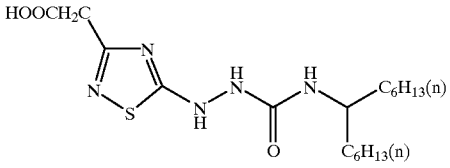
R-78
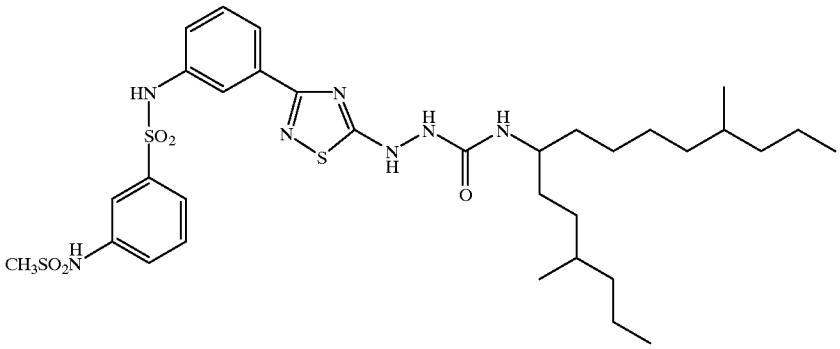
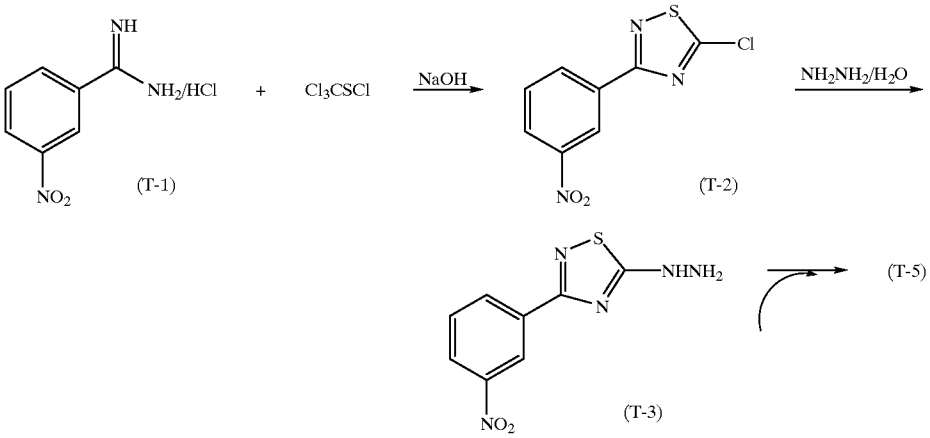

-continued

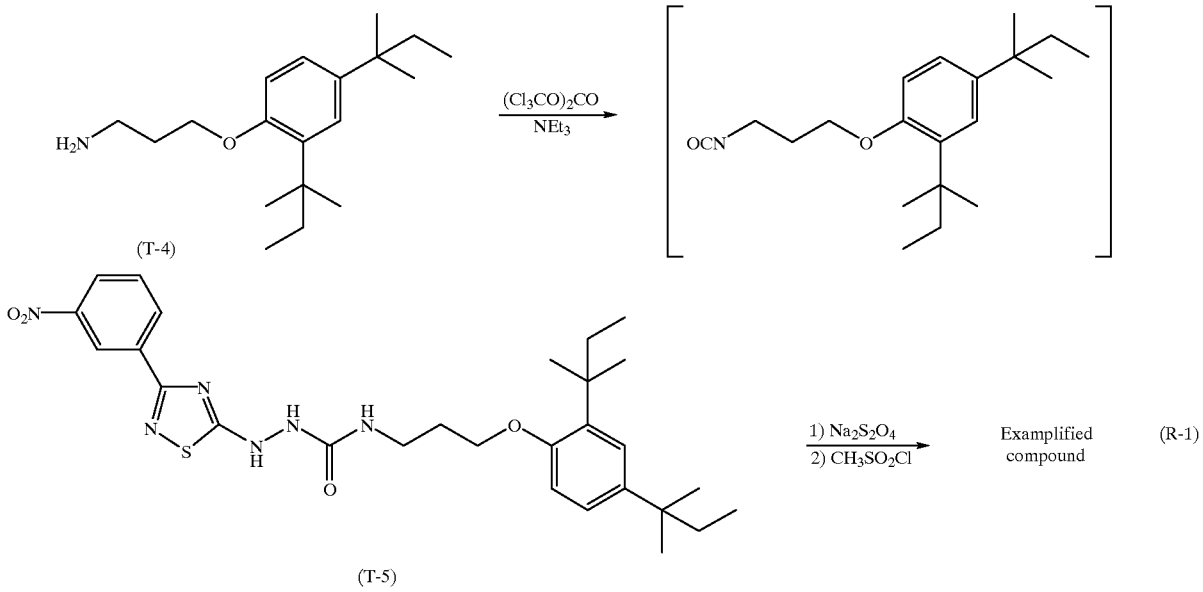

Synthesis of Exemplified Compound (R-1)

Synthesis of compound (T-3)

102.1 g of the compound (T-1) was suspended in 1 liter of methylene chloride, to which was added 100 g of perchloromethylmercaptan. The reaction system was cooled to 0–5° C. and a solution in which 200 g of sodium hydroxide was dissolved in 600 ml of water was added dropwise to the reaction system such that the reaction temperature was kept at 15° C. or less. After the reaction was completed, the water phase was removed and 50 g of hydrazine hydrate was added dropwise to the organic layer at 15° C. or less. After the reaction was completed, 1 liter of water was added to the reaction solution to carry out an extraction operation. The organic layer was concentrated under reduced pressure to obtain an intermediate (T-3) in an amount of 137.5 g (58%).

Synthesis of Compound (T-5)

100.5 g of triphosgene was dissolved in 2 liter of tetrahydrofuran. Under cooling, 300.0 g of the compound (T-4) and then 150 ml of triethylamine were added dropwise to the mixture. After the dropwise addition was completed, the reaction was continued 1 hour at room temperature, then 237.5 g of the compound (T-3) was divided into five parts which were separately added to the reaction mixture. After the addition was completed, the reaction was further continued for 2 hours. To the reaction mixture were added 2 liters of ethyl acetate and 2 liters of water to carry out extraction, followed by washing further with 2 liter of water twice. Then, the organic layer was dried using magnesium sulfate anhydride and the solvent was distilled off under reduced pressure. The residue was recrystallized from acetonitrile to obtain 360.1 g (65%) of Compound (T-5) as white crystals.

Synthesis of Exemplified compound (R-1)

27.7 g of the intermediate compound (T-5) was dissolved in 500 ml of ethyl acetate, 400 ml of water and 100 ml of ethanol, to which was further added 87 g of sodium hydrosulfite. The mixture was reacted for 2 hours and thereafter subjected to an extraction operation, followed by washing with 500 ml of water twice. The organic layer was dried using magnesium sulfate anhydride and the solvent was distilled off under reduced pressure. The residue was dissolved in 100 ml of DMAC and 7 ml of triethylamine, to which was added dropwise 4.0 ml of methanesulfonyl chloride under ice-cooling such that the internal temperature did not exceed 15° C. Then, the reaction was further run for 1 hour and the reaction mixture was poured into 500 ml of 1N hydrochloric acid. The precipitated crystals were collected by filtration and washed, followed by drying to obtain crude crystals. The crude crystals were recrystallized from acetonitrile to obtain 24.1 g (80%) of Exemplified compound (R-1) as white crystals.

Synthesis of compound (T-3)

171.5 g of m-nitrobenzyl chloride and 80 g of thiourea were dissolved in 1 liter of isopropyl alcohol and the mixture was heated under reflux for 2 hours. In succession to the reaction, the reaction mixture was cooled to room temperature to collect the precipitated crystals by filtration, which were then washed with 300 ml of isopropyl alcohol. Thus, 237.6 g (96%) of a compound (T-3) was obtained as white crystals.

Synthesis of compound (T-4)

A compound (T-4) was synthesized according to the synthetic method of the Exemplified compound (R-1).

Synthesis of compound (T-5)

57.5 g of the compound (T-4) was suspended in 300 ml of acetic acid, to which was added dropwise 35 ml of aqueous 35% hydrogen peroxide solution at an internal temperature of 50° C. The reaction system was completely uniformed within one hour after the dropwise addition was finished and thus the reaction was completed. The reaction solution was poured into 1 liter of 1N hydrochloric acid to collect the precipitated crystals by filtration, which were then washed with water. The resulting crude crystals were subjected to a silica gel column chromatography to obtain 30.9 g (44%) of a compound (T-5) as white crystals from the eluate of hexane/ethyl acetate (3:1).

Synthesis of Exemplified compound (R-14)

33.2 g of Exemplified compound (R-12) was dissolved in 500 ml of ethyl acetate, 400 ml of water and 100 ml of ethanol, to which was further added 87 g of sodium hydrosulfite. The mixture was reacted for 2 hours and thereafter subjected to an extraction operation, followed by washing with 500 ml of water twice. The organic layer was dried using magnesium sulfate anhydride and the solvent was distilled off under reduced pressure. The residue was dissolved in 100 ml of DMAC and 7 ml of triethylamine, to which was added dropwise 3.8 g of acetyl chloride under ice-cooling such that the internal temperature did not exceed 15° C. Then, the reaction was further run for 1 hour and the reaction mixture was poured into 500 ml of IN hydrochloric acid. The precipitated crystals were collected by filtration and washed, followed by drying to obtain crude crystals. The crude crystals were recrystallized from acetonitrile to obtain 25.3 g (68%) of Exemplified compound (R-14) as white crystals.

A compound generally named as active methylene, pyrazolon, pyrazoloazole, phenol, naphthol, or pyrrolotriazole is preferably used as a coupler in the present invention, and these compounds are known compound in the field of the art.

Next, couplers represented by formula (III) are described in detail.

In formula (III), $R^1$ represents an alkyl group. The alkyl group includes a straight or branched chain or cyclic alkyl group having 1 to 50 carbon atoms (e.g., methyl, ethyl, isopropyl, t-butyl, t-pentyl, cyclopropyl, cyclohexyl, 2-ethylhexyl, or dodecyl). The alkyl group is preferably a secondary or tertiary alkyl group, more preferably a tertiary alkyl group, and most preferably a t-butyl group. The carbon atoms of the alkyl group is preferably in the range of 1 to 8, more preferably in the range of 1 to 5, and most preferably in the range of 1 to 4. The alkyl group represented by $R^1$ may have a substituent but for a halogen atom. Examples of the substituent include a straight or branched chain or cyclic alkyl group having 1 to 50 carbon atoms (e.g., trifluoromethyl, methyl, ethyl, propyl, heptafluoropropyl, isopropyl, butyl, t-butyl, t-pentyl, cyclopentyl, cyclohexyl, octyl, 2-ethylhexyl, or dodecyl), a straight or branched chain or cyclic alkenyl group having 2 to 50 carbon atoms (e.g., vinyl, 1-methylvinyl, or cyclohexyl-1-yl), an alkynyl group having 2 to 50 carbon atoms (e.g., ethynyl or 1-propynyl), an aryl group having 6 to 50 carbon atoms (e.g., phenyl, naphthyl, or anthryl), an acyloxy group having 1 to 50 carbon atoms (e.g., acetoxy, tetradecanoyloxy, or benzoyloxy), a carbamoyloxy group having 1 to 50 carbon atoms (e.g., N,N-dimethylcarbamoyloxy), a carbonamide group having 1 to 50 carbon atoms (e.g., formamido, N-methylacetoamido, acetoamido, N-methylformamido, or benzamido), a sulfonamido group having 1 to 50 carbon atoms (e.g., methane sulfonamido, dodecane sulfonamido, benzene sulfonamido, or p-toluene sulfonamido), a carbamoyl group having 1 to 50 carbon atoms (e.g., N-methyl carbamoyl, N,N-diethyl carbamoyl, or N-mesylcarbamoyl), a sulfamoyl group having 0 to 50 carbon atoms (e.g., N-butyl sulfamoyl, N,N-diethyl sulfamoyl, or N-methyl-N-(4-methoxyphenyl) sulfamoyl), an alkoxy group having 1 to 50 carbon atoms (e.g., methoxy, propoxy, isopropoxy, octyloxy, t-octyloxy, dodecyloxy, or 2-(2,4-di-t-pentylphenoxy)ethoxy), an aryloxy group having 6 to 50 carbon atoms (e.g., phenoxy, 4-methoxy phenoxy, or naphthoxy), an aryloxycarbonyl group having 7 to 50 carbon atoms (e.g., phenoxycarbonyl or naphthoxycarbonyl), an alkoxycarbonyl group having 2 to 50 carbon atoms (e.g., methoxycarbonyl or t-butoxycarbonyl), an N-acylsulfamoyl group having 1 to 50 carbon atoms (e.g., N-tetradecanoylsulfamoyl or N-benzoylsulfamoyl), an alkylsulfonyl group having 1 to 50 carbon atoms (e.g., methane sulfonyl, octylsulfonyl, 2-methoxyethylsulfonyl, or 2-hexyldecyl sulfonyl), an arylsulfonyl group having 6 to 50 carbon atoms (e.g., benzene sulfonyl, p-toluene sulfonyl, or 4-phenylsulfonyl phenylsulfonyl), an alkoxycarbonylamino group having 2 to 50 carbon atoms (e.g., ethoxycarbonylamino), an aryloxycarbonylamino group having 7 to 50 carbon atoms (e.g., phenoxycarbonylamino or naphthoxycarbonylamino), an amino group having 0 to 50 carbon atoms (e.g., amino, methylamino, diethylamino, diisopropylamino, anilino, or morpholino), a cyano group, a nitro group, a carboxyl group, a hydroxyl group, a sulfo group, a mercapto group, an alkylsulfinyl group having 1 to 50 carbon atoms (e.g., methane sulfinyl or octane sulfinyl), an arylsulfinyl group having 6 to 50 carbon atoms (e.g., benzene sulfinyl, 4-chlorobenzene sulfinyl, or p-toluene sulfinyl), an alkylthio group having 1 to 50 carbon atoms (e.g., methylthio, octylthio, or cyclohexylthio), an arylthio group having 6 to 50 carbon atoms (e.g., phenylthio, or naphthylthio), an ureido group having 1 to 50 carbon atoms (e.g., 3-methylureido, 3,3-dimethylureido, or 1,3-diphenylureido), a heterocyclic group having 2 to 50 carbon atoms (e.g., a group derived from a 3- to 12-member single or condensed ring containing, for example, at least one nitrogen, oxygen, sulfur, or the like as a hetero atom; e.g., 2-furyl, 2-pyranyl, 2-pyridyl, 2-thienyl, 2-imidazolyl, morpholino, 2-quinolyl, 2-benzimidazolyl, 2-benzothiazolyl, or 2-benzoxazolyl), an acyl group having 1 to 50 carbon atoms (e.g., acetyl, benzoyl, or trifluoroacetyl), an sulfamoylamino group having 0 to 50 carbon atoms (e.g., N-butyl sulfamoylamino or N-phenyl sulfamoylamino), and a silyl group having 3 to 50 carbon atoms (e.g., trimethyl silyl, dimethyl t-butyl silyl, or triphenyl silyl). The foregoing substituents may further have a substituent. Examples of such an additional substituent are the same as the foregoing substituents.

In formula (III), $R^2$ represents a hydrogen atom, or a substituent. Examples of the substituent are a halogen atom and the same as the foregoing substituents exemplified as a substituent which $R^1$ may have.

$R^2$ is preferably a hydrogen atom, a halogen atom, an acylamino group, an alkoxycarbonylamino group, an aryloxycarbonylamino group, and an ureido group, more preferably an acylamino group, an alkoxycarbonylamino group, and an ureido group.

In formula (III), $R^3$ represents a hydrogen atom, or a substituent. Examples of the substituent are a halogen atom and the same as the foregoing substituents exemplified as a substituent which $R^1$ may have. $R^3$ is preferably a hydrogen atom.

In formula (III), at least one of $R^1$, $R^2$ and $R^3$ preferably has a dissociative group having a pKa of 1 to 12. More preferably R has the dissociative group. The pKa of the dissociative group is more preferably in the range of 3 to 12 and most preferably in the range of 5 to 11.

As a preferable dissociative group, there are groups including a —$NHSO_2$ group, a phenolic hydroxyl group, a —CONHCO— group, a —$CONHSO_2$— group, a —CON(R)—OH, a —COOH, a —$SO_2NHSO_2$— group. More preferred among these groups are a —$NHSO_2$ group, a phenolic hydroxyl group, a —CONHCO— group, a —$CONHSO_2$— group, a —$SO_2NHSO_2$— group. R represents a hydrogen atom, or a substituent. As the R, an alkyl group, an aryl group, and a heterocyclic group are preferred.

In formula (III), $X^1$ represents a group cleavable by a coupling reaction with an oxidation product of the developing agent. Examples of $X^1$ include a heterocyclic group (for example, a group derived from a saturated or unsaturated 5- to 7-member single ring or condensed ring containing at least one nitrogen, oxygen, sulfur, or the like as a hetero atom, more specifically such as succinimide, maleinimide, phthalimide, diglycolimide, pyrrole, pyrazole, imidazole, 1,2,4-triazole, tetrazole, indole, benzopyrrazole, benzimidazole, benzotriazole, imidazoline-2,4-dione, oxazolidine-2,4-dione, thiazolidine-2,4-dione, imidazoline-2-one, oxazoline-2-one, thiazoline-2-one, benzimidazoline-2-one, benzoxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone, 2-pyrazone, 2-amino-1,3,4-thiazolidine, or 2-imino-1,3,4-thiazolidine-4-one), a halogen atom (e.g., chlorine or bromine), an aryloxy group (e.g., phenoxy or 1-naphthoxy), a heterocyclicoxy group (e.g., pyridyloxy or pyrazolyloxy), an acyloxy group (e.g., cyclohexylcarbonyloxy or benzoyloxy), an alkoxy group (e.g., methoxy, ethoxy, or dodecyloxy), a carbamoyloxy group (e.g., N,N-didodecylcarbamoyloxy or morpholinocarbonyloxy), an aryloxycarbonyloxy group (e.g., phenoxycarbonyloxy), an alkoxycarbonyloxy group (e.g., methoxycarbonyloxy or hexadecyl carbonyloxy), an arylthio group (e.g., phenylthio or naphthylthio), a heterocyclic thio group (e.g., tetrazolylthio, 1,3,4-thiadiazolylthio, 1,3,4-oxadiazolylthio, or benzimidazolylthio), an alkylthio group (e.g., methylthio, octylthio, or hexadecylthio), an alkylsulfonyloxy group, an arylsulfonyloxy group (e.g., benzene sulfonyloxy or toluene sulfonyloxy), a carbonamido group (e.g., undecylcarbonamino or phenylcarbonamino), a sulfonamido group (e.g., dodecyl sulfonamido or benzenesulfonamido), an alkylsulfonyl group, an arylsulfonyl group (e.g., benzene sulfonyl), an alkylsulfinyl group (e.g., octyl sulfinyl), an arylsulfinyl group (e.g., benzene sulfinyl), and an carbamoylamino group (e.g., N-hexadecyl carbamoylamino).

Preferred among these groups are an aryloxy group, a heterocyclic oxy group, a acyloxy group, an alkoxycarbonyloxy group, a carbamoyloxy group, an aryloxycarbonyloxy group, an arylthio group, a heterocyclic thio group, an alkylsulfonyloxy group, and an arylsulfonyloxy group, more preferably an aryloxy group, a heterocyclic oxy group, a acyloxy group, an aryloxycarbonyloxy group, an alkoxycarbonyloxy group, a carbamoyloxy group. An alkoxycarbonyloxy group, a carbamoyloxy group are most preferred.

$X^1$ may be substituted with a substituent. Examples of the substituent that $X^1$ may have, are a halogen atom, and the same as the foregoing substituents exemplified as a substituent which $R^1$ may have.

$X^1$ preferably has a formula weight of 200 or greater, more preferably 250 or greater.

Specific examples of a coupler that can be used in the present invention are shown below, but the present invention is not limited to them.

(1)

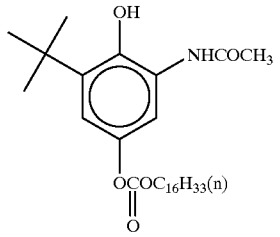

(2)

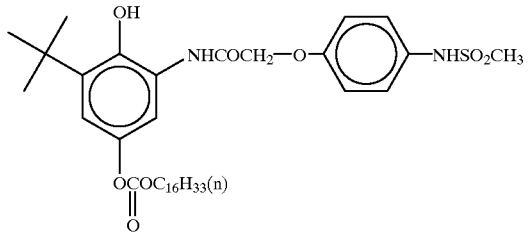

(3)

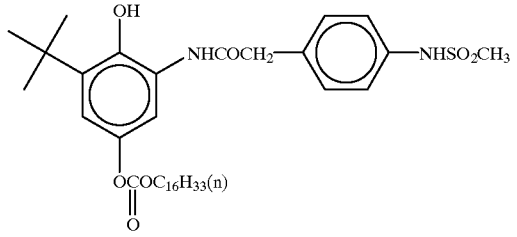

-continued
(4)
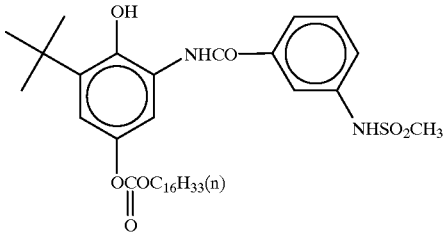
(5)
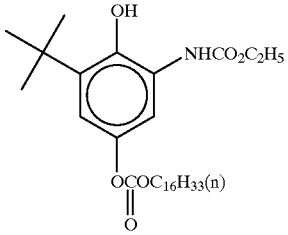
(6)
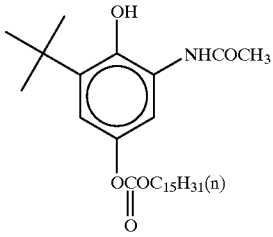
(7)
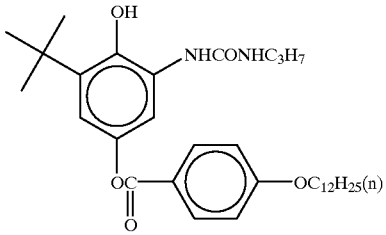
(8)
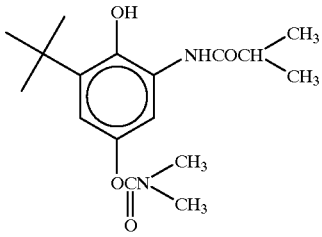
(9)
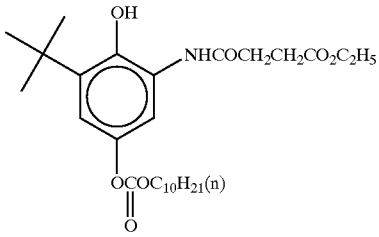

-continued
(10)
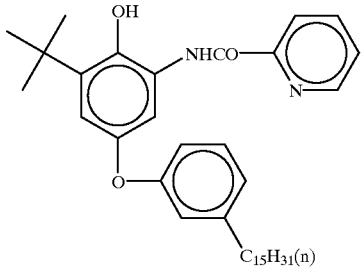
(11)
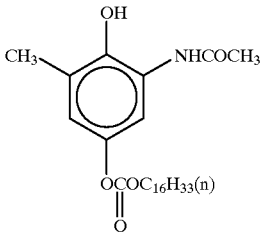
(12)
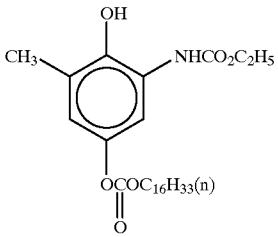
(13)
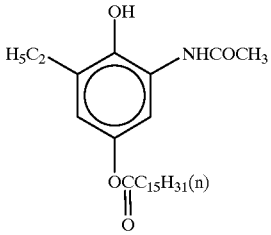
(14)
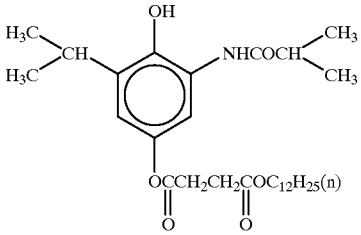
(15)
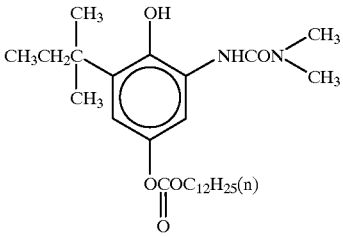

-continued
(16)
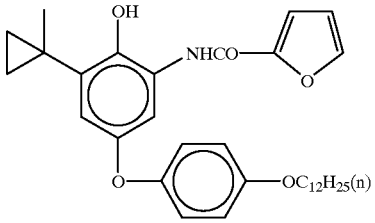
(17)
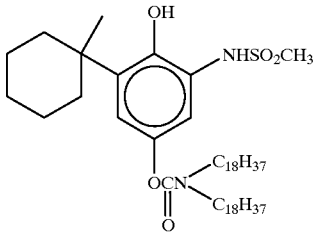
(18)
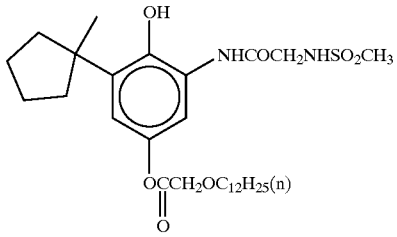
(19)
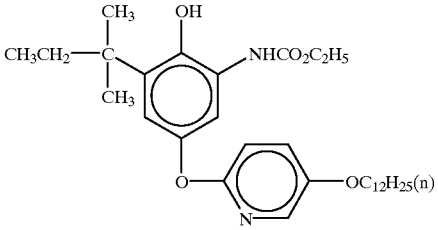
(20)
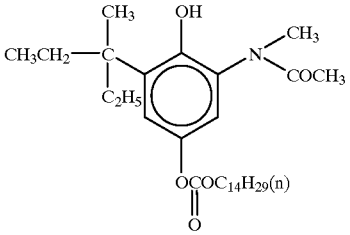
(21)
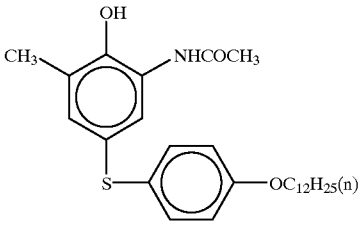

-continued
(22)
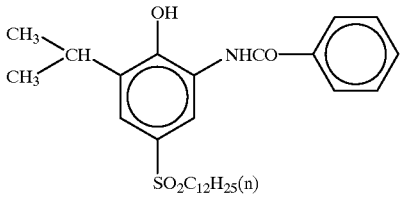
(23)
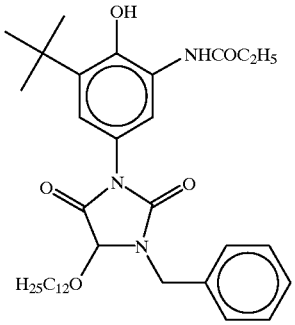
(24)
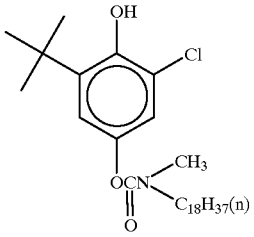
(25)
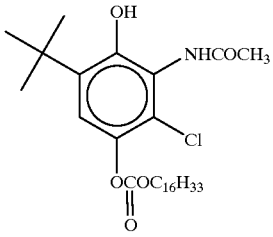
(26)
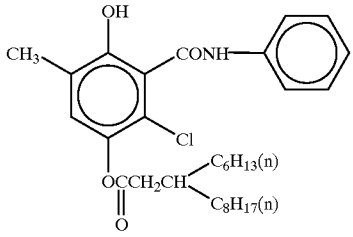
(27)
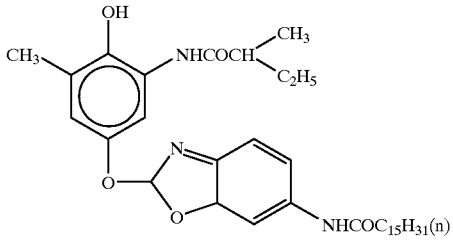

-continued
(28)
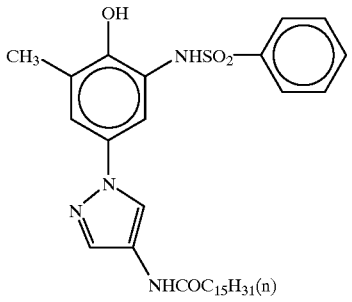
(29)
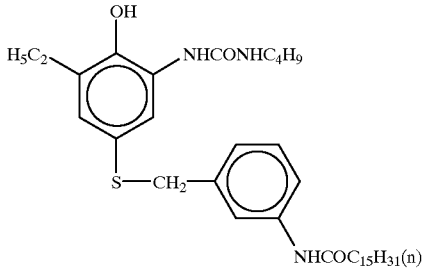
(30)
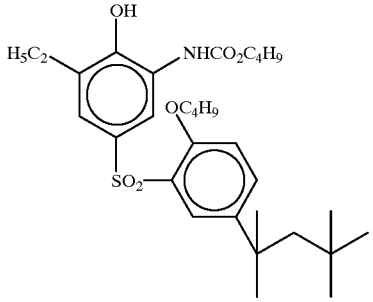
(31)
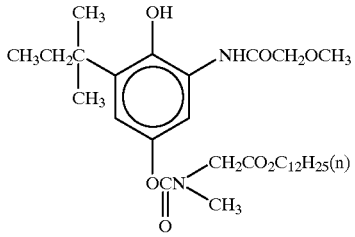
(32)
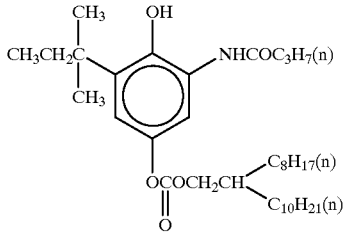

-continued
(33)
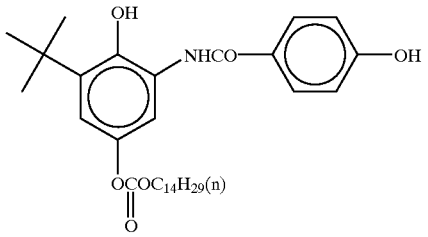
(34)
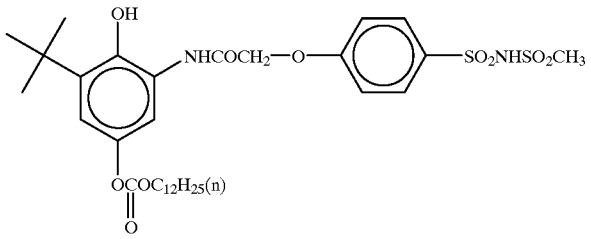
(35)
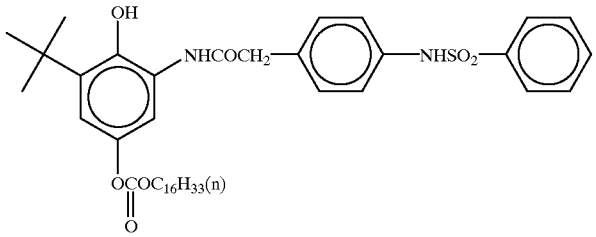
(36)
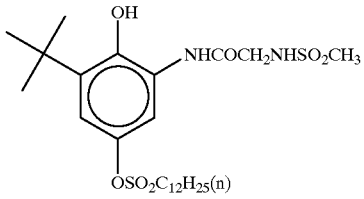
(37)
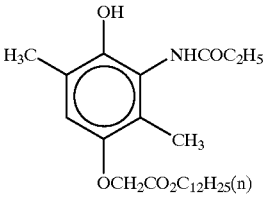
(38)
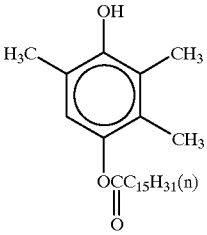

-continued
(39)
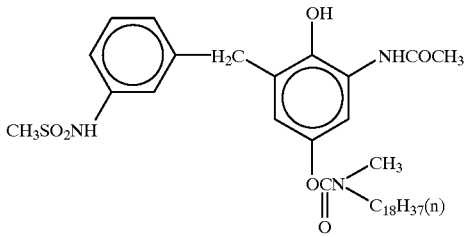
(40)
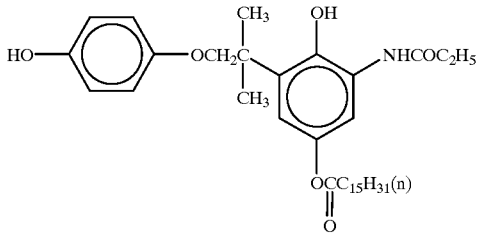
(41)
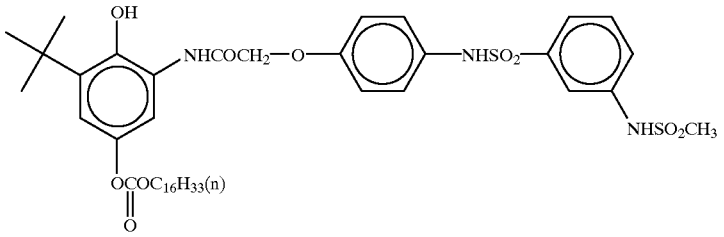
(42)
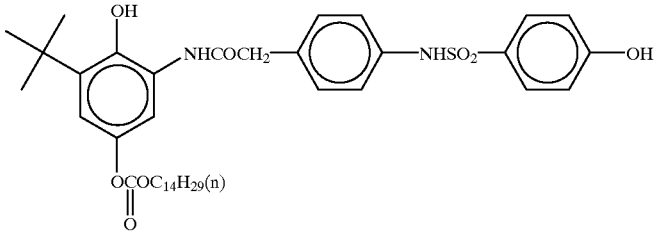
(43)
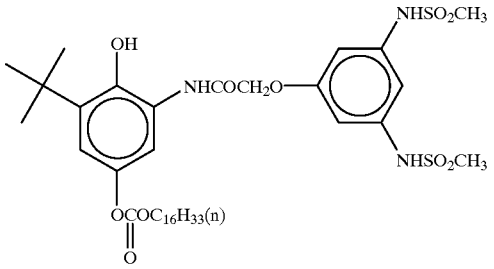
(44)
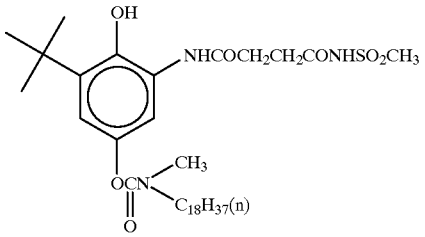

-continued
(45)
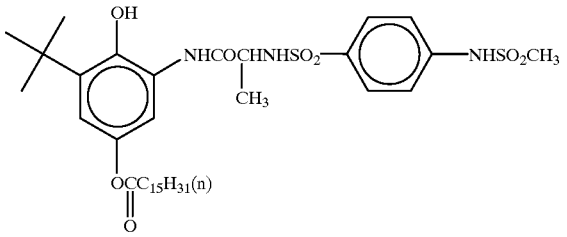
(46)
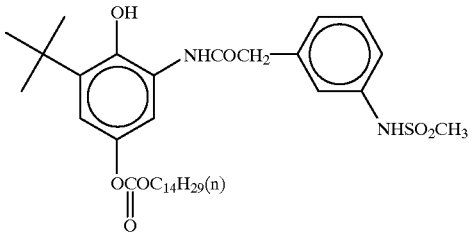
(47)
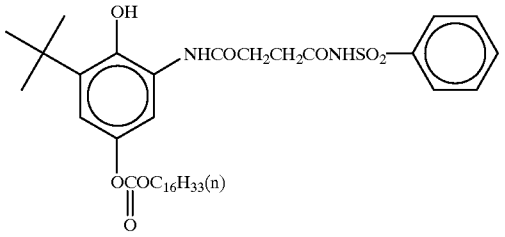
(48)
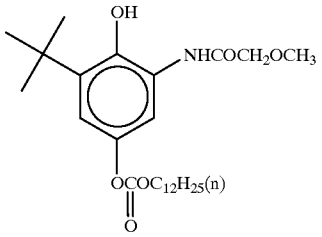
(49)
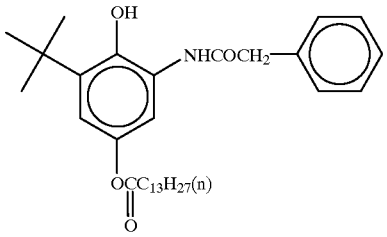
(50)
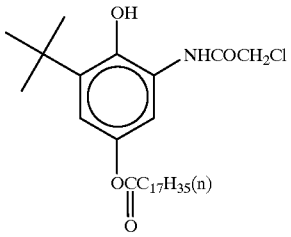
Next, typical synthesis examples of the compound represented by formula (III) for use in the present invention are described below.
Other compounds also can be synthesized in the same manner as in the following synthesis examples. Synthesis Example 1. Synthesis of Exemplified Compound (1)

Compound (1) was synthesized according to the following synthesis rout:

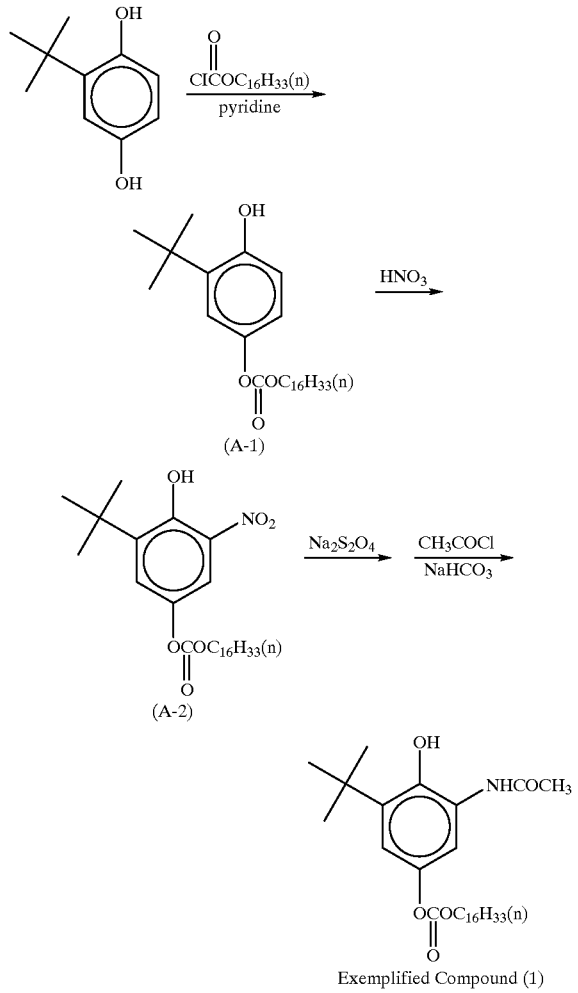

Synthesis of Compound (A-1)

66.5 g (0.40 mol) of t-butyl hydroquinone and 12.8 ml (0.16 mol) of pyridine was dissolved in 250 ml of acetonitrile, and then 24.4 g (0.080 mol) of hexadecyl chloroformate was dropwise added thereto at a room temperature. After stirring at the room temperature for 2 hours, 200 ml of water was added dropwise. Precipitated crystals were separated by filtration and washed with acetonitrile followed by drying to obtain 33.4 g (0.0768 mol) of Compound (A-1) as a white crystal. Yield; 96.0%

Synthesis of Compound (A-2)

32.6 g (75 mmol) of Compound (A-1) was dissolved in 150 ml of methylene chloride, and then 5 g of silica gel was added thereto. 5.9 ml (79 mmol) of conc. nitric acid (specific gravity 1.38) was added dropwise over 20 minutes while cooling on an ice bath. After stirring at 10° C. for 1 hour, silica gel was removed by filtration, and the resulting filtrate was washed with water. After drying with magnesium sulfate anhydride, a solvent was removed by distillation under a reduced pressure. The residue was allowed to crystallize from a mixture solvent of ethyl acetate and methanol. As a result, 27.1 g (56.5 mmol) of Compound (A-2) was obtained as a yellow crystal. Yield; 75.3%.

Synthesis of Exemplified Compound (1)

9.59 g (20 mmol) of Compound (A-2) was dissolved in 50 ml of methanol and 50 ml of ethyl acetate, and a solution of 10.4 g (60 mmol) of sodium hydrosulfite dissolved in 30 ml of water was added and then stirred at 60° C. for 30 minutes. To the resulting reaction mixture, 50 ml of ethyl acetate and 100 ml of water were added for extraction followed by separation. The resulting organic layer was washed in water. Thereto, 6.7 g of sodium bicarbonate and 50 ml of water were added, and then 3.2 g (40 mmol) of acetyl chloride was added dropwise at a room temperature over 20 minutes. After stirring for 30 minutes, the reaction mixture was separated, and the resulting organic layer was washed in a sodium bicarbonate aqueous solution and a saturated brine, followed by drying with magnesium sulfate anhydride. Thereafter, a solvent was removed from the organic layer by distillation under a reduced pressure. The residue was refined by means of a column chromatography using a mixture solvent of acetone/hexane (1/3) as an eluate, and then recrystallized from a mixture solvent of ethyl acetate and hexane to obtain 6.3 g (12.8 mmol) of Exemplified Compound (1) as a white crystal. Yield; 64.1%.

$^1$H-NMR(200 MHz, $CDCl_3$) 8.53(s, 1H), 7.66(s, 1H), 6.96(d, 1H), 6.65(d, 1H), 4.24(t, 2H), 2.18(s, 3H), 1.75(tt, 2H), 1.41(s, 9H), 1.45 to 1.20 (m, 26H), 0.88(t, 3H).

Synthesis Example 2. Synthesis of Exemplified Compound (12)

Exemplified Compound (12) was synthesized according to the following synthesis rout:

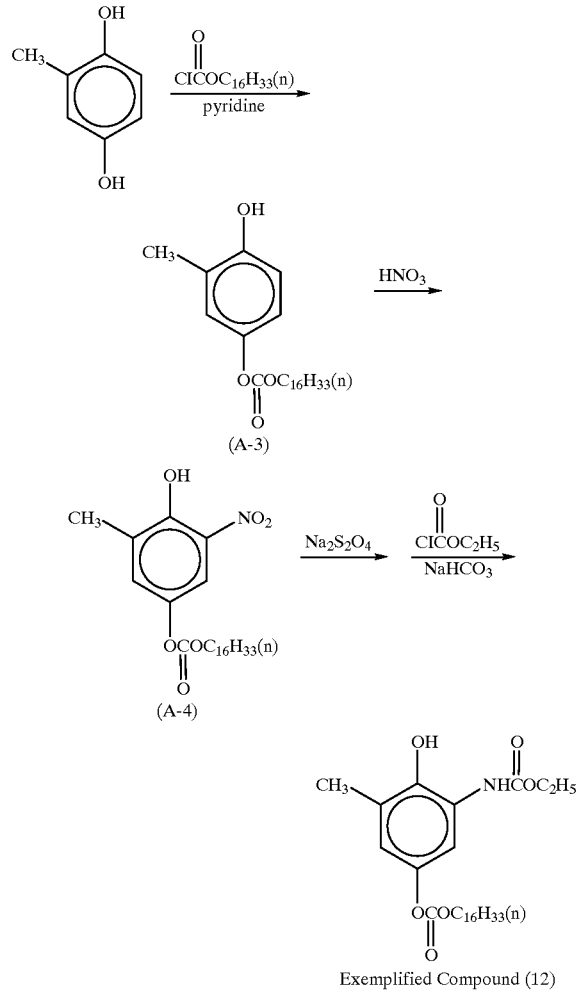

Synthesis of Compound (A-3)

74.5 g (0.60 mol) of methylhydroquinone and 19.4 ml (0.24 mol) of pyridine were dissolved in 300 ml of acetonitrile, and then 36.6 g (0.12 mol) of hexadecyl chloro formate was added dropwise at 5° C. over 30 minutes. After stirring at a room temperature for 1 hour, 500 ml of water was added dropwise. Precipitated crystals were separated by filtration and washed with water followed by drying. The crystals were refined by means of a column chromatography using a mixture solvent of ethyl acetate/hexane (1/6) as an eluate to obtain 15.5 g (0.039 mol) of Compound (A-3) as a white crystal. Yield; 32.9%

Synthesis of Compound (A-4)

5.50 g (14 mmol) of Compound (A-3) was dissolved in 50 ml of methylene chloride, and then 1 g of silica gel was added thereto. 1.2 ml (16 mmol) of conc. nitric acid (specific gravity 1.38) was added dropwise over 20 minutes while cooling on an ice bath. After stirring at 10° C. for 1 hour, silica gel was removed by filtration, and the resulting filtrate was washed with water. After drying with magnesium sulfate anhydride, a solvent was removed by distillation under a reduced pressure. The residue was allowed to crystallize from a mixture solvent of ethyl acetate and methanol. As a result, 4.92 g (11.2 mmol) of Compound (A-4) was obtained as a yellow crystal. Yield; 80.3%.

Synthesis of Exemplified Compound (12)

4.81 g (11 mmol) of Compound (A-4) was dissolved in 25 ml of ethyl acetate and 25 ml of methanol, and a solution of 5.7 g (33 mmol) of sodium hydrosulfite dissolved in 25 ml of water was added. After stirring at 50° C. for 1 hour, 5.7 g (33 mmol) of hydrosulfite was added and then further stirred at 50° C. for 1 hour. To the resulting reaction mixture, 25 ml of ethyl acetate and 50 ml of water were added for extraction followed by separation. The resulting organic layer was washed in water. Thereto, 1.9 g of sodium bicarbonate and 50 ml of water were added, and then 1.73 g (16 mmol) of ethyl chloroformate was added dropwise at a room temperature over 20 minutes. After stirring for 30 minutes, the reaction mixture was separated, and the resulting organic layer was washed in a sodium bicarbonate aqueous solution and a saturated brine, followed by drying with magnesium sulfate anhydride. Thereafter, a solvent was removed from the organic layer by distillation under a reduced pressure. The residue was refined by means of a column chromatography using a mixture solvent of ethyl acetate/hexane (1/4) as an eluate, and then recrystallized from hexane to obtain 2.50 g (5.2 mmol) of Exemplified Compound (12) as a white crystal. Yield; 47.4%.

$^1$H-NMR(200 MHz, $CDCl_3$) 7.20 to 7.05(m, 2H), 6.92(s, 1H), 6.69(d, 1H), 4.35 to 4.15(m, 4H), 2.20(s, 3H), 1.73(tt, 2H), 1.50 to 1.20(m, 29H), 0.88(s, 3H).

The coupler for use in the present invention is preferably used in the range of 0.01 to 10 mmol/m$^2$, per coloring layer, in order to obtain a sufficient color density. The use amount is more preferably in the range of 0.05 to 5 mmol/m$^2$, and especially preferably in the range of 0.1 to 1 mmol/m$^2$. The foregoing range is preferred in the point that a sufficient color density can be obtained.

The amount of the color developing compound to be used in the coloring layer containing the coupler for use in the present invention is preferably 0.05 to 20 times, more preferably 0.1 to 10 times and especially preferably 0.2 to 5 times, as much as the molar amount of the coupler contained in the coloring layer. The foregoing range is preferred in the point that a sufficient color density can be obtained.

The color light-sensitive material for use in the present invention basically has a support and coated thereon a photographic constitutional layer composed of at least one hydrophilic layer, wherein any layer(s) of said photographic constitutional layer contain(s) a light-sensitive silver halide, a dye-forming coupler and a color developing compound.

It is the most typical embodiment that a dye-forming coupler and the color developing compound are added to the same layer. However, if the coupler and a color developing compound are in the state that they can react with each other, they may be divided to add to separate layers. These ingredients are preferably added to a silver halide emulsion layer, or a layer adjacent thereto. It is especially preferred to add them to a silver halide emulsion layer.

The color developing compound and the dye-forming coupler for use in the present invention may be incorporated in a light-sensitive material according to various known dispersion methods. Preferred among these methods is an "oil in water" dispersion method wherein a compound is dissolved in a high boiling point organic solvent (a low boiling point organic solvent may be used in combination therewith as an occasion demands), and the resultant solution is emulsified and dispersed into an aqueous gelatin solution, and the thus-obtained emulsion dispersion is used for addition. Further, it is necessary that the reducing agent for use in the present invention that substantially does not cause a coupling reaction with a coupler, be dispersed in the foregoing high boiling point organic solvent.

As a high boiling point organic solvent, use can be made of a compound immiscible with water and having a melting point of 100° C. or less and a boiling point of 140° C. or higher, as long as the compound is a good solvent for a color developing compound, a dye-forming coupler, and/or a reducing agent that substantially does not cause a coupling reaction with a coupler. The melting point of the high boiling point organic solvent is preferably 80° C. or less. The boiling point of the high boiling point organic solvent is preferably 160° C. or greater, and more preferably 170° C. or greater. The details of these high boiling point organic solvents are described in JP-A-62-215272, page 137, right under column to page 144, right upper column.

As a high boiling point organic solvent that can be used in the present invention, high boiling point organic solvents exhibiting a high electron-donating property, as described in JP-A-8-320542, are preferred in the point that they can stabilize a dissociation type dye which are formed by a reaction between the foregoing color developing compound and dye-forming coupler. When these high boiling point organic solvents providing a high electron-donating property are used, a tertiary amine compound described in JP-A-11-102052 is preferably used in combination therewith.

On the other hand, when none of the foregoing high boiling point organic solvents exhibiting a high electron-donating property is used, it is also a preferable embodiment that a quaternary ammonium salt described in JP-A-11-84603 is incorporated.

In the present invention, when the color developing compound is incorporated in a light-sensitive material, an auxiliary developing agent and a precursor thereof are preferably used in the light-sensitive material. The compounds are explained below.

The auxiliary developing agent used in the present invention is a compound that has an action to accelerate electric transfer from the color-forming reducing agent to silver halides in the development step of silver halide particles. Preferably the auxiliary developing agent is a compound that can cause development of silver halide particles exposed to light, and the oxidization product of the compound can oxidize a color-developing compound (hereinafter referred to as cross oxidation).

As the auxiliary developing agent for use in the present invention, pyrazolidones, dihydroxybenzenes, reductones, or aminophenols can be used preferably, with pyrazolidones being used particularly preferably. Preferably that the diffusibility of these compounds in a hydrophilic colloidal layer is low, and, for example, the solubility to water (25° C.) is preferably 0.1% or below, more preferably 0.05% or below, and particularly preferably 0.01% or below.

The precursor of the auxiliary developing agent for use in the present invention is a compound that is present stably in the light-sensitive material, but it rapidly releases the auxiliary developing agent after it has been processed by a processing solution. Also in a case of using that compound, preferably the diffusibility in the hydrophilic colloidal layer is low. For example, the solubility to water (25° C.) is preferably 0.1% or below, more preferably 0.05% or below, and particularly preferably 0.01% or below. There is no particular restriction on the solubility of the auxiliary developing agent released from the precursor, but preferably the solubility of the auxiliary developing agent itself is low.

The auxiliary developing agent precursor for use in the present invention is preferably represented by formula (A).

$$A—(L)_n—PUG \qquad \text{formula (A)}$$

A represents a blocking group whose bond to $(L)_n$—PUG will be split off at the time of development step; L represents a linking group whose bond between L and PUG in the above formula (A) will be split off after the bond between A and L is split off; n is an integer of 0 to 3; and PUG represents a group to give an auxiliary developing agent.

As the auxiliary developing agent, an electron-releasing compound that follows the Kendall-Pelz rule, other than the compounds of p-phenylenediamines, can be used, and preferably the above pyrazolidones are used.

As the blocking group represented by A, the following already known groups can be used: blocking groups described, for example, in U.S. Pat. No. 3,311,476, such as an acyl group and a sulfonyl group; blocking groups that use the reverse Michael reaction, as described, for example, in JP-A-59-105642; blocking groups that use the formation of quinone methide, or a compound similar to quinone methide, by intramolecular electron transfer, as described, for example, in JP-A-2-280140; blocking groups that use intramolecular nucleophilic substitution reaction, as described, for example, in JP-A-63-318555 (EP-A-0295729); blocking groups that use the addition reaction of a nucleophilic reagent to a conjugated unsaturated bond, as described, for example, in JP-A-4-186344; blocking groups that use the β-elimination reaction, as described, for example, in JP-A-62-163051; blocking groups that use the nucleophilic substitution reaction of diarylmethanes, as described in JP-A-61-188540; blocking groups that uses the Lossen rearrangement reaction, as described in JP-A-62-187850; blocking groups that use the reaction between the N-acylated product of thiazolidin-2-thion and an amine, as described in JP-A-62-147457; and blocking groups that have two electrophilic groups to react with a di-nucleophilic agent, as described in WO-A-93/03419.

The group represented by L is a linking group that can be split off from the group represented by A, at the time of development step, and that then can split $(L)_{n-1}$—PUG. There is no particular restriction on the group of L, if the group has the above function.

Specific examples of the auxiliary developing agent or its precursor are shown below, but the compound that can be used in the present invention is not limited to them.

(ETA-1)

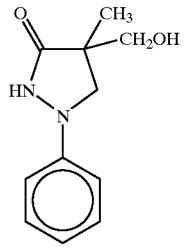

(ETA-2)

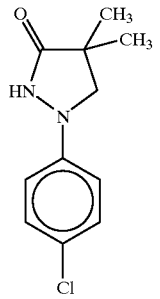

(ETA-3)

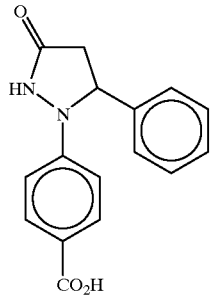

(ETA-4)

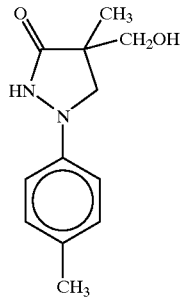

(ETA-5)

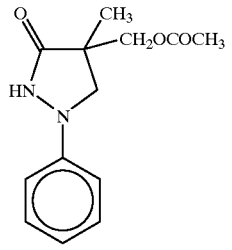

-continued
(ETA-6)
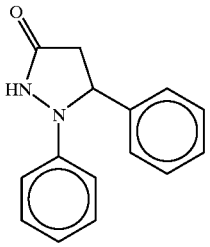
(ETA-7)
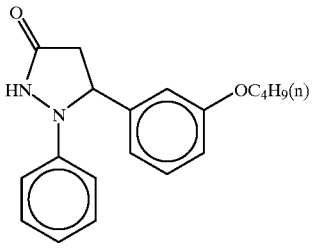
(ETA-8)
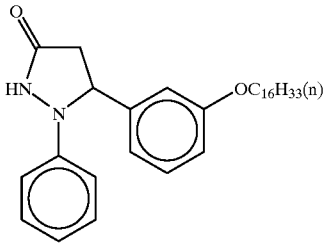
(ETA-9)
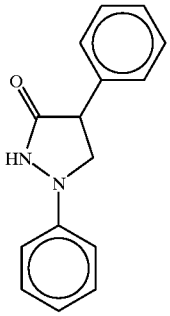
(ETA-10)
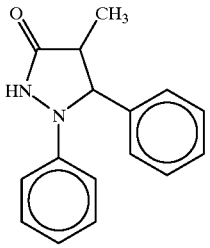
(ETA-11)
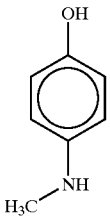
-continued
(ETA-12)
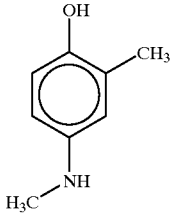
(ETA-13)
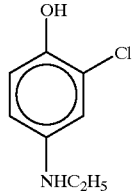
(ETA-14)
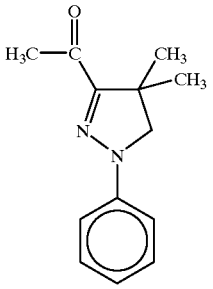
(ETA-15)
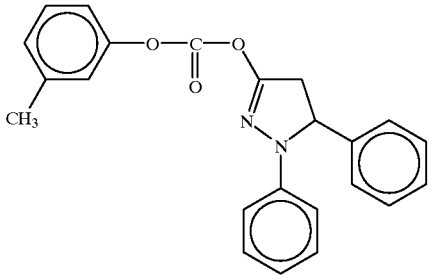
(ETA-16)
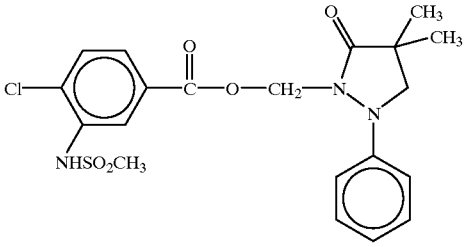
(ETA-17)
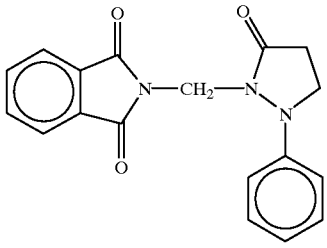

-continued (ETA-18)

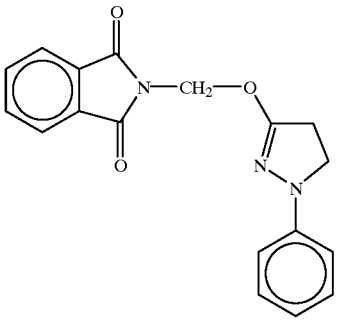

(ETA-19)

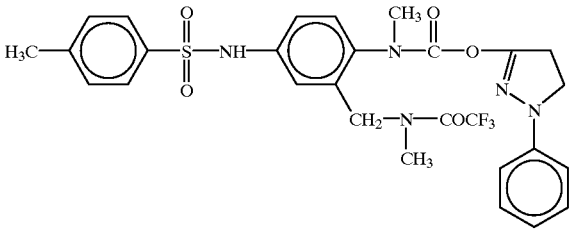

(ETA-20)

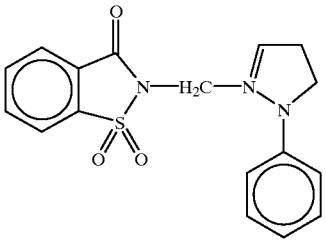

The above compound may be added to any of the light-sensitive layer, an intermediate layer, an undercoat layer, and a protective layer of a light-sensitive material, and preferably it is added to and used in a non-light-sensitive layer, when the auxiliary developing agent is contained in the light-sensitive material.

The methods of incorporating the compound into the light-sensitive material include, for example, a method of dissolving the compound in a water-miscible organic solvent, such as methanol, and directly adding this to a hydrophilic colloidal layer; a method of forming an aqueous solution or a colloidal dispersion of the compound, with a surface-active agent also contained, and adding the same; a method of dissolving the compound into a solvent or oil substantially immiscible with water, and then dispersing the solution into water or a hydrophilic colloid, and then adding the same; or a method of adding the compound, in a state of a dispersion of fine solid particles. The known methods may be applied singly or in combination. A method of preparing a dispersion of solid fine particles is described in detail on page 20 in JP-A-2-235044.

The amount of the compound to be added in a light sensitive material is generally 1 mol % to 200 mol %, preferably 5 mol % to 100 mol %, and more preferably 10 mol % to 50 mol %, to the color-forming reducing agent.

As the support (base) to be used in the present invention, any support can be used if it is a transmissible support or reflective support, on which a photographic emulsion layer can be coated, such as glass, paper, and plastic film. As the plastic film to be used in the present invention, for example, polyester films made, for example, of polyethylene terephthalates, polyethylene naphthalates, cellulose triacetate, or cellulose nitrate, polyamide films, polycarbonate films, and polystyrene films can be used.

"The reflective support" that can be used in the present invention refers to a support that increases the reflecting properties to make bright (sharp) the dye image formed in the silver halide emulsion layer. Such a reflective support includes a support coated with a hydrophobic resin containing a light-reflecting substance, such as titanium oxide, zinc oxide, calcium oxide, and calcium sulfate, dispersed therein, or a support made of a hydrophobic resin itself containing a dispersed light-reflecting substance. Examples are a polyethylene-coated paper, a polyester-coated paper, a polypropylene-series synthetic paper, a support having a reflective layer or using a reflecting substance, such as a glass sheet; a polyester film made, for example, of a polyethylene terephthalate, cellulose triacetate, or cellulose nitrate; a polyamide film, a polycarbonate film, a polystyrene film, and a vinyl chloride resin. As the polyester-coated paper, particularly a polyester-coated paper whose major component is a polyethylene terephthalate, as described in EP-0 507 489, is preferably used.

The reflective support to be used in the present invention is preferably a paper support, both surfaces of which are coated with a water-resistant resin layer, and at least one of the water-resistant resin layers contains fine particles of a white pigment. Preferably the particles of a white pigment are contained in a density of 12% by weight or more, and more preferably 14% by weight or more. Preferably the light-reflecting white pigment is kneaded well in the presence of a surface-active agent, and the surface of the pigment particles is preferably treated with a dihydric to tetrehydric alcohol.

In the present invention, a support having the second kind diffuse reflective surface can also be used, preferably. "The second kind diffuse reflectivity" means diffuse reflectivity obtained by making a specular surface uneven, to form finely divided specular surfaces facing different directions. The unevenness of the second kind diffuse reflective surface has a three-dimensional average coarseness of generally 0.1 to 2 $\mu$m, and preferably 0.1 to 1.2 $\mu$m, for the center surface. Details about such a support are described in JP-A-2-239244.

In order to obtain colors ranging widely on the chromaticity diagram by using three primary colors: yellow, magenta, and cyan, use is made of a combination of at least three silver halide emulsion layers photosensitive to respectively different spectral regions. For examples, a combination of three layers of a blue-sensitive layer, a green-sensitive layer, and a red-sensitive layer, and a combination of three layers of a green-sensitive layer, a red-sensitive layer, and an infrared-sensitive layer, and the like can be coated on the above support. The photosensitive layers can be arranged in various orders known generally for color light-sensitive materials. Further, each of these light-sensitive layers can be divided into two or more layers if necessary.

In the light-sensitive material, photographic constitutional layers comprising the above photosensitive layers and various non-photosensitive layers, such as a protective layer, an underlayer, an intermediate layer, an antihalation layer, and a backing layer, can be provided. Further, in order to improve the color separation, various filter dyes can be added to the photographic constitutional layer.

As a binder or a protective colloid that can be used in the light-sensitive material according to the present invention, a gelatin can advantageously be used, and other hydrophilic colloids can be used alone or in combination with a gelatin. The calcium content of gelatin is preferably 800 ppm or less, and more preferably 200 ppm or less. The iron content of gelatin is preferably 5 ppm or less, and more preferably 3 ppm or less. Further, in order to prevent the proliferation of various molds and bacteria that will proliferate in a hydrophilic colloid layer to deteriorate an image, preferably mildew-proofing agents, as described in JP-A-63-271247, are added.

The total amount of gelatin of the light-sensitive material for use in the present invention is generally 1.0 to 30 g, and preferably 2.0 to 20 g, per $m^2$. In the swelling of the light-sensitive material in an alkali solution having a pH of 12, the time for the swelled film thickness to reach ½ of its saturated swelled film thickness (90% of the maximum swelled thickness) is preferably 15 sec or less, and more preferably 10 sec or less. Further, the swelling rate [(maximum swelled film thickness−film thickness)/film thickness×100] is preferably 50 to 300%, and particularly preferably 100 to 200%.

When the light-sensitive material for use in the present invention is subjected to printer exposure, it is preferable to use a band stop filter described in U.S. Pat. No. 4,880,726, by which light-color-mixing can be removed, to noticeably improve color reproduction.

The light-sensitive material for use in the present invention can be used in a usual printing system, in which a negative printer is used, and it can also be suitable for a scanning exposure system, in which a cathode ray (CRT) is used.

In comparison with apparatuses using lasers, cathode ray tube exposure apparatuses are simple and compact and make the cost low. Further, the adjustment of optical axes and colors is easy.

For the cathode ray tubes used for image exposure, use is made of various emitters that emit light in spectral regions as required. For example, any one of, or a mixture of two or more of, a red-color emitter, a green-color emitter, and a blue-color emitter may be used. The spectral region is not limited to the above red, green, and blue, and a phosphor that emits a color in the yellow, orange, purple, or infrared region may also be used. In particular, a cathode ray tube that emits white light by mixing these emitters can often be used.

When the light-sensitive material has plural light-sensitive layers different in spectral sensitivity distributions, and the cathode ray tube has phosphors that show light emission in plural spectral regions, plural colors may be exposed at a time; namely, image signals of plural colors are inputted into the cathode ray tube, to emit lights from the tube surface. A method in which exposure is made in such a manner that image signals for respective colors are inputted successively, to emit the respective colors successively, and they are passed through filters (films) for cutting out other colors (surface-successive exposure), may be employed, and generally the surface-successive exposure is preferred to make image quality high, since a high-resolution cathode ray tube can be used.

The light-sensitive material for use in the present invention is preferably used for digital scanning exposure system that uses monochromatic high-density light, such as a second harmonic generating light source (SHG) that comprises a combination of a nonlinear optical crystal with a semiconductor laser or a solid state laser using a semiconductor laser as an excitation light source, a gas laser, a light-emitting diode, or a semiconductor laser. To make the system compact and inexpensive, it is preferable to use a semiconductor laser or a second harmonic generating light source (SHG) that comprises a combination of a nonlinear optical crystal with a semiconductor laser or a solid state laser. Particularly, to design an apparatus that is compact, inexpensive, long in life, and high in stability, the use of a semiconductor laser is preferable, and desired is the use of a semiconductor laser in at least one exposure light source.

If such a scanning exposure light source is used, the spectral sensitivity maximum of the light-sensitive material for use in the present invention can arbitrarily be set by the wavelength of the light source for the scanning exposure to be used. In an SHG light source obtained by combining a nonlinear optical crystal with a semiconductor laser or a solid state laser that uses a semiconductor laser as an excitation light source, since the emitting wavelength of the laser can be halved, blue light and green light can be obtained. Therefore, the spectral sensitivity maximum of the light-sensitive material can be present in each of the usual three regions, the blue region, the green region and the red region. In order to use a semiconductor laser as a light source to make the apparatus inexpensive, high in stability, and compact, preferably each of at least two layers has a spectral sensitivity maximum at 670 nm or over. This is because the emitting wavelength range of the available, inexpensive, and stable III-V group semiconductor laser is present now only in from the red region to the infrared region. However, on the laboratory level, the oscillation of a II-VI group semiconductor laser in the green or blue region is confirmed and it is highly expected that these semiconductor lasers can be used inexpensively and stably if production technique for the semiconductor lasers be developed. In that event, the necessity that each of at least two layers has a spectral sensitivity maximum at 670 nm or over becomes lower.

In such scanning exposure, the time for which the silver halide in the light-sensitive material is exposed to light is the time for which a certain very small area is required to be exposed to light. As the very small area, the minimum unit that controls the quantity of light from each digital data is generally used and is called a picture element. Therefore, the exposure time per picture element is changed depending on the size of the picture element. The size of the picture element is dependent on the density of the picture element, and the actual range is generally from 50 to 2,000 dpi. If the exposure time is defined as the time for which a picture element size is exposed to light with the density of the picture element being 400 dpi, preferably the exposure time is $10^{-4}$ sec or less, more preferably $10^{-6}$ sec or less. The lower limit of the exposure time is not particularly limited, but it is preferably $10^{-8}$ sec or more.

To the photographic material for use in the present invention, may be added the above-mentioned various additives, and also other various additives in accordance with the purpose.

These additives are described in more detail in Research Disclosure, Item 17643 (December 1978); Research Disclosure, Item 18176 (November 1979); and Research Disclosure, Item 307105 (November 1989), and the particular parts are given below in a table.

| Additives | RD 17643 | RD 18716 | RD 307105 |
|---|---|---|---|
| 1 Chemical sensitizers | p. 23 | p. 648 (right column) | p. 996 |
| 2 Sensitivity-enhancing agents | — | p. 648 (right column) | — |

-continued

| Additives | RD 17643 | RD 18716 | RD 307105 |
|---|---|---|---|
| 3 Spectral sensitizers and Supersensitizers | pp. 23–24 | pp. 648 (right column)–649 (right column) | pp. 996 (right column)–998 (right column) |
| 4 Brightening agents | p. 24 | — | p. 998 (right column) |
| 5 Antifogging agents and Stabilizers | pp. 24–25 | p. 649 (right column) | pp. 998 (right column)–1000 (right column) |
| 6 Light absorbers, Filter dyes, and UV Absorbers | pp. 25–26 | pp. 649 (right column)–650 (left column) | p. 1003 (left to right column) |
| 7 Stain-preventing agents | p. 25 (right column) | p. 650 (left to right column) | — |
| 8 Image dye stabilizers | p. 25 | — | — |
| 9 Hardeners | p. 26 | p. 651 (left column) | pp. 1004 (right column)–1005 (left column) |
| 10 Binders | p. 26 | p. 651 (left column) | pp. 1003 (right column)–1004 (right column) |
| 11 Plasticizers and Lubricants | p. 27 | p. 650 (right column) | p. 1006 (left to right column) |
| 12 Coating aids and Surfactants | pp. 26–27 | p. 650 (right column) | pp. 1005 (left column)–1006 (left column) |
| 13 Antistatic agents | p. 27 | p. 650 (right column) | pp. 1006 (right column)–1007 (left column) |

In the present invention, a processing solution is coated on the surface of a light-sensitive material by means of a coating apparatus as described above. Accordingly, the light-sensitive material must be easily wet with a processing solution. In the present invention, for improvement in the wetness on the surface of a light-sensitive material, it is preferred to coat a surface active agent on the layer furthest from a support among hydrophilic colloid layers of the light-sensitive material. Preferred surface active agents are a betaine-series surface active agent, a fluorine-containing surface active agent, and the like. Further, it is also preferred to incorporate a hydrophilic polymer in the layer furthest from a support among hydrophilic colloid layers of the light-sensitive material on the ground that the wetness is improved by easily letting a processing solution permeate through the light-sensitive material. As a hydrophilic polymer, an acrylic acid-series polymer, polyvinyl alcohol, a copolymer of acrylic acid and vinyl alcohol, and the like are preferred.

According to the color image-forming method of the present invention, both a highly enhanced convenience of the processing and a simplicity and miniaturization of the processing apparatus can be realized by using a silver halide color photographic light-sensitive material that is excellent in color property, storage stability, dye image fastness and hue, and moreover by omitting both the washing and desilvering steps. Further, a color image formation that is able to lessen a stain occurring after processing a light-sensitive material can be also performed thereby.

The present invention will now be described in more detail with reference to the following examples, but the present invention is not limited thereto.

EXAMPLES

Example 1

A paper base both surfaces of which had been laminated with polyethylene, was subjected to surface corona discharge treatment; then it was provided with a gelatin undercoat layer containing sodium dodecylbenzensulfonate, and it was coated with various photographic constitutional layers, to prepare a multi-layer photographic color printing paper (100) having the layer constitution shown below.

Preparation of Fifth Layer Coating Solution 50 g of a cyan coupler (ExC-1), 180 g of a cyan coupler (ExC-2), 24 g of a cyan coupler (ExC-3), 230 g of a color-image stabilizer (Cpd-1), 10 g of a color-image stabilizer (Cpd-9), 10 g of a color-image stabilizer (Cpd-12), 10 g of a color-image stabilizer (Cpd-13), 40 g of an ultraviolet absorbing agent (UV-1), 10 g of an ultraviolet absorbing agent (UV-3) and 10 g of an ultraviolet absorbing agent (UV-4) were dissolved in 230 g of a solvent (Solv-6) and 350 ml of ethyl acetate, and the resulting solution was emulsified and dispersed in 6500 g of a 10% aqueous gelatin solution containing 200 ml of 10% sodium dodecylbenzene sulfonate, to prepare an emulsified dispersion C.

On the other hand, a silver chlorobromide emulsion C (cubes; a mixture of a large-size emulsion $C_1$ having an average particle size of 0.1 $\mu$m, and a small-size emulsion $C_2$ having an average particle size of 0.08 $\mu$m (1:4 in terms of mol of silver), the deviation coefficients of the particle size distributions being 0.09 and 0.11, respectively, and each emulsion having 0.8 mol % of silver bromide locally contained in part of the particle surface whose substrate was made up of silver chloride) was prepared. To the large-size emulsion $C_1$ of this emulsion, had been added $6.0\times10^{-5}$ mol, per mol of silver, of each of red-sensitive sensitizing dyes G and H shown below, and to the small-size emulsion $C_2$ of this emulsion, had been added $9.0\times10^{-5}$ mol, per mol of silver, of each of red-sensitive sensitizing dyes G and H shown below. The chemical ripening of this emulsion was carried out optimally with a sulfur sensitizer and a gold sensitizer being added.

The above emulsified dispersion C and this silver chlorobromide emulsion C were mixed and dissolved, and a fifth-layer coating solution was prepared so that it would have the composition shown below. The coating amount of the emulsion is in terms of silver.

The coating solutions for the first layer to the fourth layer and for the sixth layer to the seventh layer were prepared in the similar manner as that for the fifth-layer coating solution. As the gelatin hardener for each layer, 1-oxy-3,5-dichloro-s-triazine sodium salt was used. Further, to each layer, were added Ab-1, Ab-2, Ab-3, and Ab-4, so that the total amounts would be 15.0 mg/m$^2$, 60.0 mg/m$^2$, 5.0 mg/m$^2$, and 10.0 mg/m$^2$, respectively.

(Ab-1)

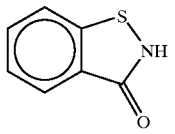

Antistatic agent (Ab-2)

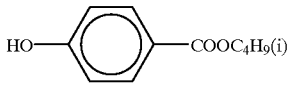

Antistatic agent

-continued (Ab-3)

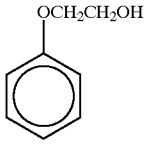

Antistatic agent (Ab-4)

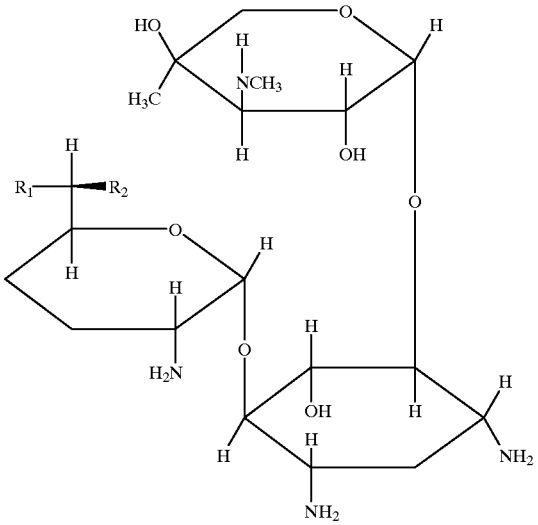

Antistatic agent

A mixture in 1:1:1:1(molar ratio) of a,b,c and d

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

For the silver chlorobromide emulsion of the respective photosensitive emulsion layer, the following spectral sensitizing dyes were used. Blue-Sensitive Emulsion Layer (Sensitizing dye A)

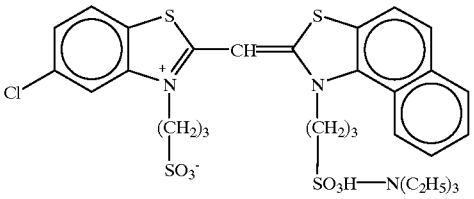

(Sensitizing dye B)

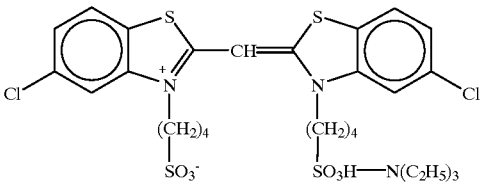

-continued (Sensitizing dye C)

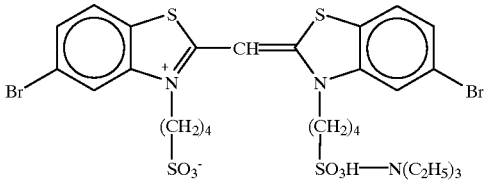

(The sensitizing dyes A, B, and C were added to the large-size emulsion in an amount of $1.4\times10^{-4}$ mol, per mol of silver halide, and to the small-size emulsion in an amount of $1.7\times10^{-4}$ mol, per mol of silver halide.)

Green-Sensitive Emulsion Layer (Sensitizing dye D)

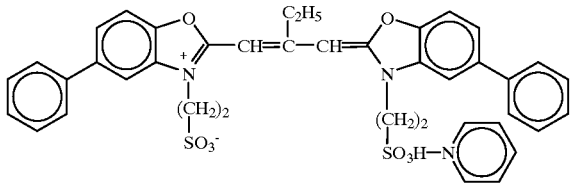

(Sensitizing dye E)

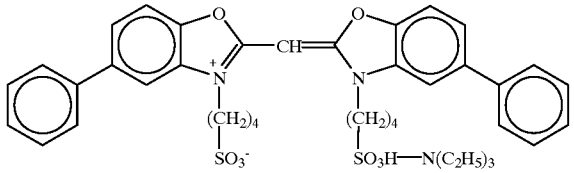

(Sensitizing dye F)

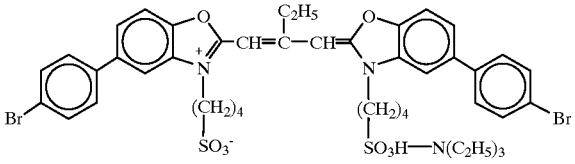

(The sensitizing dye D was added to the large-size emulsion in an amount of $3.0\times10^{-4}$ mol per mol of the silver halide, and to the small-size emulsion in an amount of $3.6\times10^{-4}$ mol per mol of the silver halide; the sensitizing dye E was added to the large-size emulsion in, an amount of $4.0\times10^{-5}$ mol per mol of the silver halide, and to the small-size emulsion in an amount of $7.0\times10^{-5}$ mol per mol of the silver halide; and the sensitizing dye F was added to the large-size emulsion in an amount of $2.0\times10^{-5}$ mol per mol of the silver halide, and to the small-size emulsion in an amount of $2.8\times10^{-4}$ mol per mol of the silver halide.)

Red-Sensitive Emulsion Layer (Sensitizing dye G)

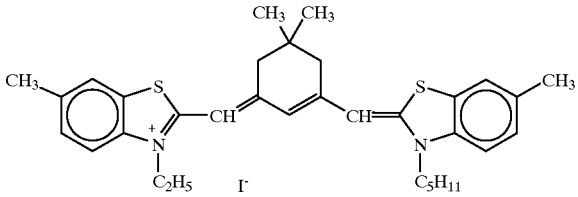

(Sensitizing dye H)

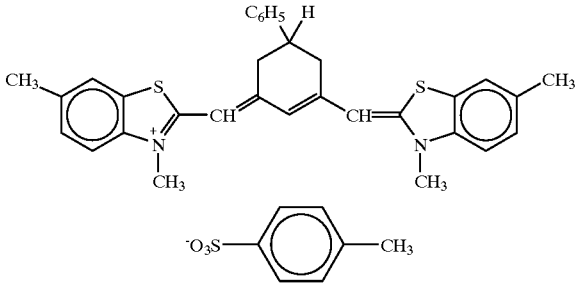

(The sensitizing dyes G and H were added to the large-size emulsion in an amount of $6.0\times10^{-5}$ mol per mol of the silver halide, and to the small-size emulsion in an amount of $9.0\times10^{-5}$ per mol of the silver halide.)

Further, the following Compound I was added to the red-sensitive emulsion layer in an amount of $2.6\times10^{-3}$ mol per mol of the silver halide.

(Compound I)

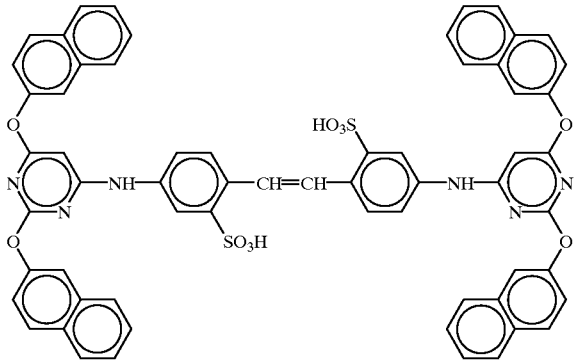

To the blue-sensitive emulsion layer, the green-sensitive emulsion layer, and the red-sensitive emulsion layer, was added 1-(3-methylureidophenyl)-5-mercaptotetrazole in amounts of $3.3\times10^{-4}$ mol, $1.0\times10^{-3}$ mol, and $5.9\times10^{-4}$ mol, respectively, per mol of the silver halide.

Further, to the second layer, the forth layer, the sixth layer, and the seventh layer, was added 1-(3-methylureidophenyl)-5-mercaptotetrazole in amounts of 0.2 mg/m$^2$, 0.2 mg/m$^2$, 0.6 mg/m$^2$, and 0.1 mg/m$^2$, respectively.

Further, to the blue-sensitive emulsion layer and the green-sensitive emulsion layer, were added 4-hydroxy-6-methyl-1,3,3a,7-tetrazaindene in amounts of $1\times10^{-4}$ mol and $2\times10^{-4}$ mol, respectively, per mol of the silver halide.

To the red-sensitive emulsion layer, was added a copolymer of methacrylic acid and butyl acrylate (1:1 in weight ratio; average molecular weight, 200,000 to 400,000) in an amount of 0.05 g/m$^2$.

Further, to the second layer, the fourth layer, and the sixth layer, was added disodium catechol-3,5-disulfonate in amounts of 6 mg/m$^2$, 6 mg/m$^2$, and 18 mg/m$^2$, respectively.

(Layer Constitution)

The composition of each layer is shown below. The numbers show coating amounts (g/m$^2$). In the case of the silver halide emulsion, the coating amount is in terms of silver. Base Polyethylene-Laminated Paper [the polyethylene on the first layer side contained a fluorescent whitening agent, a white pigment ($TiO_2$, 15 wt %) and a blue dye (ultramarine)] was used as the above base. First Layer (Blue-Sensitive Emulsion Layer)

A silver chlorobromide emulsion A: cubes, a mixture of a large-size emulsion $A_1$ having an average particle size of 0.15 $\mu$m, and a small-size emulsion $A_2$ having an average particle size of 0.15 $\mu$m (3:7 in terms of mol of silver). The deviation coefficients of the particle size distributions were 0.08 and 0.10, respectively, and each emulsion had 0.3 mol % of AgBr contained locally in part of the particle surface whose substrate was made up of silver chloride.

| | |
|---|---|
| | 0.025 |
| Gelatin | 1.35 |
| Yellow coupler (ExY-1) | 0.41 |
| Yellow coupler (ExY-2) | 0.21 |
| Color-image stabilizer (Cpd-1) | 0.08 |
| Color-image stabilizer (Cpd-2) | 0.04 |
| Color-image stabilizer (Cpd-3) | 0.08 |
| Color-image stabilizer (Cpd-8) | 0.04 |
| Solvent (Solv-1) | 0.23 |
| Second Layer (Color-Mixing Inhibiting Layer) | |
| Gelatin | 1.00 |
| Color-mixing inhibitor (Cpd-4) | 0.05 |
| Color-mixing inhibitor (Cpd-5) | 0.07 |
| Color-image stabilizer (Cpd-6) | 0.007 |
| Color-image stabilizer (Cpd-7) | 0.14 |
| Color-image stabilizer (Cpd-13) | 0.006 |
| Solvent (Solv-1) | 0.06 |
| Solvent (Solv-2) | 0.22 |
| Third Layer (Green-Sensitive Emulsion Layer) | |

A silver chlorobromide emulsion B: cubes, a mixture of a large-size emulsion $B_1$ having an average particle size of 0.10 $\mu$m, and a small-size emulsion $B_2$ having an average particle size of 0.08 $\mu$m (1:3 in terms of mol of silver) The deviation coefficients of the particle size distributions were 0.10 and 0.08, respectively, and each emulsion had 0.4 mol % of AgBr contained locally in part of the particle surface whose substrate was made up of silver chloride.

| | |
|---|---|
| | 0.012 |
| Gelatin | 1.20 |
| Magenta coupler (ExM-1) | 0.10 |
| Magenta coupler (ExM-2) | 0.05 |
| Ultraviolet absorbing agent (UV-1) | 0.05 |
| Ultraviolet absorbing agent (UV-2) | 0.02 |
| Ultraviolet absorbing agent (UV-3) | 0.02 |
| Ultraviolet absorbing agent (UV-4) | 0.03 |
| Color-image stabilizer (Cpd-2) | 0.01 |
| Color-image stabilizer (Cpd-4) | 0.002 |
| Color-image stabilizer (Cpd-7) | 0.08 |
| Color-image stabilizer (Cpd-8) | 0.01 |
| Color-image stabilizer (Cpd-9) | 0.03 |
| Color-image stabilizer (Cpd-10) | 0.01 |
| Color-image stabilizer (Cpd-11) | 0.0001 |
| Color-image stabilizer (Cpd-13) | 0.004 |
| Solvent (Solv-3) | 0.10 |

-continued

| | |
|---|---|
| Solvent (Solv-4) | 0.19 |
| Solvent (Solv-5) | 0.17 |
| Fourth Layer (Color-Mixing Inhibiting Layer) | |
| Gelatin | 0.71 |
| Color-mixing inhibitor (Cpd-4) | 0.04 |
| Color-mixing inhibitor (Cpd-5) | 0.05 |
| Color-image stabilizer (Cpd-6) | 0.005 |
| Color-image stabilizer (Cpd-7) | 0.10 |
| Color-image stabilizer (Cpd-13) | 0.004 |
| Solvent (Solv-1) | 0.04 |
| Solvent (Solv-2) | 0.16 |
| Fifth Layer (Red-Sensitive Emulsion Layer) | |

A silver chlorobromide emulsion C: cubes, a mixture of a large-size emulsion $C_1$ having an average particle size of 0.10 $\mu$m, and a small-size emulsion $C_2$ having an average particle size of 0.08 $\mu$m (1:4 in terms of mol of silver). The deviation coefficients of the particle size distributions were 0.09 and 0.11, respectively, and each emulsion had 0.8 mol % of AgBr locally contained in part of the particle surface whose substrate was made up of silver chloride.

| | |
|---|---|
| | 0.017 |
| Gelatin | 1.00 |
| Cyan coupler (ExC-1) | 0.05 |

-continued

| | |
|---|---|
| Cyan coupler (ExC-2) | 0.18 |
| Cyan coupler (ExC-3) | 0.024 |
| Ultraviolet absorbing agent (UV-1) | 0.04 |
| Ultraviolet absorbing agent (UV-3) | 0.01 |
| Ultraviolet absorbing agent (UV-4) | 0.01 |
| Color-image stabilizer (Cpd-1) | 0.23 |
| Color-image stabilizer (Cpd-9) | 0.01 |
| Color-image stabilizer (Cpd-12) | 0.01 |
| Color-image stabilizer (Cpd-13) | 0.01 |
| Solvent (Solv-6) | 0.23 |
| Sixth Layer (Ultraviolet Absorbing Layer) | |
| Gelatin | 0.46 |
| Ultraviolet absorbing agent (UV-1) | 0.14 |
| Ultraviolet absorbing agent (UV-2) | 0.05 |
| Ultraviolet absorbing agent (UV-3) | 0.05 |
| Ultraviolet absorbing agent (UV-4) | 0.04 |
| Ultraviolet absorbing agent (UV-5) | 0.03 |
| Ultraviolet absorbing agent (UV-6) | 0.04 |
| Solvent (Solv-7) | 0.18 |
| Seventh Layer (Protective Layer) | |
| Gelatin | 1.00 |
| Acryl-modified copolymer of polyvinyl alcohol (modification degree: 17%) | 0.04 |
| Liquid paraffin | 0.02 |
| Surface-active agent (Cpd-14) | 0.01 |
| Surface-active agent (Cpd-15) | 0.01 |

(ExY-1)

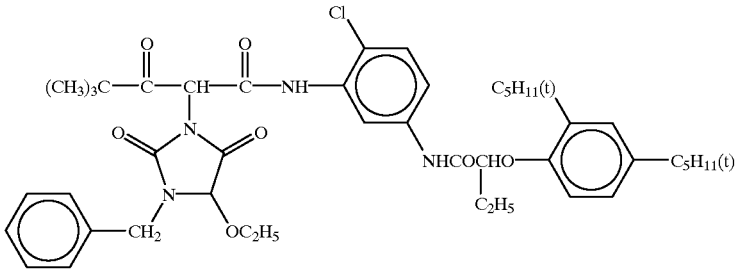

Yellow coupler (ExY-2)

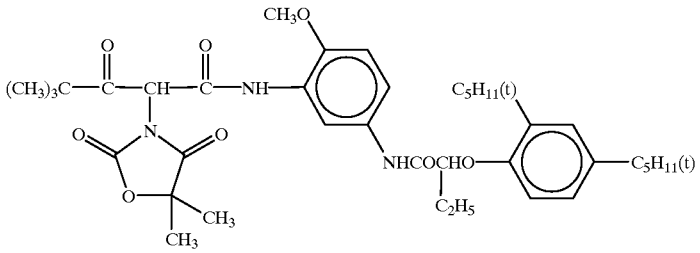

Yellow coupler

-continued
(ExM-1)
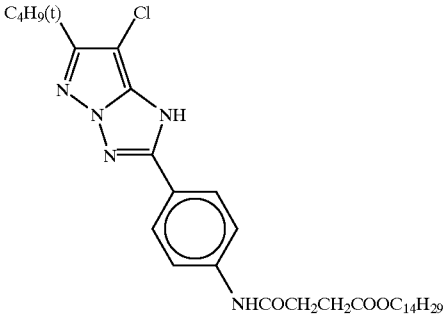
Magenta coupler
(ExM-2)
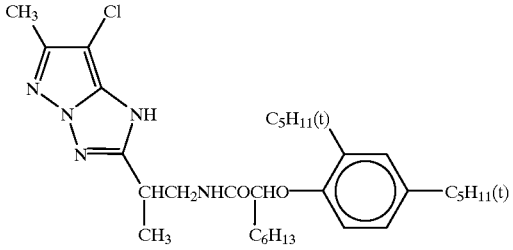
Magenta coupler
(ExC-1)
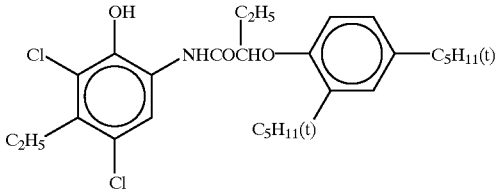
Cyan coupler
(ExC-2)
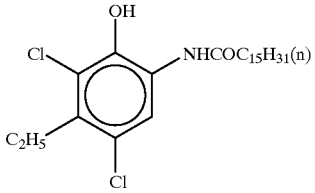
Cyan coupler
(ExC-3)
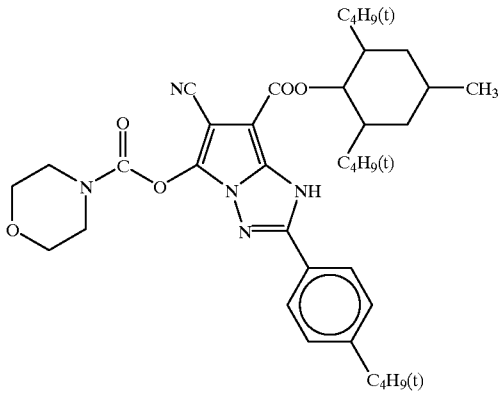
Cyan coupler
(Cpd-1)
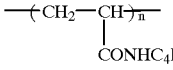
number-average molecular weight 60,000
Color-image stabilizer
(Cpd-2)
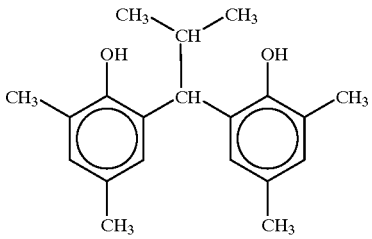
Color-image stabilizer -continued
(Cpd-3)
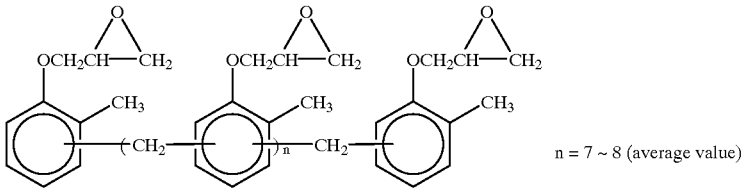
n = 7 ~ 8 (average value)
Color-image stabilizer
(Cpd-4)
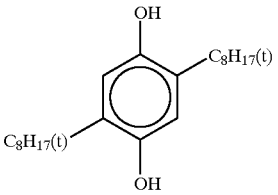
Color-mixing inhibitor
(Cpd-5)
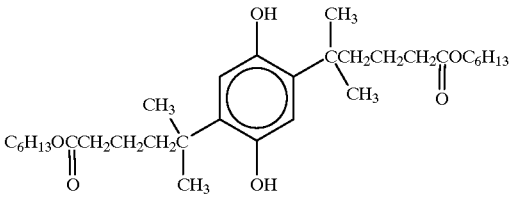
Color-mixing inhibitor
(Cpd-6)
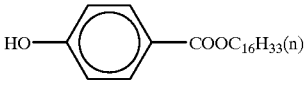
Auxiliary agent of color-mixing prevention
(Cpd-7)
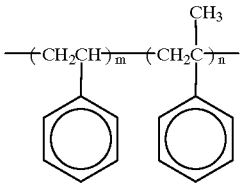
Number-average molecular weight 600
m/n = 10/90
Stabilizer
(Cpd-8)
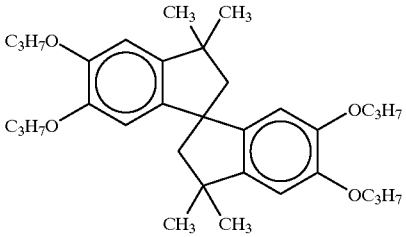
Color-image stabilizer
(Cpd-9)
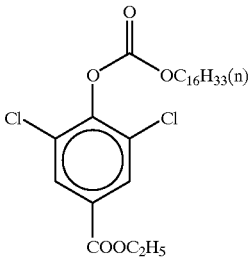
Color-image stabilizer
(Cpd-10)
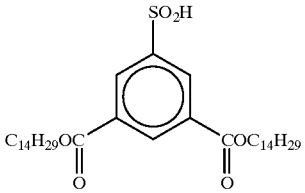
Color-image stabilizer -continued
(Cpd-11)
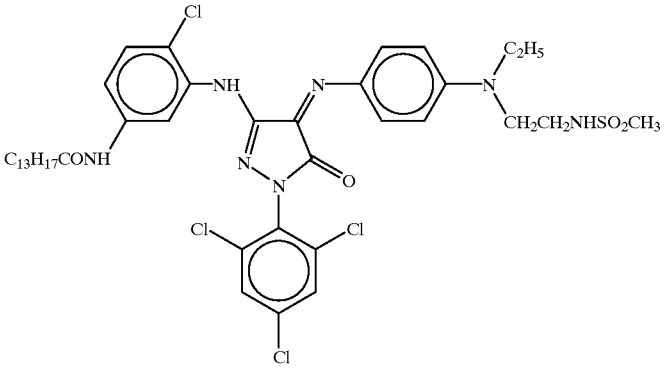
(Cpd-12)
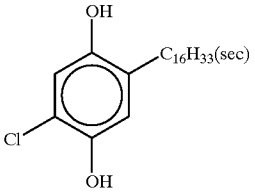
Color-image stabilizer
(Cpd-13)
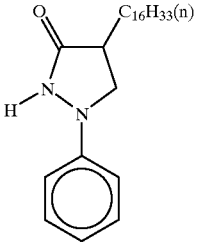
Color-image stabilizer
(Cpd-14)
A mixture in 7:3 (weight ratio) of
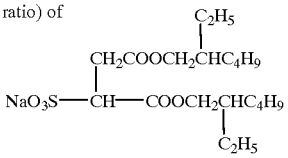
and
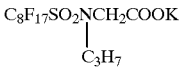
Surfactant
(Cpd-15)
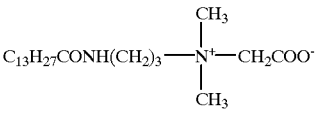
Surfactant
(UV-1)
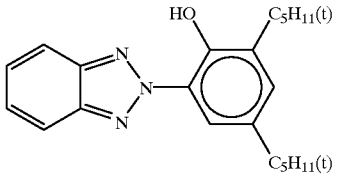
Ultraviolet absorbing agent
(UV-2)
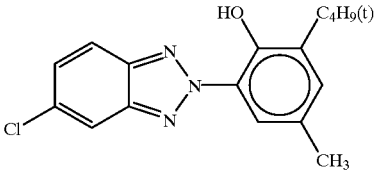
Ultraviolet absorbing agent
(UV-3)
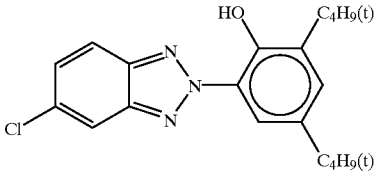
Ultraviolet absorbing agent -continued (UV-4)

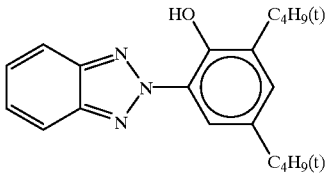

Ultraviolet absorbing agent (UV-5)

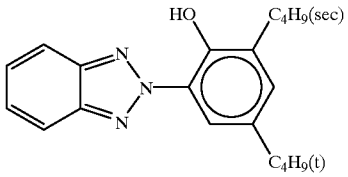

Ultraviolet absorbing agent (UV-6)

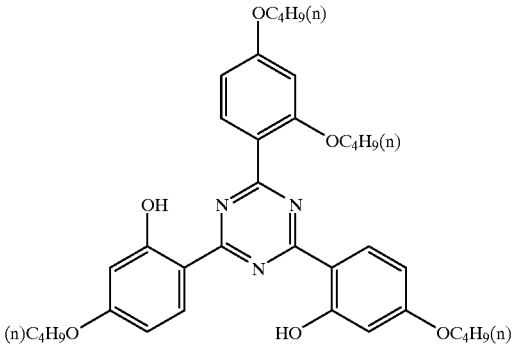

Ultraviolet absorbing agent (Solv-1)

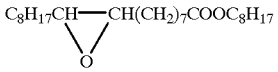

(Solv-2)

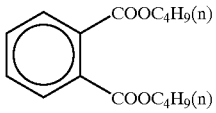

(Solv-3)

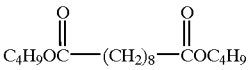

(Solv-4)

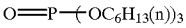

(Solv-5)

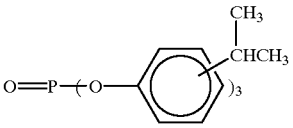

(Solv-6)

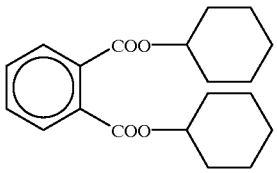

(Solv-7)

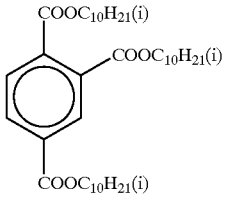

(Solv-8)

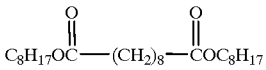

(Solv-9)

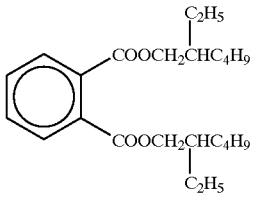

(Processing Step)

Processing A

The light-sensitive material was processed using the processor illustrated in FIG. 4 in the way described below.

| Processing step | Temperature | Time | Replenisher amount | Tank Volume |
|---|---|---|---|---|
| Color development intensification | 38° C. | 45 sec | — | 5 liter |

-continued

| Processing step | Temperature | Time | Replenisher amount | Tank Volume |
|---|---|---|---|---|
| Fixing | 35° C. | 45 sec | 30 ml | 5 liter |
| Rinse ① | 35° C. | 20 sec | — | 2 liter |
| Rinse ② | 35° C. | 20 sec | — | 2 liter |
| Rinse ③ | 35° C. | 20 sec | — | 2 liter |
| Rinse ④ | 35° C. | 30 sec | 90 ml | 3 liter |
| Drying | 70° C.–80° C. | 60 sec | | |

※ Replenisher amount represents that of per $m^2$ of the light-sensitive material. (The rinse was performed by a counter-current piping system of three tanks from tank ③ to tank ①)

Processing B

The light-sensitive material was processed using the processor illustrated in FIG. 5 in the way described below.

| Processing step | Temperature | Time | Replenisher amount | Tank Volume |
|---|---|---|---|---|
| Color development intensification | 38° C. | 45 sec | — | 5 liter |
| Processing of acidic solution | 35° C. | 10 sec | 30 ml | 5 liter |
| Drying | 90° C.–100° C. | 10 sec | | |

※ Replenisher amount represents that of per $m^2$ of the light-sensitive material.

Processing C

The light-sensitive material was processed using the processor illustrated in FIG. 1 in the way described below.

| Processing step | Temperature | Time | Replenisher amount | Tank Volume |
|---|---|---|---|---|
| Color development intensification | 38° C. | 45 sec | — | 5 liter |
| Coating of acidic solution | 25° C. | — | — | — |

(Coating processing by means of a processor described in Example 1 of JP-A-11-249274)

Coating amount of the processing solution: 20 cc/$m^2$.
Pitch P between nozzle hole: $(\sqrt{3})\cdot D/2$ or less=150 $\mu$m
Width of the nozzle: 5.5 cm (the term "width" herein used means a width from one end of a plurality of nozzle holes of the injection tank to the other (a direction intersecting to the moving direction of the light-sensitive material))

Length of coating: 12 cm (the term "length" herein used means a length at the time when a light-sensitive material is moved under a nozzle and an alkaline processing solution is coated thereon in a certain length)

Drying 90° C.–100° C. 10 sec

※ Replenisher amount represents that of per $m^2$ of the light-sensitive material.

| [Color Development Intensifier] | [Tank solution] |
|---|---|
| Water | 800 ml |
| Dimethylpolysiloxane-series surface active agent (Silicone KF351A, trade name: manufactured by Shinetsu Kagaku Kogyo Co.) | 0.1 g |
| Tri(isopropanol)amine | 8.8 g |
| Ethylenediaminetetraacetic acid | 4.0 g |
| Polyethylene glycol (MW 300) | 10.0 g |
| Sodium 4,5-dihydroxybenzene-1,3-disulfonate | 0.5 g |
| Potassium chloride | 5.0 g |
| Triazinylaminostilbene-series fluorescent whitening agent (Hakkol FWA-SF, trade name: manufactured by Showa Kagaku Co.) | 2.5 g |
| Sodium sulfite | 0.1 g |
| Disodium-N,N-bis(sulfonatoethyl) hydroxylamine | 8.5 g |
| N-Ethyl-N-(β-methanesulfonamidoethyl)-3-methyl-4-aminoaniline 3/2 sulfuric acid monohydrate | 5.0 g |
| Tripotassium phosphate | 40 g |
| Hydrogen peroxide (30% aqueous solution) | 15 ml |
| Water to make | 1000 ml |
| pH (adjusted by using potassium hydroxide and sulfuric acid at 25° C.) | 11 |

(Hydrogen peroxide was added just before the processing)

| | [Tank solution] | [Replenisher] |
|---|---|---|
| [Fixing solution] | | |
| Water | 700 ml | 700 ml |
| Sodium hydrogen sulfite | 18 g | 18 g |
| Sodium sulfite | 15.6 g | 15.6 g |
| Triazinylaminostilbene-series fluorescent brightening agent (WHITEX 4B, trade name: manufactured by Sumitomo Chemical Industry Co., Ltd.) | 5 g | 5 g |
| Ammonium thiosulfate (75%) | 10 cc | 10 cc |
| Water to make | 1000 ml | 1000 ml |
| pH (pH was adjusted by potassium hydroxide and sulfuric acid at 25° C.) | 7.0 | 7.0 |
| [Rinse Solution] | | |
| Sodium chlorinated-isocyanurate | 0.02 g | 0.02 g |
| Deionized water (having a conductivity of 5 $\mu$S/cm or below) | 1000 ml | 1000 ml |
| pH | 6.5 | 6.5 |
| [Acidic solution] | | |
| Citric acid (anhydride) | | 30 g |
| KBr | | 30 g |
| m-carboxybenzene sulfinic acid | | 5 g |
| Fluorescent brightening agent (Stil-1) | | 5 g |
| Water to make | | 1000 ml |
| pH | | 2 |

(Stil-1)

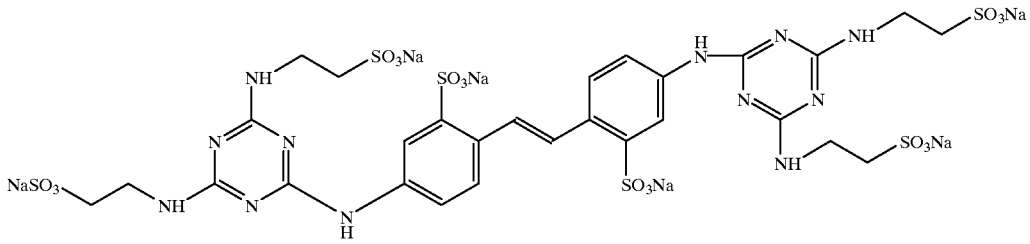

After giving a whole exposure to the prepared sample using a white light so that the exposed area ratio of the sample becomes 30%, the sample was subjected to a continuous (running) processing by using the foregoing Processing A. The running processing was carried out until the total replenishing amount to the fixing solution became two times the original volume of the fixing tank solution. Further, after giving a whole exposure to the prepared sample using a white light so that the exposed area ratio of the sample becomes 30%, the sample was subjected to a continuous (running) processing by using the foregoing Processing B. The running processing was carried out until the total replenishing amount to the fixing solution became two times the original volume of the fixing tank solution, while the sample was subjected to flesh processing in which a color development intensifier was replaced with a flesh one every square meter of the processed area. Thus, a running solution was prepared.

Further, gradation exposure was given to the prepared samples through a sensitometric three color separation optical wedge (filter) by using the FWH type sensitometer (color temperature of light source 3200 ° K.) manufactured by Fuji Photo Film Co., Ltd. Each exposed sample was processed by the above-described Processing A in which the fixing solution is a running solution, Processing B in which the acidic solution is a running solution, or Processing C. As a color development intensifier, a flesh solution was used.

After the processing, measurements of blue, green, and red optical reflective densities were performed for the maximum colored portion of each sample using a blue light, a green light, and a red light, and the resulting maximum optical densities were designated as Mb, Mg, and Mr, respectively. The obtained results are shown in Table 2.

TABLE 2

| | Mb | Mg | Mr | Remarks |
|---|---|---|---|---|
| Processing A | 2.41 | 2.45 | 2.39 | Comparative example |
| Processing B | 2.41 | 2.45 | 2.39 | Comparative example |
| Processing C | 2.41 | 2.45 | 2.39 | This invention |

It is apparent from Table 2 that high colored densities are also obtained even by the Processing C employing a coating step of an acidic solution, but free of both fixing and washing steps. Further, it was found that even though each sample was processed by the Processing C, the white back ground portion also had a pure whiteness which causes practically no problem.

Example 2

Similarly to the preparation of the light-sensitive material described in Example 1, the light-sensitive material (200) having the following layer composition was prepared.

Base

As the above-described base, a polyethylene resin-laminated paper [the polyethylene resin on the first layer side contained Fluorescent whitening agent (I) described below, a white pigment ($TiO_2$; content 15 wt %) and a blue dye (ultramarine)] was used.

First Layer (Blue-Sensitive Emulsion Layer)

Above-described silver chlorobromide emulsion A

| | |
|---|---|
| | 0.025 |
| Gelatin | 1.50 |
| Yellow coupler (ExY-5) | 0 23 |
| Color-developing compound (ExD-1) | 0.16 |
| Solvent (Solv-10) | 0.80 |
| Second Layer (Color-Mixing Inhibiting Layer) | |
| Gelatin | 1.00 |
| Color-mixing inhibitor (Cpd-4) | 0.05 |
| Color-mixing inhibitor (Cpd-5) | 0.07 |
| Color-image stabilizer (Cpd-6) | 0.007 |
| Color-image stabilizer (Cpd-7) | 0.14 |
| Color-image stabilizer (Cpd-13) | 0.006 |
| Solvent (Solv-1) | 0.06 |
| Solvent (Solv-2) | 0.22 |
| 1,5-diphenyl-3-pyrazolidone | 0.03 |
| (in the state of a fine-grain solid dispersion) | |
| Third Layer (Green-Sensitive Emulsion Layer) | |
| Above-described silver chlorobromide emulsion B | |
| | 0.012 |
| Gelatin | 1.50 |
| Magenta coupler (ExM-4) | 0.14 |
| Color-developing compound (ExD-1) | 0.24 |
| Color-image stabilizer (Cpd-22) | 0.54 |
| Solvent (Solv-11) | 0.56 |
| Fourth Layer (Color-Mixing Inhibiting Layer) | |
| Gelatin | 0.71 |
| Color-mixing inhibitor (Cpd-4) | 0.04 |
| Color-mixing inhibitor (Cpd-5) | 0.05 |
| Color-image stabilizer (Cpd-6) | 0.005 |
| Color-image stabilizer (Cpd-7) | 0.10 |
| Color-image stabilizer (Cpd-13) | 0.004 |
| Solvent (Solv-1) | 0.04 |
| Solvent (Solv-2) | 0.16 |
| 1,5-diphenyl-3-pyrazolidone | 0.02 |
| (in the state of a fine-grain solid dispersion) | |
| Fifth Layer (Red-Sensitive Emulsion Layer) | |
| Above-described silver chlorobromide emulsion C | |
| | 0.017 |
| Gelatin | 0.15 |
| Cyan coupler (ExC-5) | 0.21 |
| Color-developing compound (ExD-2) | 0.20 |
| Solvent (Solv-10) | 0.80 |
| Sixth Layer (Ultraviolet Absorbing Layer) | |
| Gelatin | 0.46 |
| Ultraviolet absorbing agent (UV-1) | 0.14 |
| Ultraviolet absorbing agent (UV-2) | 0.05 |

-continued

| | |
|---|---|
| Ultraviolet absorbing agent (UV-3) | 0.05 |
| Ultraviolet absorbing agent (UV-4) | 0.04 |
| Ultraviolet absorbing agent (UV-5) | 0.03 |
| Ultraviolet absorbing agent (UV-6) | 0.04 |
| Solvent (Solv-7) | 0.18 |
| Seventh Layer (Protective Layer) | |
| Gelatin | 1.00 |
| Acryl-modified copolymer of polyvinyl alcohol (modification degree: 17%) | 0.04 |
| Liquid paraffin | 0.02 |
| Surface-active agent (Cpd-14) | 0.01 |
| Surface-active agent (Cpd-15) | 0.01 |

(ExY-5)

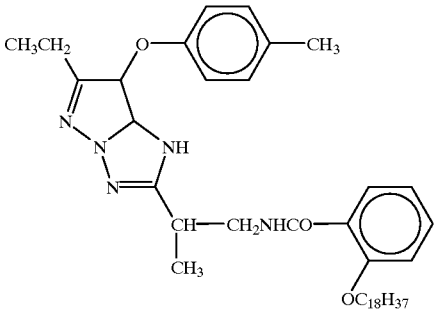

(ExM-4)

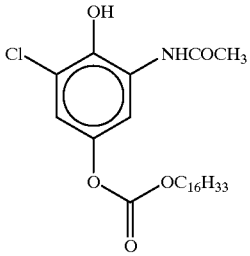

(ExC-5)

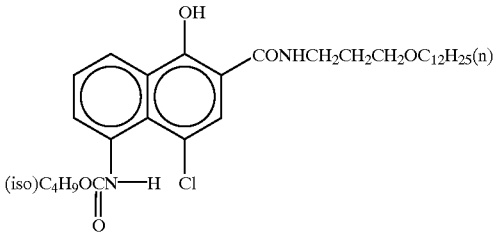

(ExD-1)

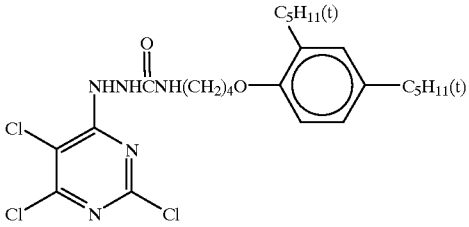

-continued (ExD-2)

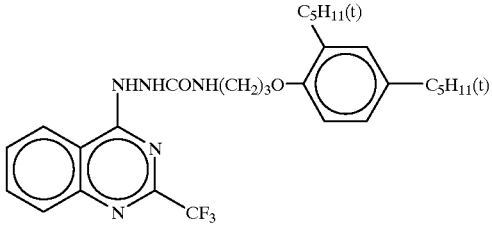

(Cpd-22)

$(C_8H_{17})_4N^+ \cdot \bar{O}_3SOC_{12}H_{25}$

Color-image stabilizer (Solv-10)

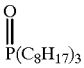

Solvent (Solv-11)

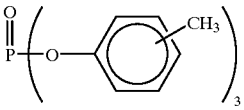

Solvent

Processing D

The light-sensitive material was processed using the processor illustrated in FIG. 4 in the way described below.

| Processing step | Temperature | Time | Replenisher amount | Tank Volume |
|---|---|---|---|---|
| Activator intensification development | 40° C. | 25 sec | 40 ml | 5 liter |
| Fixing | 35° C. | 20 sec | 30 ml | 5 liter |
| Rinse ① | 35° C. | 20 sec | — | 2 liter |
| Rinse ② | 35° C. | 20 sec | — | 2 liter |
| Rinse ③ | 35° C. | 20 sec | — | 2 liter |
| Rinse ④ | 35° C. | 30 sec | 90 ml | 3 liter |
| Drying | 70° C.–80° C. | 60 sec | | |

※ Replenisher amount represents that of per $m^2$ of the light-sensitive material.

(The rinse was performed by a counter-current piping system of three tanks from tank ③ to tank ①)

Processing E

The light-sensitive material was processed using the processor illustrated in FIG. 1 in the way described below.

| Processing step | Temperature | Time | Replenisher amount | Tank Volume |
|---|---|---|---|---|
| Activator intensification development | 40° C. | 25 sec | 40 ml | 5 liter |
| Coating of acidic solution | 25° C. | — | — | — |

(The processing was carried out in the same manner as in Processing C using a processing solution-coating apparatus which was employed in the Processing C)

Drying 90° C.–100° C. 10 sec

※ Replenisher amount represents that of per $m^2$ of the light-sensitive material.

Processing F

The light-sensitive material was processed using the processor illustrated in FIG. 2 in the way described below.

| Processing step | Temperature | Time | Replenisher amount | Tank Volume |
|---|---|---|---|---|
| Coating of activator intensifier | 45° C. | — | — | — |

(The processing was carried out in the same manner as in Processing C using a processing solution-coating apparatus which was employed in the Processing C, except that the coating amount of the activator intensifier was adjusted to 40 $ml/m^2$)

| | | | | |
|---|---|---|---|---|
| Standing on a heat panel | 45° C. | 18 sec | | |
| Coating of acidic solution | 25° C. | — | — | — |

(The processing was carried out in the same manner as in Processing C using a processing solution-coating apparatus which was employed in the Processing C)

Drying 90° C.–100° C. 10 sec

Processing G

The light-sensitive material was processed using the processor illustrated in FIG. 3 in the way described below.

| Processing step | Temperature | Time | Replenisher amount | Tank Volume |
|---|---|---|---|---|
| Coating of alkali activation solution | 45° C. | — | — | — |

(The processing was carried out in the same manner as in Processing C using a processing solution-coating apparatus which was employed in the Processing C)

Coating of 45° C.
hydrogen peroxide
containing solution (The processing was carried out in the same manner as in Processing C using a processing solution-coating apparatus which was employed in the Processing C)

| | | | | |
|---|---|---|---|---|
| Standing on a heat panel | 45° C. | 18 sec | — | |
| Coating of acidic solution | 25° C. | — | — | — |

(The processing was carried out in the same manner as in Processing C using a processing solution-coating apparatus which was employed in the Processing C)

Drying 90° C.–100° C. 10 sec

| | [Tank solution] | [Replenisher] |
|---|---|---|
| [Activator intensification developer] | | |
| Water | 700 ml | 700 ml |
| Sodium 5-sulfosalicylate | 25 g | 25 g |
| Potassium chloride | 1.25 g | 1.25 g |
| Benzotriazole | 0.01 g | 0.01 g |
| Hydroxyethylidene-1,1-diphosphonic acid (30% aqueous solution) | 4 ml | 4 ml |
| Fluorescent brightening agent (Stil-1) | 5 g | 5 g |
| Hydrogen peroxide solution (30%) | 20 ml | 20 ml |
| Water to make | 1000 ml | 1000 ml |
| pH (pH was adjusted by potassium hydroxide and sulfuric acid at 25° C.) | 12.0 | 12.0 |
| [Activator intensifier] | | |
| Water | 700 ml | |
| Sodium 5-sulfosalicylate | 25 g | |
| Potassium chloride | 1.25 g | |
| Benzotriazole | 0.01 g | |
| Hydroxyethylidene-1,1-diphosphonic acid (30% aqueous solution) | 4 ml | |
| Fluorescent brightening agent (Stil-1) | 5 g | |
| Water to make | 1000 ml | |
| pH (pH was adjusted by potassium hydroxide and sulfuric acid at 25° C.) | 12.0 | |
| [Hydrogen peroxide-containing solution] | | |
| Water | 800 ml | |
| Aqueous hydrogen peroxide solution (30%) | 30 ml | |
| Hydroxyethylidene-1,1-diphosphonic acid (30% aqueous solution) | 4 ml | |
| Fluorescent brightening agent (Stil-1) | | |
| Water to make | 1000 ml | 1000 ml |
| pH | 5.5 | 5.5 |

[Fixing solution]

The same stabilizing solution as used in the Processing C

[Rinse solution]

The same rinse solution as used in the Processing C

[Acidic solution]

The same acidic solution as used in the Processing C, except that m-carboxybenzene sulfinic acid is omitted therefrom.

The prepared sample (200), after an exposure was given thereto in the same manner as in Example 1, was processed by Processing D, E, F, or G, respectively. Each sample was evaluated in the same manner as in Example 1, except that after the processing, measurements of blue, green, and red optical reflective densities were also performed for the minimum colored portion of each sample using a blue light, a green light, and a red light, and the resulting minimum optical densities were designated as Lb, Lg, and Lr, respectively.

The obtained results are shown in Table 3.

TABLE 3

| | Mb | Mg | Mr | Lb | Lg | Lr | Remarks |
|---|---|---|---|---|---|---|---|
| Processing D | 2.42 | 2.56 | 1.61 | 0.06 | 0.11 | 0.08 | Comparative example |
| Processing E | 2.42 | 2.56 | 1.61 | 0.06 | 0.11 | 0.08 | This invention |

TABLE 3-continued

| | Mb | Mg | Mr | Lb | Lg | Lr | Remarks |
|---|---|---|---|---|---|---|---|
| Processing F | 2.55 | 2.64 | 1.68 | 0.06 | 0.11 | 0.08 | This invention |
| Processing G | 2.58 | 2.67 | 1.75 | 0.06 | 0.11 | 0.08 | This invention |

It is apparent from Table 3 that an excellent image having a well-balanced S/N ratio can be also obtained by coating such an acidic solution, while omitting both the fixing and washing steps, in the case where a light-sensitive material incorporating therein a color developing compound such as ExD-1 and ExD-2 is processed with an activator intensifier. In this case, no p-phenylenediamine derivatives are contained in the light-sensitive material and a stain resulting from the p-phenylenediamine derivatives is not generated. Accordingly, it is understood that when compared to the results of Example 1, the Table 3 shows smaller minimum color densities, i.e., a lower stain. Further, in this case, it is found that an excellent image having a well-balanced S/N ratio can be also obtained by coating the above-described acidic solution, in the case where an activator intensifier is applied by a coating processing in which no processing tank is needed. Further, it is known from Table 3 that an excellent image having a well-balanced S/N ratio can be also obtained by coating the above-described acidic solution, even in the case where an activator intensifier is divided into an alkali-activated solution and a hydrogen peroxide-containing solution in order to improve liquid stability of the activator intensifier.

Example 3

After an exposure is given thereto in the same manner as in Example 2, the sample (200) prepared in Example 2 was processed by the same Processing G as used in Example 2, except that the standing time on a heat panel was changed to 3 sec, 10 sec, 18 sec, 28 sec and 35 sec, respectively.

Each processed sample was evaluated in the same manner as in Example 2.

The obtained results are shown in Table 4.

TABLE 4

| Standing on a heat panel | Mb | Mg | Mr | Lb | Lg | Lr | Remarks |
|---|---|---|---|---|---|---|---|
| 3 sec | 2.05 | 2.10 | 1.20 | 0.06 | 0.10 | 0.08 | This invention |
| 10 sec | 2.45 | 2.56 | 1.62 | 0.06 | 0.11 | 0.08 | This invention |
| 18 sec | 2.58 | 2.67 | 1.75 | 0.06 | 0.11 | 0.08 | This invention |
| 28 sec | 2.58 | 2.67 | 1.75 | 0.07 | 0.12 | 0.09 | This invention |
| 35 sec | 2.58 | 2.67 | 1.75 | 0.09 | 0.14 | 0.12 | This invention |

It is known from Table 4 that an image having a well-balanced S/N ratio can be also obtained by the standing time of 10 sec, 18 sec, or 28 sec, whereas the color density is insufficient in the case of 3 sec, and the density at the minimum density portion increases in the case of 40 sec, which results in deterioration of the S/N ratio.

Example 4

Acidic solutions ① to ⑧ were prepared. These solutions are the same as the acidic solution used in Example 2, except that silver complex-forming agents as shown in Table 5 are used in place of KBr. However, the amount of a silver complex-forming agent to be used was adjusted to 1/10 time the mol of KBr. After an exposure is given thereto in the same manner as in Example 2, the sample (200) prepared in Example 2 was processed by Processing H to 0, which were the same as Processing G, except that the acidic solution therein was replaced by the foregoing acidic solutions (① to ⑧, respectively.

Each processed sample was evaluated in the same manner as in Example 2. The obtained results are shown in Table 5.

TABLE 5

| | Silver complex-forming agent | Mb | Mg | Mr | Lb | Lg | Lr | Remarks |
|---|---|---|---|---|---|---|---|---|
| Processing G | KBr | 2.58 | 2.67 | 1.75 | 0.06 | 0.11 | 0.08 | This invention |
| Processing H | A-8 | 2.58 | 2.67 | 1.75 | 0.06 | 0.11 | 0.08 | This invention |
| Processing I | A-14 | 2.58 | 2.67 | 1.75 | 0.06 | 0.11 | 0.08 | This invention |
| Processing J | A-13 | 2.58 | 2.67 | 1.75 | 0.06 | 0.11 | 0.08 | This invention |
| Processing K | B-1 | 2.58 | 2.67 | 1.75 | 0.08 | 0.13 | 0.10 | This invention |
| Processing L | C-1 | 2.40 | 2.58 | 1.71 | 0.08 | 0.13 | 0.10 | This invention |
| Processing M | C-2 | 2.40 | 2.58 | 1.71 | 0.08 | 0.13 | 0.10 | This invention |
| Processing N | D-1 | 2.40 | 2.58 | 1.71 | 0.08 | 0.13 | 0.10 | This invention |
| Processing O | D-6 | 2.40 | 2.58 | 1.71 | 0.08 | 0.13 | 0.10 | This invention |

It is apparent from Table 5 that when a complex-forming agent such as A-8, A-14 and A-13 is used, each of Mb, Mg, Mr, Lb, Lg and Lr shows a good value, while the values of Lb, Lg and Lr slightly increase by the use of a compound such as B-1, and the values of Mb, Mg and Mr slightly decrease by the use of C-1, C-2, D-1 and D-6. It is concluded that a well-balanced S/N ratio can be obtained by the use of the foregoing complex-forming agent for use in the present invention.

Example 5

Samples (201) to (208) were prepared in the same manner as Sample (200), except that the coupler and the color developing compound in the third layer were replaced by those compounds shown in Table E, and (Solv-10) was replaced by a half amount of (Solv-5), and further (Cpd-22) was added in an amount of 400 mol % of the color developing compound.

After an exposure is given thereto in the same manner as in Example 2, the prepared sample was processed by Processing G. Thereafter, evaluation was conducted in the same manner as in Example 2.

Further, to each unprocessed sample, an exposure to green light was given so that a magenta color density after processing became about 1. After exposure, the sample was processed in the same manner as in Processing F. The processed sample was observed by the naked eye, and evaluation was conducted according to the following criteria (evaluation standard):

There is almost no streaks (unevenness), and an uniform coloring is seen: ○

Streaks are seen : X

The obtained results are shown in Table 6.

TABLE 6

| Sample No. | Color developing compound | Coupler | Mg | Lg | Streaks | Remarks |
|---|---|---|---|---|---|---|
| (200) | ExD-2 | ExM-4 | 2.67 | 0.11 | X | This invention |
| (201) | R-1 | (1) | 2.69 | 0.10 | ○ | This invention |
| (202) | R-6 | (1) | 2.68 | 0.10 | ○ | This invention |
| (203) | R-10 | (2) | 2.68 | 0.10 | ○ | This invention |
| (204) | R-31 | (2) | 2.67 | 0.10 | ○ | This invention |
| (205) | R-57 | (44) | 2.64 | 0.10 | ○ | This invention |
| (206) | R-58 | (3) | 2.60 | 0.10 | ○ | This invention |
| (207) | R-76 | (36) | 2.62 | 0.10 | ○ | This invention |
| (208) | R-1 | (8) | 2.61 | 0.10 | ○ | This invention |

From the results of Table 6, it is understood that streaks resulting from a processing can be substantially prevented by using both the coupler and color developing compound according to the present invention, and also by carrying out the processing of the present invention.

Example 6

With respect to the samples used in the foregoing Example 2, evaluation was conducted in the same manner as in Example 2, except that the exposure was replaced by the following exposure.

(Exposure to light)

Light having a wavelength of 473 nm, taken out by wavelength conversion of a YAG solid laser (oscillation wavelength, 946 nm) by an SHG crystal of $KNbO_3$, using, as a light source, a semiconductor laser GaAlAs (oscillation wavelength, 808.5 nm) serving as an excitation light source; light having a wavelength of 532 nm, taken out by wavelength conversion of a $YVO_4$ solid laser (oscillation wavelength, 1064 nm) by an SHG crystal of KTP, using, as a light source, a semiconductor laser GaAlAs (oscillation wavelength: 808.7 nm) serving as an excitation light source; and light from AlGaInP (oscillation wavelength, about 670 nm; Type No. TOLD 9211, manufactured by Toshiba Corporation) were used. The laser beams of the apparatus could be scanned successively by a rotating polyhedron over a color print paper moved vertically to the scanning direction for exposure to light. Using this apparatus, the amount of light was varied, to find the relationship D-logE between the density (D) of the light-sensitive material and the amount of light (E). At that time, with respect to the laser beams having three wavelengths, the amounts of the lights were modulated using an external modulator, to control the exposure amounts. In this scanning exposure, the density of the picture element was 400 dpi, and the average exposure time per picture element was about $5\times10^{-8}$ sec. The temperature of the semiconductor lasers was kept constant by using Peltier elements to suppress the fluctuation of the amounts of lights due to the temperature.

As a result, it was found that similarly to the results shown in Example 2, a well-balanced S/N ratio with respect to the image formed by a high intensity digital exposure was able to obtain by the processing of the present invention.

Having described our invention as related to the present embodiments, it is our intention that the invention not be limited by any of the details of the description, unless otherwise specified, but rather be construed broadly within its spirit and scope as set out in the accompanying claims.

What we claim is:

1. A method for forming a color image that comprises processing a silver halide color photographic light-sensitive material having at least one photographic constitutional layer on a support, wherein the processing substantially comprises the steps of:

a) developing, and subsequent thereto b) supplying an acidic solution having a pH of 4 or less, in the form of a thin layer, onto the light-sensitive material, so as to have a coverage of 30 $ml/m^2$ or less; and wherein the total of the coated silver amount in each of the coating layers of the light-sensitive material is in the range of 0.003 to 0.3 $g/m^2$ in terms of silver.

2. The method for forming a color image as claimed in claim 1, wherein the period of time necessitated after a developer is supplied onto the light-sensitive material in the developing step a), until the acidic solution is supplied thereon, in the form of a thin layer, is in the range of 5 sec to 30 sec.

3. The method for forming a color image as claimed in claim 1, wherein a developer is supplied, in the form of a thin layer, in the developing step a).

4. The method for forming a color image as claimed in claim 3, wherein the volume ratio of the amount of the acidic solution, to the amount of the developer to be supplied onto the light-sensitive material, is in the range of 1/100 to 1/1.

5. The method for forming a color image as claimed in claim 1, wherein the acidic solution having a pH of 4 or less contains at least one kind of compounds selected from a group consisting of a nitrogen-containing heterocyclic compound having a sulfido group, a mesoionic compound, a thioether compound, a thiourea compound, a bromide salt, and an iodide salt.

6. The method for forming a color image as claimed in claim 1, wherein the silver halide color photographic light-sensitive material contains a compound capable of forming a dye having an absorption in the visible region by a coupling reaction between a coupler and an oxidation product of the compound ascribable to at least one kind of silver halide, or a precursor of the compound; and wherein the developer is an alkaline processing solution substantially free of a color-developing agent.

7. The method for forming a color image as claimed in claim 6, wherein the compound capable of forming a dye having an absorption in the visible region by a coupling reaction between a coupler and an oxidation product of the compound ascribable to at least one kind of silver halide, is represented by the following formula (I):

formula (I)

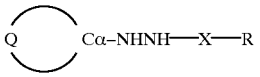

wherein Cα represents a carbon atom; R represents a substituted or unsubstituted, alkyl group, aryl group, or heterocyclic group; Q represents an atomic group necessary to form an unsaturated ring with Cα; X represents $—SO_2—$, —CO—, —COCO—, —CO—O—, —CON(R')—, —COCO—O—, —COCO—N(R')— or —$SO_2$—N(R')—, wherein R' represents a hydrogen atom or the groups defined by R.

8. The method for forming a color image as claimed in claim 7, wherein X in formula (I) is —CONH—.

9. The method for forming a color image as claimed in claim 7, wherein a compound represented by formula (II), and a coupler represented by formula (III), are incorporated in the same layer:

formula (II)

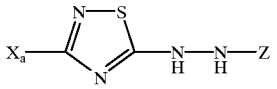

wherein $X_a$ represents a halogen atom, an aliphatic thio group, an aliphatic sulfinyl group, an aliphatic sulfonyl group, an arylthio group, an aryl sulfinyl group, an aryl sulfonyl group, a sulfamoyl group, or a substituent substituted with —COOH, —$NHSO_2R$, —$SO_2NHR$, —$SO_2NHCOR$, —$CONHSO_2R$, —OH, or —SH; and Z represents a carbamoyl group, an acyl group, an alkoxy carbonyl group, or an aryloxy carbonyl group:

formula (III)

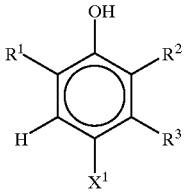

wherein $R^1$ represents an alkyl group; $R^2$ and $R^3$ each represent a hydrogen atom or a substituent; $X^1$ represents a group cleavable by coupling with an oxidation product of the color-developing agent, provided that a halogen-substituted alkyl group is excluded from $R^1$.

10. The method for forming a color image as claimed in claim 1, wherein the exposure time per picture element (pixel) is in the range of $10^{-8}$ to $10^{-4}$ sec, with a scanning exposure system providing overlap between raster adjacent to each other.

11. The method for forming a color image as claimed in claim 6, wherein the alkaline processing solution contains hydrogen peroxide and/or a hydrogen peroxide releasing compound.

12. The method for forming a color image as claimed in claim 6, wherein after the alkaline processing solution is supplied, a solution containing hydrogen peroxide and/or a hydrogen peroxide releasing compound is supplied onto the light-sensitive material, in the developing step a).

* * * * *